US006379878B1

(12) United States Patent
Matsuda et al.

(10) Patent No.: US 6,379,878 B1
(45) Date of Patent: Apr. 30, 2002

(54) SILVER HALIDE COLOR PHOTOSENSITIVE MATERIAL

(75) Inventors: Naoto Matsuda; Yoshio Shimura; Tetsuo Nakamura; Hisashi Mikoshiba, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/580,658

(22) Filed: May 26, 2000

(30) Foreign Application Priority Data

May 28, 1999 (JP) ..... 11-149800
Feb. 24, 2000 (JP) ..... 2000-048220

(51) Int. Cl.[7] ..... G03C 1/46

(52) U.S. Cl. ..... 430/505; 430/558; 430/550; 430/570; 430/581; 430/585; 430/587

(58) Field of Search ..... 430/505, 543, 430/558, 550, 570, 581, 585, 587

(56) References Cited

U.S. PATENT DOCUMENTS 4,764,456 A * 8/1988 Watanabe et al. ..... 430/558
4,994,351 A 2/1991 Haga et al.
5,024,925 A 6/1991 Deguchi

* cited by examiner

*Primary Examiner*—Geraldine Letscher
(74) *Attorney, Agent, or Firm*—Birch, Stewart, Kolasch & Birch, LLP

(57) ABSTRACT

A silver halide color photosensitive material having at least one blue-sensitive emulsion layer, at least one green-sensitive emulsion layer, and at least one red-sensitive emulsion layer on a support, wherein the red-sensitive emulsion layer has the maximum value of sensitivity in a wavelength region of 580 nm to 650 nm, and the green-sensitive emulsion layer contains at least one magenta coupler represented by formula (MC-1) below:

(MC-1)

wherein the substituent are defined herein the specification.

20 Claims, No Drawings

SILVER HALIDE COLOR PHOTOSENSITIVE MATERIAL

CROSS-REFERENCE TO RELATED APPLICATIONS

This application is based upon and claims the benefit of priority from the prior Japanese Patent Applications No. 11-149800, filed May 28, 1999; and No. 2000-048220, filed Feb. 24, 2000, the entire contents of which are incorporated herein by reference.

BACKGROUND OF THE INVENTION

The present invention relates to a silver halide color photosensitive material and, more particularly, to a silver halide color photosensitive material having improved color reproduction.

Recently, silver halide color photosensitive materials are strongly required to have superior color reproduction in addition to high sensitivity with which photographing is possible, high sharpness, and high graininess.

In particular, purplish colors which reflect light having longer wavelengths than 580 nm are reproduced as colors much more reddish than the actual ones. It is pointed out that one cause of this inconvenience is that the maximum sensitivity wavelength of the spectral sensitivity distribution of red-sensitive layers of many color photosensitive materials for photographing, e.g., many color reversal films, is much longer than 605 nm (in many cases longer than 640 nm) which is the wavelength of the spectral sensitivity peak of the longest wavelength of three sensory organs of the human eye. For the purposes of obtaining faithful color reproduction and providing a photographing sensitive material which does not largely changes its color reproduction during photographing under various light sources, U.S. Pat. No. 3,672,898 has disclosed a method of restricting the spectral sensitivity distributions of blue-, green-, and red-sensitive layers to certain ranges. According to this patent, purplish hue reproduction can be effectively improved by shifting the spectral sensitivity distribution of a red-sensitive layer to a shorter wavelength and approaching the maximum sensitivity wavelength of the spectral sensitivity distribution of that red-sensitive layer to 605 nm.

Unfortunately, the following problems arise in providing a color film which faithfully reproduces the hue and perceived chroma of an object to be photographed by shifting the spectral sensitivity distribution of a red-sensitive layer to a shorter wavelength.

First, when the spectral sensitivity wavelength of a red-sensitive layer is shortened, purple is faithfully reproduced. However, the sensitivity of this red-sensitive emulsion layer to red light becomes insufficient, so the color reproduction of red becomes cyanic and this lowers the saturation. As a method of solving this problem and improving both the saturation and the hue reproduction, Jpn. Pat. Appln. KOKAI Publication No. (hereafter referred to as JP-A-)62-49354, whose corresponding U.S. application is now patented to U.S. Pat. No. 4,764,456, has disclosed a method of using pyrazoloazole couplers as magenta couplers. Also, JP-A-2-124566 has proposed a method of improving saturation by enhancing the interlayer effect to red-sensitive emulsion layers in a color reversal photosensitive material, thereby improving both hue and faithfulness. Furthermore, in examples of this publication the use of 2-equivalent pyrazolotriazole couplers is described.

When, however, the present inventors examined the application of 2-equivalent pyrazoloazole couplers to color reversal photosensitive materials, it turned out that the saturation of red did not improve as expected and green became impure to lower its saturation when 2-equivalent pyrazoloazole couplers were used in green-sensitive layers, compared to conventionally used 4-equivalent pyrazolone magenta couplers. When the spectral sensitivity of a red-sensitive emulsion layer is shortened, the saturation of red and green naturally lowers. Therefore, a further lowering of the saturation of green is a serious problem when the spectral sensitivity wavelength of a red-sensitive emulsion layer is relatively shortened.

A method which uses an asymmetrical trimethinecyanine dye (e.g., one is a benzoxazole derivative and the other is a benzothiazole derivative) as represented by formula (I) described in JP-A-2-124566, whose corresponding U.S. application is now patented to U.S. Pat. No. 5,024,925, is an effective means for shortening the wavelength of the spectral sensitivity distribution of a red-sensitive layer. Also, JP-A-62-49354 describes in its examples the combined use of sensitizing dyes in this category and 2-equivalent pyrazoloazole couplers. However, when the present inventors used 2-equivalent pyrazoloazole magenta couplers and also used large amounts of sensitizing dyes effective to wavelength shortening in in red-sensitive layers, the sensitizing dyes remained after development and colored white portions. Since coloration of white portions in particularly color reversal photosensitive materials largely impairs the product value, coloration after processing is unallowable, so a certain solution is being strongly demanded. On the other hand, the use of 4-equivalent pyrazoloazole couplers in color reversal photosensitive materials is disclosed in, e.g., JP-A-63-153548, whose corresponding U.S. application is now patented to U.S. Pat. No. 4,994,351. However, this JP-A-63-153548 has not disclosed the difference between the color reproduction effects of 2- and 4-equivalent couplers and the combination of these couplers with the aforementioned sensitizing dyes. That is, the problems which the present inventors encountered, i.e., the problem of color reproduction of 2-equivalent pyrazoloazole couplers or of the combination of 2- and 4-equivalent pyrazoloazole couplers and the problem of coloration of white portions caused by residual sensitizing dyes are unknown problems.

BRIEF SUMMARY OF THE INVENTION

It is an object of the present invention to provide a silver halide color photosensitive material having improved reproduction of hue and perceived chroma and, more specifically, to apply this material to a color reversal photosensitive material which is subjected to reversal processing and color development after black-and-white development.

The above object of the present invention is achieved by the following.

(1) A silver halide color photosensitive material having at least one blue-sensitive emulsion layer, at least one green-sensitive emulsion layer, and at least one red-sensitive emulsion layer on a support, wherein the red-sensitive emulsion layer has the maximum value of sensitivity in a wavelength region of 580 nm to 650 nm, and the green-sensitive emulsion layer contains at least one magenta coupler represented by formula (MC-1) below:

(MC-1)

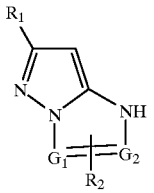

wherein $R_1$ represents a substituent selected from the group consisting of a secondary or tertiary alkyl group, an aryl group, an alkoxy group, an aryloxy group, an amino group, an acylamino group, an arylthio group, an alkylthio group, an aminocarbonylamino group, an alkoxycarbonylamino group, a carbamoyloxy group, and a heterocyclic thio group. These substituents may be substituted or unsubstituted. Each of $G_1$ and $G_2$ represents a nitrogen atom or a carbon atom. When $G_1$ is a nitrogen atom, $G_2$ is a carbon atom; when $G_2$ is a nitrogen atom, $G_1$ is a carbon atom. $R_2$ substitutes one of $G_1$ and $G_2$ which is a carbon atom, and represents a substituent. A group represented by formula (MC-1) can further substitute via $R_1$ or $R_2$ to form a polymer. Also, a group represented by formula (MC-1) can bond to a polymer chain via $R_1$ or $R_2$.

(2) A silver halide color photosensitive material having at least one blue-sensitive emulsion layer, at least one green-sensitive emulsion layer, and at least one red-sensitive emulsion layer on a support, wherein the red-sensitive emulsion layer contains a sensitizing dye represented by formula (SD-1) below at a molar ratio of 10% to 100% with respect to all the sensitizing dyes in the layer, and the green-sensitive emulsion layer contains at least one magenta coupler represented by formula (MC-1) described in item (1):

(SD-1)

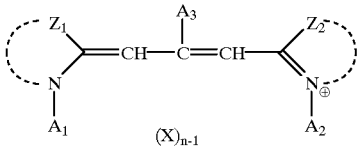

wherein $Z_1$ represents an atomic group necessary to form a heterocyclic ring selected from the group consisting of substituted or nonsubstituted benzoimidazole, benzoxazole, and naphthoxazole. $Z_2$ represents an atomic group necessary to form a heterocyclic ring selected from the group consisting of substituted or nonsubstituted benzothiazole, benzoselenazole, naphthothiazole, naphthoselenazole, and benzotellurazole. Each of $A_1$ and $A_2$ represents a substituted or nonsubstituted alkyl group. $A_3$ represents a hydrogen atom, an alkyl group, or an aryl group. X represents a cation, and n is 1 or 2. n is 1 when an intramolecular salt is to be formed.

(3) A silver halide color photosensitive material having at least one blue-sensitive emulsion layer, at least one green-sensitive emulsion layer, and at least one red-sensitive emulsion layer on a support, wherein a quality factor indicating the consistency between the spectral sensitivity of the red-sensitive emulsion layer and the color sensitivity of a human is 0.9 or more, and the green-sensitive emulsion layer contains at least one type of a magenta coupler represented by formula (MC-1) described in item (1).

(4) The silver halide color photosensitive material described in item (2), wherein the red-sensitive emulsion layer has the maximum value of sensitivity in a wavelength region of 580 to 650 nm, or a quality factor indicating the consistency between the spectral sensitivity of the red-sensitive emulsion layer and the color sensitivity of a human is 0.9 or more.

(5) A silver halide color photosensitive material having at least one blue-sensitive emulsion layer, at least one green-sensitive emulsion layer, and at least one red-sensitive emulsion layer on a support, wherein the silver halide color photosensitive material further has a photosensitive silver halide emulsion layer which does not substantially generate an image dye but imparts the interimage effect to another layer, and the green-sensitive emulsion layer contains at least one magenta coupler represented by formula (MC-1) described in item (1).

DETAILED DESCRIPTION OF THE INVENTION

The present invention will be described in detail below.

First, formula (MC-1) will be explained.

In formula (MC-1), $R_1$ represents a substituent selected from the group consisting of a secondary or tertiary alkyl group, an aryl group, an alkoxy group, an aryloxy group, an amino group, an acylamino group, an arylthio group, an alkylthio group, an aminocarbonylamino group, an alkoxycarbonylamino group, a carbamoyloxy group, and a heterocyclic thio group. These substituents can have a substituent. Examples of this substituent are groups represented by $R_2$ to be described later.

Specific examples of $R_1$ are a secondary or tertiary alkyl group (e.g., isopropyl, t-butyl, t-amyl, adamantyl, 1-methylcylopropyl, t-octyl, cyclohexyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-amylphenoxy)propyl, benzyl, 4-methoxybenzyl, and 2-methoxybenzyl), an aryl group (e.g., phenyl, 4-t-butylphenyl, 2,4-di-t-amylphenyl, and 4-tetradecaneamidophenyl), an alkoxy group (e.g., methoxy, ethoxy, 2-methoxyethoxy, 2-dodecylethoxy, 2-methanesulfonylethoxy, and 2-phenoxyethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoylhpenoxy), an amino group (including an anilino group; e.g., methylamino, ethylamino, anilino, dimethylamino, diethylamino, t-butylamino, 2-methoxyanilino, 3-acetylaminoanilino, and cyclohexylamino), an acylamino group (e.g., acetamide, benzamide, tetradecaneamide, 2-(2,4-di-t-amylphenoxy)butaneamide, 4-(3-t-butyl-4-hydroxyphenoxy)butaneamide, and 2-{4-(4-hydroxyphenylsulfonyl)phenoxy}decaneamide), an aminocarbonylamino group (e.g., carbamoylamino, N,N-dimethylaminocarbonylamino, and morpholinocarbonylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), an alkoxycarbonylamino group (e.g., methoxycarbonylamino and tetradecyloxycarbonylamino), a carbamoyloxy group (e.g., N-methylcarbamoyloxy and N-phenylcarbamoyloxy), and a heterocyclic thio group (e.g., 2-benzothiazolylthio, 2,4-di-phenoxy-1,3,5-triazole-6-thio, and 2-pyridylthio).

Of these substituents, a secondary or tertiary alkyl group having a total number of carbon atoms of 3 to 30, an aryl group, an alkoxy group, an aryloxy group, and an amino group are preferable, a secondary or tertiary alkyl group having a total number of carbon atoms of 3 to 15 is more preferable, and a tertiary alkyl group having a total number of carbon atoms of 4 to 10 is most preferable.

One of $G_1$ and $G_2$ is a nitrogen atom, the other is a carbon atom, and $R_2$ in formula (MC-1) substitutes one of $G_1$ and $G_2$ which is a carbon atom.

$R_2$ represents a substituent. Examples of this substituent are a halogen atom, alkyl group, aryl group, heterocyclic group, cyano group, hydroxyl group, nitro group, carboxyl group, amino group, alkoxy group, aryloxy group, acylamino group, alkylamino group, anilino group, aminocarbonylamino group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imide group, heterocyclic thio group, sulfinyl group, phosphonyl group, aryloxycarbonyl group, acyl group, and azolyl group. These substituents can have a substituent.

More specifically, examples of the substituent represented by $R_2$ are a halogen atom (e.g., a chlorine atom and a bromine atom), an alkyl group {e.g., a straight-chain or branched-chain alkyl group, and a cycloalkyl group (more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecaneamido}phenyl}propyl, 2-ethoxytridecyl, trifluoromethyl, cyclopentyl, and 3-(2,4-di-t-amylphenoxy) propyl)), an alkenyl group (e.g. vinyl, allyl and prenyl), an alkinyl group (e.g. ethynyl and propargyl)}, an aryl group (e.g., phenyl, 4-t-butylphenyl, 2,4-di-t-amylphenyl, and 4-tetradecaneamidophenyl), a heterocyclic group (e.g., 2-furyl, 2-thienyl, 2-pyrimidinyl, and 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy), an acylamino group (e.g., acetamide, benzamide, tetradecaneamide, 2-(2,4-di-t-amylphenoxy)butaneamide, 4-(3-t-butyl-4-hydroxyphenoxy)butaneamide, 2-{4-(4-hydroxyphenylsulfonyl)phenoxy}decaneamide), an alkylamino group (e.g., methylamino, butylamino, dodecylamino, diethylamino, and methylbutylamino), an anilino group (e.g., phenylamino, 2-chloroanilino, 2-chloro-5-tetradecaneaminoanilino, 2-chloro-5-dodecyloxycarbonylanilino, N-acetylanilino, and 2-chloro-5-{a-(3-t-butyl-4-hydroxyphenoxy) dodecaneamido}anilino), a ureido group (e.g., phenylureido, methylureido, and N,N-dibutylureido), sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), an alkoxycarbonylamino group (e.g., methoxycarbonylamino and tetradecyloxycarbonylamino), a sulfonamide group (e.g., methanesulfonamide, hexadecanesulfonamide, benzenesulfonamide, p-toluenesulfonamide, octadecanesulfonamide, 2-methyloxy-5-t-butylbenzenesulfonamide), a carbamoyl group (e.g., N-ethylcarbamoyl, N,N-dibutylcarbamoyl, N-(2-dodecyloxyethyl)carbamoyl, N-methyl-N-dodecylcarbamoyl, and N-(3-(2,4-di-t-amylphenoxy) propyl)carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazole-5-oxy and 2-tetrahydropyranyloxy), an azo group (e.g., phenylazo, 4-methoxphenylazo, 4-pyvaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imide group (e.g., N-succinimide, N-phthalimide, and 3-octadecenylsuccinimide), a heterocyclic thio group (e.g., 2-benzothiazolylthio, 2,4-di-phenoxy-1,3,5-trizole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), an acyl group (e.g., acetyl, 3-phenylpropanoyl, benzoyl, and 4-dodecyloxybenzoyl), and an azolyl group (e.g., imidazolyl, pyrazolyl, 3-chloro-pyrazole-1-yl, and triazole).

A group in which a group represented by $R_2$ can further have a substituent can further have an organic substituent, which couples by a carbon atom, oxygen atom, nitrogen atom, or sulfur atom, or a halogen atom.

Preferable examples of $R_2$ are an alkyl group, aryl group, alkoxy group, aryloxy group, alkylthio group, ureido group, alkoxycarbonylamino group, and acylamino group. Furthermore, $R_2$ is preferably a group having a total number of carbon atoms of 6 to 70, which contains a 6- to 70-carbon alkyl group or an aryl group as a partial structure, and preferably gives immobility to a coupler represented by formula (MC-1). In the specification, the phrase "a substituent having an alkyl group as a partial structure" includes the case where the substituent itself is the alkyl group, as well as the substituent has the alkyl group as a further substituent, if possible. The same can be applied to "a substituent having an aryl group (or another group) as a partial structure", if possible. That is, "a group having an aryl group as a partial structure" includes the case where the group as a whole is the aryl group, as well as the group is substituted with the aryl group, if possible.

In formula (MC-1), $R_2$ is more preferably a compound which is a substituent represented by formula (BL-1) or (BL-2) below:

(BL-1)

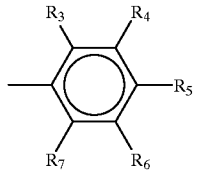

(BL-2)

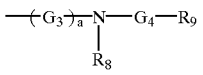

In formula (BL-1), each of $R_3$, $R_4$, $R_5$, $R_6$, and $R_7$ independently represents a hydrogen atom or a substituent, and at least one of them represents a substituent having a total number of carbon atoms of 4 to 70 and containing a substituted or nonsubstituted alkyl group as a partial structure, or a substituent having a total number of carbon atoms of 6 to 70 and containing a substituted or nonsubstituted aryl group as a partial structure.

A group represented by formula (BL-1) will be described below.

Each of $R_3$, $R_4$, $R_5$, $R_6$, and $R_7$ independently represents a hydrogen atom or a substituent. Examples of this substituent are those enumerated above for $R_2$. At least one of $R_3$, $R_4$, $R_5$, $R_6$, and $R_7$ is a substituent having a total number of carbon atoms of 4 to 70 and containing a substituted or nonsubstituted alkyl group as a partial structure, or a substituent having a total number of carbon atoms of 6 to 70 and containing a substituted or nonsubstituted aryl group as a partial structure. Preferable examples are an alkoxy group, an aryloxy group, an acylamino group, an aminocarbonylamino group, a carbamoyl group, an alkoxycarbonylamino group, a sulfonyl group, a sulfonamide group, a sulfamoyl group, a sulfamoylamino group, an alkoxycarbonyl group, an alkyl group, and an aryl group, each having a total number of carbon atoms of 4 (6 if an aryl group is contained) to 70 and containing a substituted or nonsubstituted alkyl or aryl group as a partial structure. Of these substituents, an alkyl group having a total number of carbon atoms of 4 to 70, an alkoxy group having a total number of carbon atoms of 4 to 70 and containing an alkyl group as a partial structure, an alkoxycarbonyl group having a total number of carbon atoms of 4 to 70 and containing an alkyl group as a partial structure, ian acylamino group having a total number of carbon atoms of 4 to 70 and containing an alkyl group as a partial structure, and sulfonamide group having a total number of carbon atoms of 4 to 70 and containing an alkyl group as a partial structure are preferable.

In formula (BL-2), $G_3$ represents a substituted or nonsubstituted methylene group, a represents an integer from 1 to 3, $R_8$ represents a hydrogen atom, an alkyl group, or an aryl group, $G_4$ represents —CO— or —$SO_2$—, Rg represents a substituent having a total number of carbon atoms of 6 to 70 and containing a substituted or nonsubstituted alkyl or aryl group as a partial structure. If $R_9$ has a substituent, examples of this substituent are those enumerated above for $R_2$. If a is 2 or more, a plurality of $G_3$'s can be the same or different. Preferably, a group represented by $(G_3)a$ is —$CH_2$—, $C(CH_3)H$—, —$C(CH_3)_2$—, —$C(i\text{-}C_3H_7)H$—, —$C_2H_4$—, —$C(CH_3)H$—$CH_2$—, —$C(CH_3)_2$—$CH_2$—, —$C(CH_3)_2$—$C(CH_3)H$—, or —$C(CH_3)H$—$C(CH_3)H$—, $R_8$ is a hydrogen atom, $G_4$ is —CO— or —$SO_2$—, $R_9$ is a substituted or nonsubstituted alkyl or aryl group having a total number of carbon atoms of 10 to 70.

In a compound represented by formula (MC-1), if $G_1$ is a nitrogen atom and $G_2$ is a carbon atom, it is preferable that $R_1$ be a tertiary alkyl group, $R_2$ be a group represented by formula (BL-1), and each of $R_4$ and $R_6$ be a group selected from the group consisting of an acylamino group, a sulfonamide group, a ureido group, an alkoxycarbonylamino group, a sulfonyl group, a carbamoyl group, a sulfamoyl group, a sulfamoylamino group, and an alkoxycarbonyl group, each having a total number of carbon atoms of 4 or more and 70 or less and to each of which a substituted or nonsubstituted alkyl group is attached, and an acylamino group, a sulfonamide group, a ureido group, an alkoxycarbonylamino group, a sulfonyl group, a carbamoyl group, a sulfamoyl group, a sulfamoylamino group, and an alkoxycarbonyl group, each having a total number of carbon atoms of 6 or more and 70 or less and to each of which a substituted or nonsubstituted aryl group is attached.

If $G_1$ is a carbon atom and $G_2$ is a nitrogen atom in a compound represented by formula (MC-1), it is preferable that $R_1$ be a tertiary alkyl group and $R_2$ be a group represented by formula (BL-1) or (BL-2). Most preferably, $R_2$ is a group represented by formula (BL-2) or a group represented by formula (BL-1) in which each of $R_3$ and $R_7$ is a 1- to 6-carbon alkyl group and at least one of $R_4$, $R_5$, and $R_6$ is a group having a total number of carbon atoms of 6 to 70, and containing a substituted or nonsubstituted alkyl or aryl group as a partial structure.

In the present invention, it is preferable that $G_1$ be a carbon atom, $G_2$ be a nitrogen atom, $R_1$ be a tertiary alkyl group, and $R_2$ be represented by formula (BL-2) in which $G_4$ is —$SO_2$—, $R_9$ is a phenyl group having at least one group containing a 6- to 50-carbon alkyl group as a substituent, and a is 1 or 2. Most preferably, $R_9$ is a group further having a group selected from —OH, —$SO_2NH_2$, —$SO_2NHR_{10}$, —$NHSO_2R_{10}$, —$SO_2NHCOR_{10}$, —COOH, and —$CONH_2$ as a partial structure. $R_{10}$ represents a substituted or nonsubstituted alkyl group or aryl group. If $R_{10}$ is an aryl group, this aryl group is preferably a phenyl group, and this phenyl group preferably substitutes at least one electron attracting group. Preferable examples of this electron attracting group are a halogen atom, cyano group, alkyl halide group, aryl halide group, acyl group, carbamoyl group, alkyloxycarbonyl, aryloxycarbonyl group, sulfonyl group, alkylaminosulfonyl or arylaminosulfonyl group.

If $R_{10}$ is an alkyl group, this alkyl group is preferably a 1- to 50-carbon (more preferably, 1- to 30-carbon), substituted or nonsubstituted, straight-chain or branched alkyl group.

If a coupler represented by formula (MC-1) forms a polymer, this polymer is preferably a dimer, trimer, or tetramer, and most preferably, a dimer. Also, if this coupler bonds to a polymer chain, the total molecular weight is preferably 8,000 to 50,000, and the molecular weight per coupler nucleus is preferably 500 to 1,000.

Practical compound examples of formula (MC-1) will be presented below, but the present invention is not limited to these practical examples.

CA-1
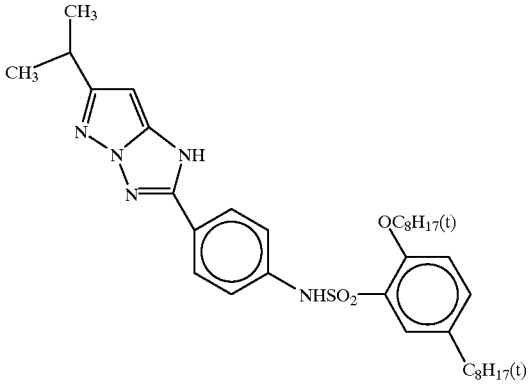
CA-2
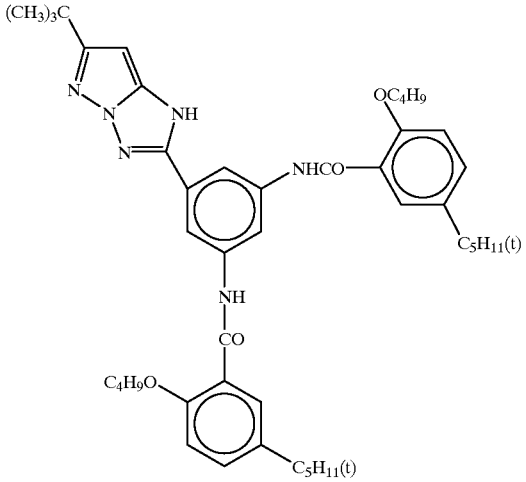
CA-3
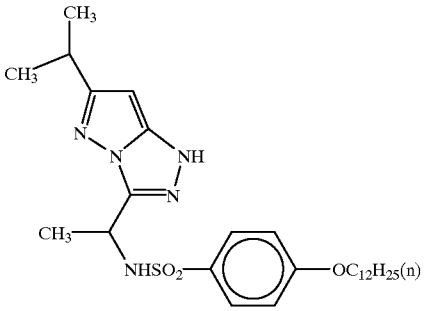
CA-4
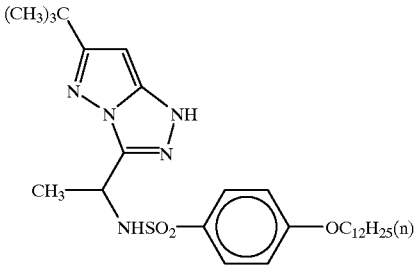
-continued
CA-5
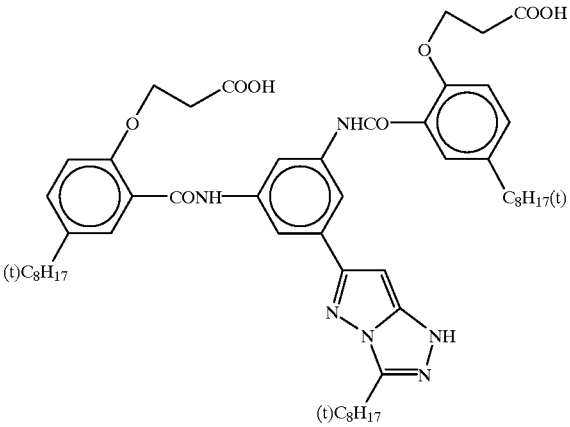
CA-6
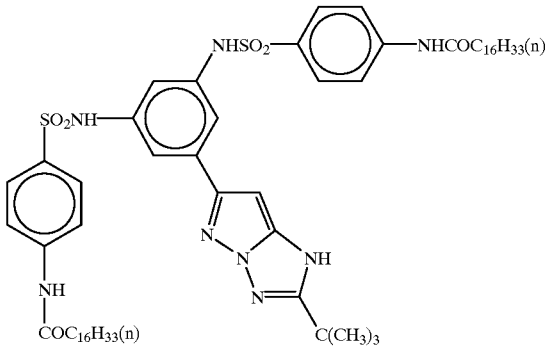
CA-7
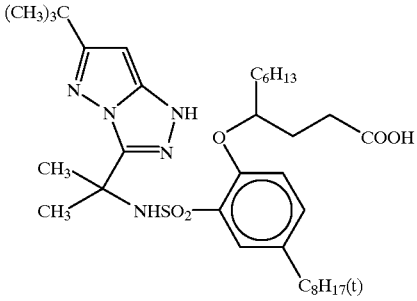
CA-8
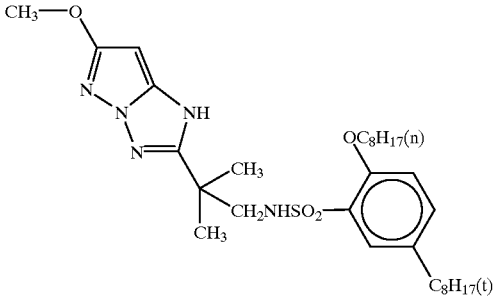

-continued
CA-9
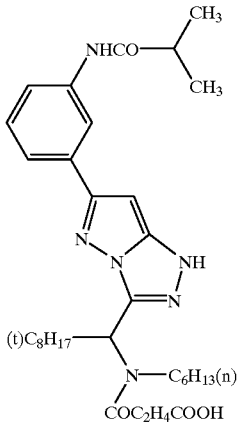
CA-10
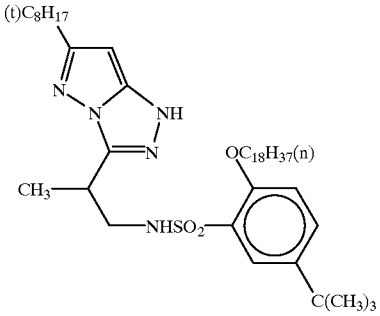
CA-11
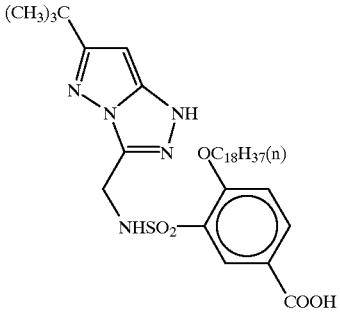
CA-12
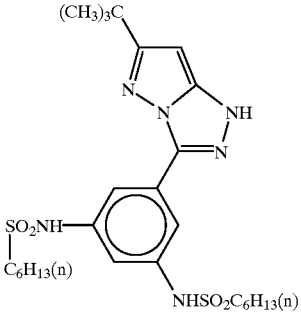
-continued
CA-13
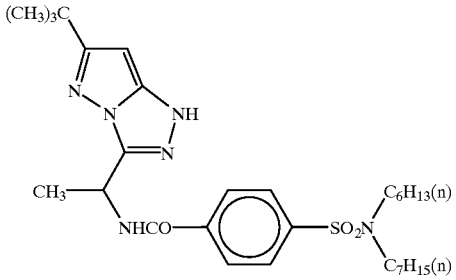
CA-14
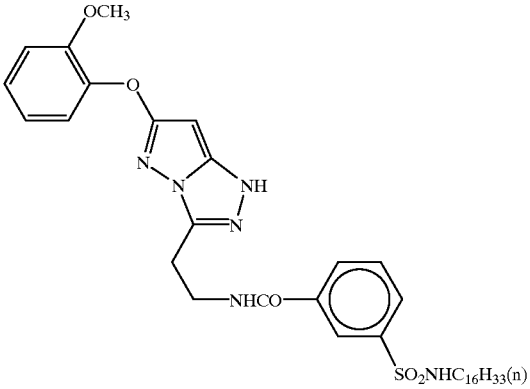
CA-15
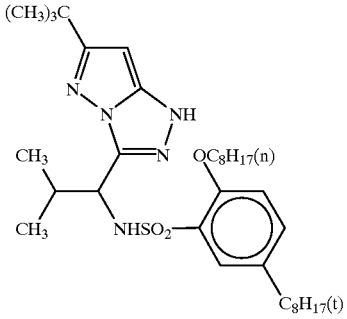
CA-16
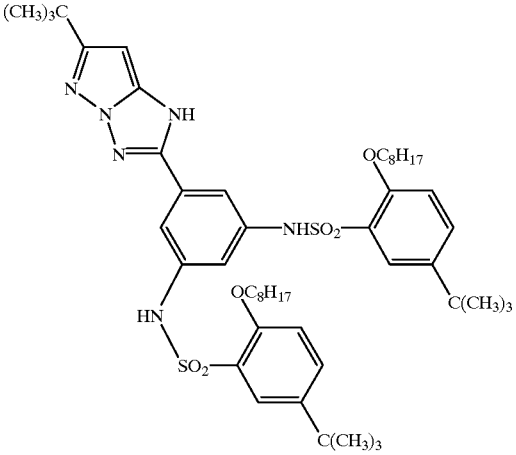

-continued
CA-17
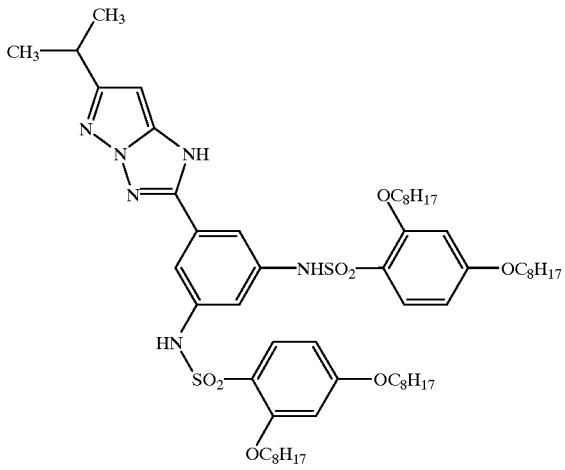
CA-18
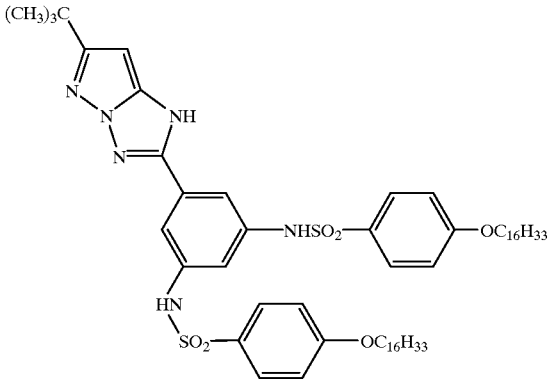
CA-19
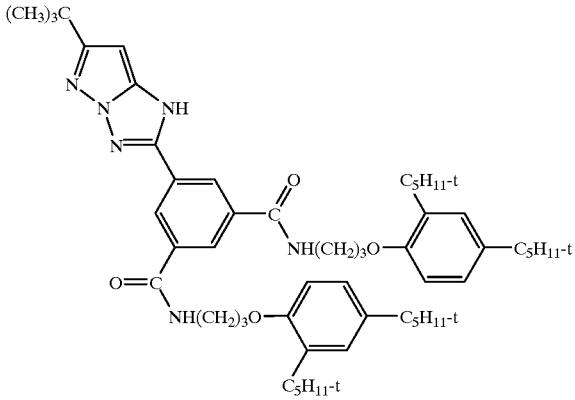
-continued
CA-20
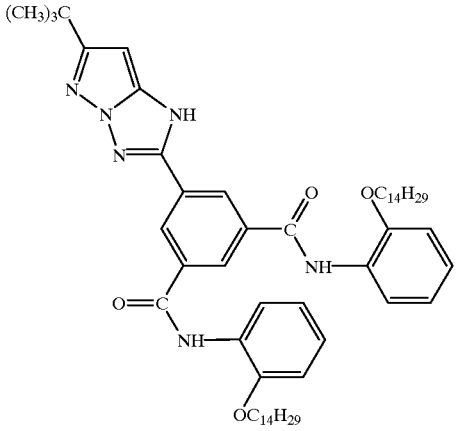
CA-21
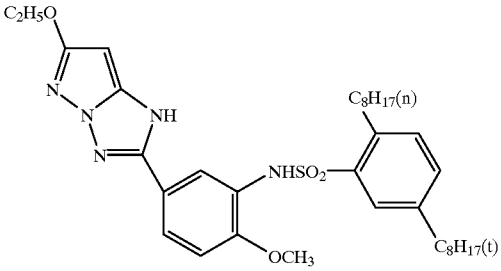
CA-22
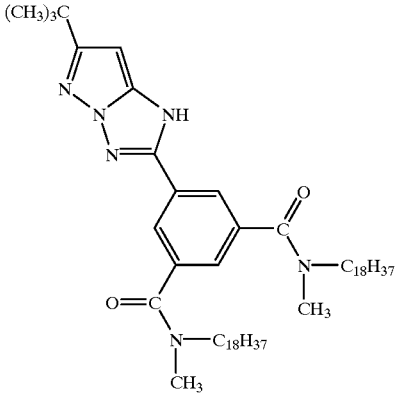
CA-23
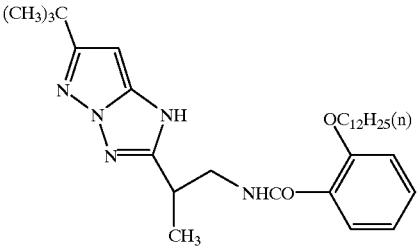

-continued
CA-24
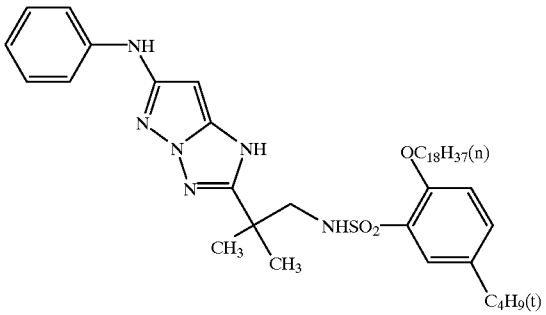
CA-25
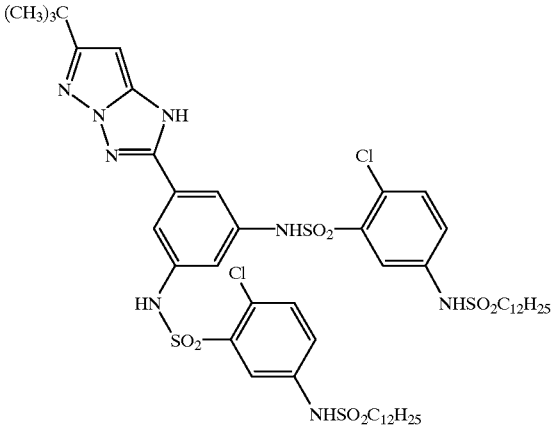
CA-26
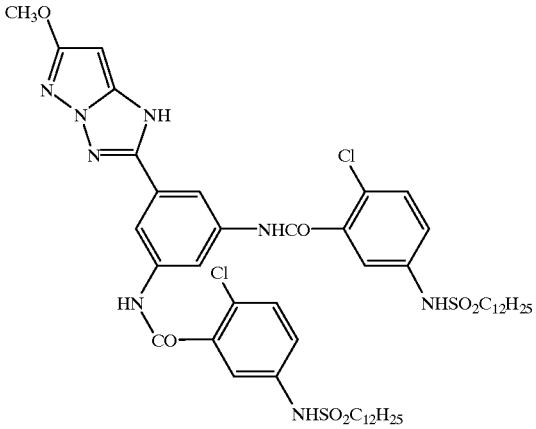
-continued
CA-27
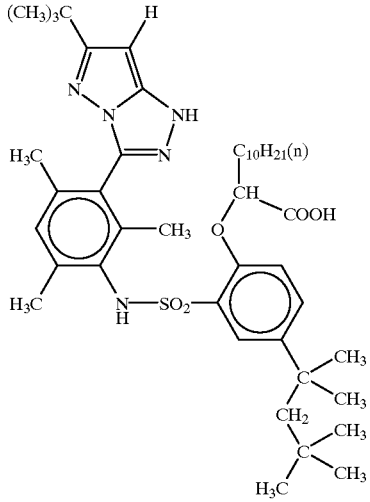
CA-28
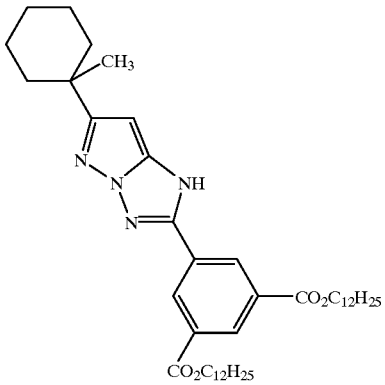
CA-29
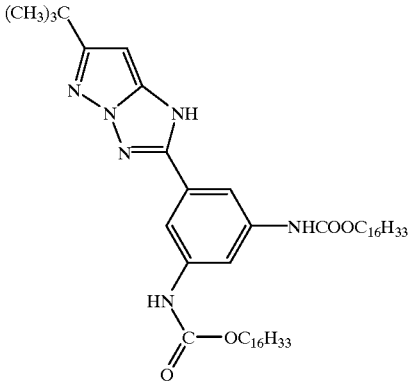

-continued
CA-30
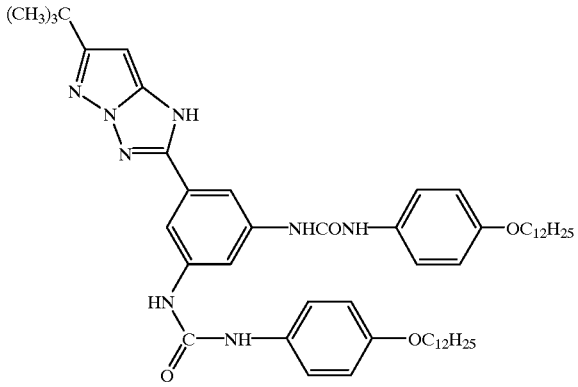
CA-31
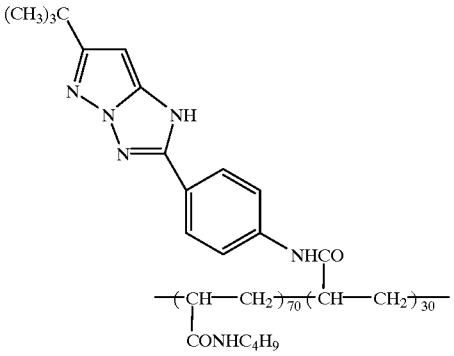
CA-32
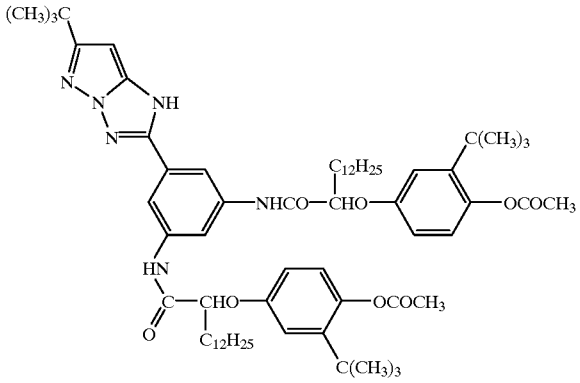
CA-33
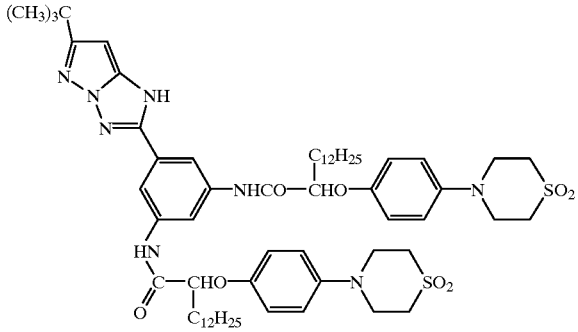
-continued
CA-34
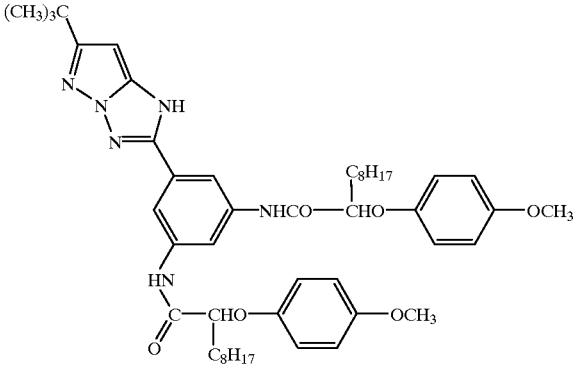
CA-35
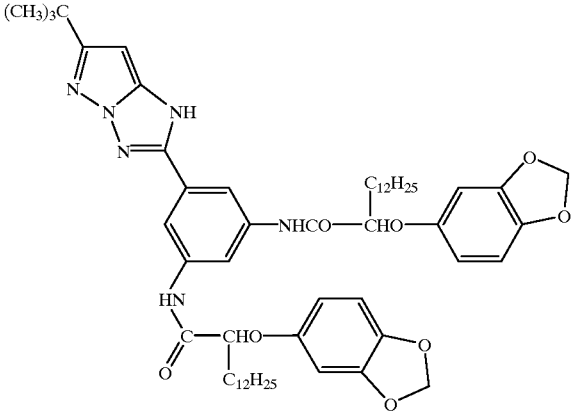
CA-36
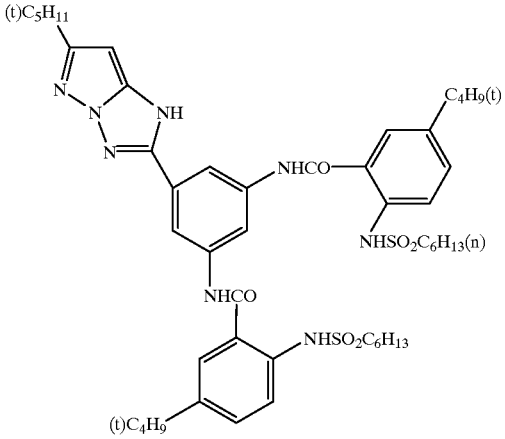

-continued
CA-37
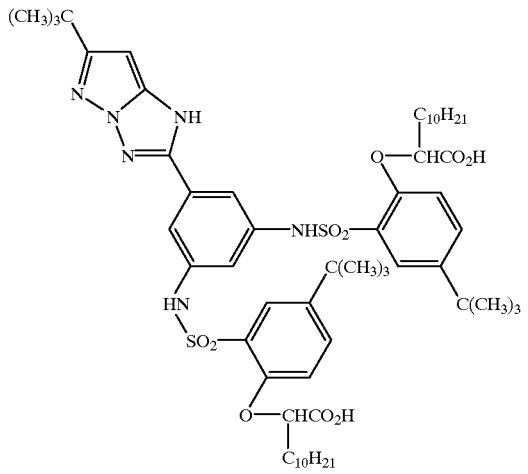
CA-38
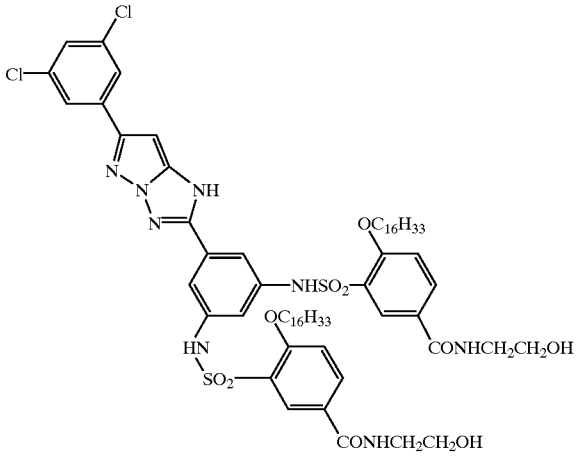
CA-39
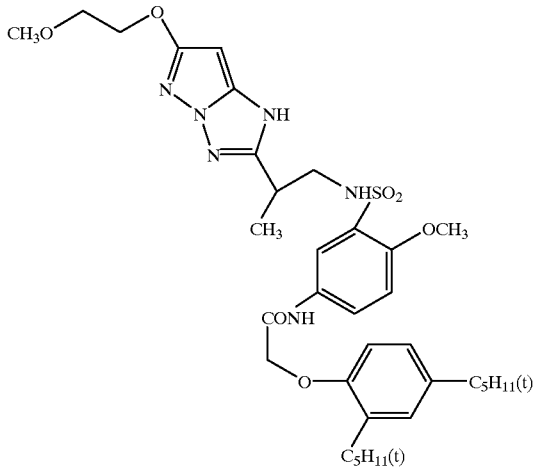
-continued
CA-40
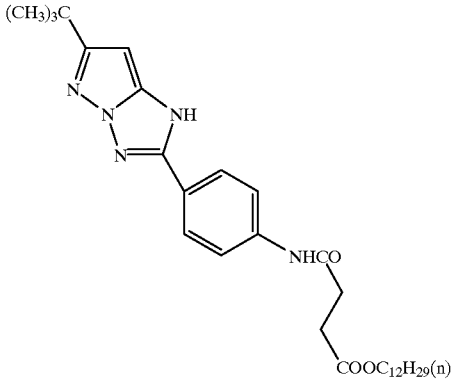
CA-41
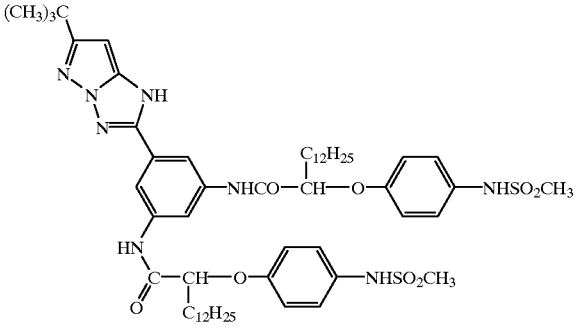
CA-42
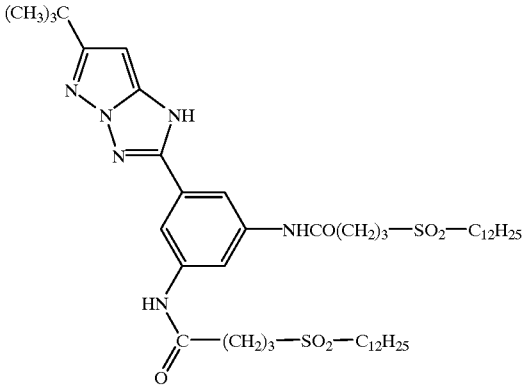
CA-43
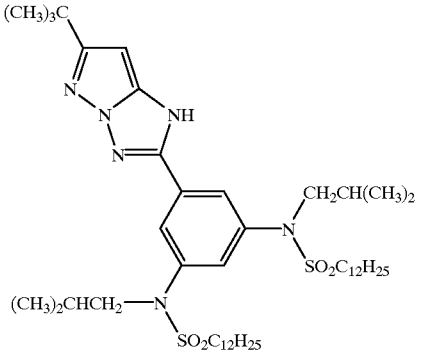

-continued
CA-44
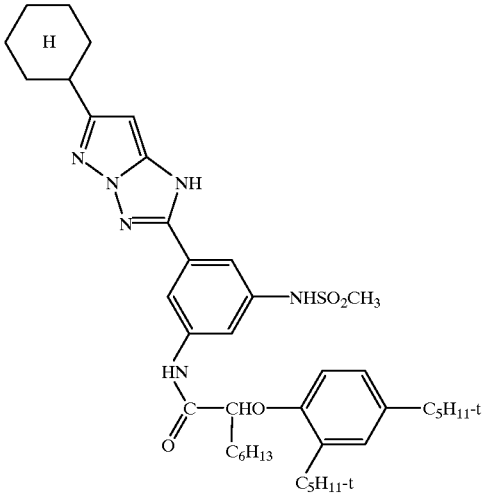
CA-45
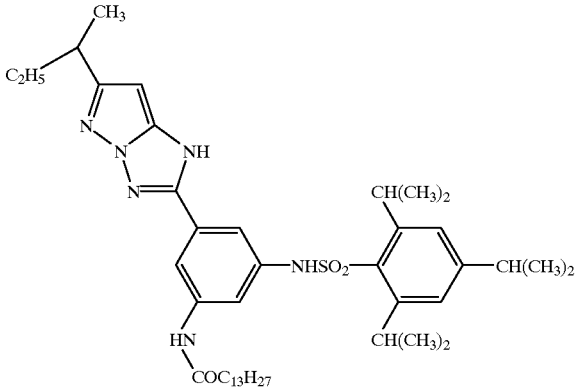
CA-46
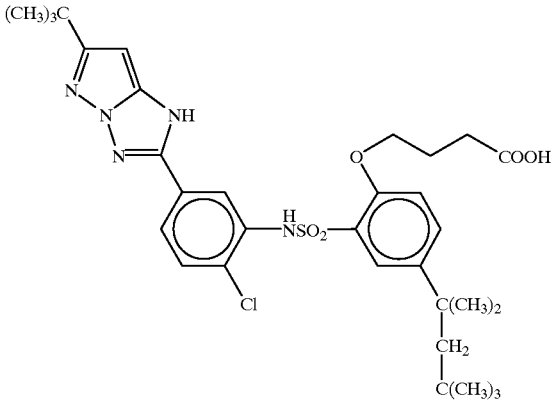
-continued
CA-47
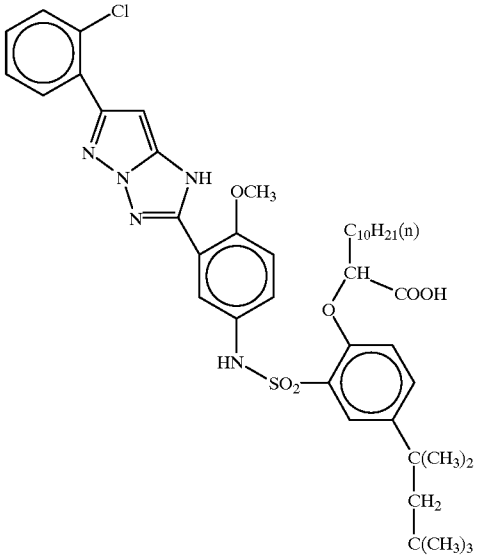
CA-48
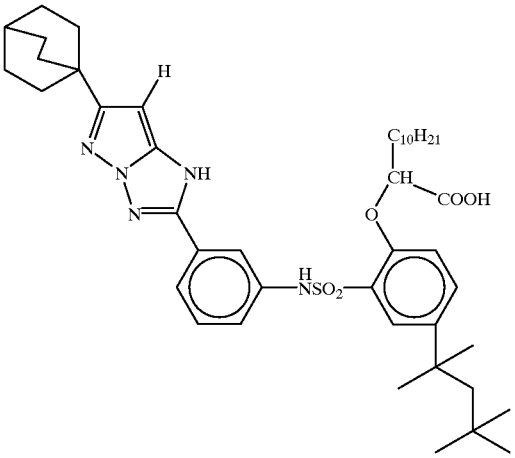
CA-49
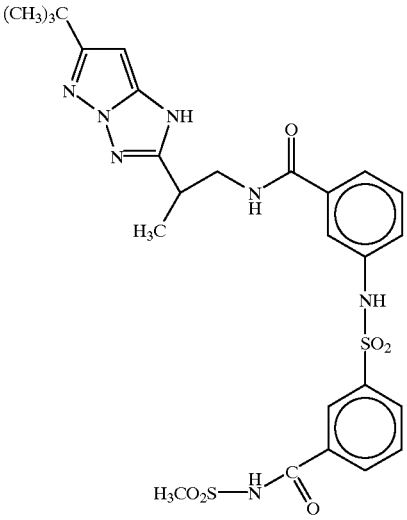

-continued
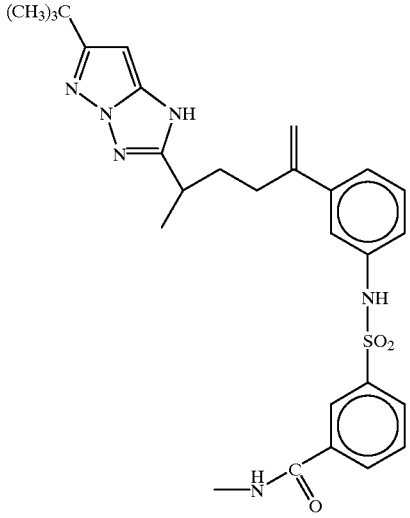
CA-50
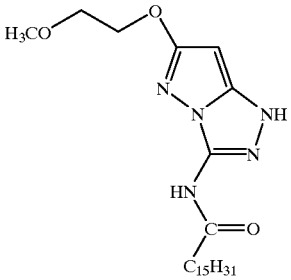
CA-51
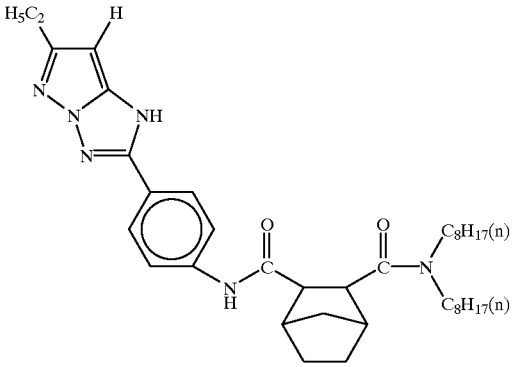
CA-52
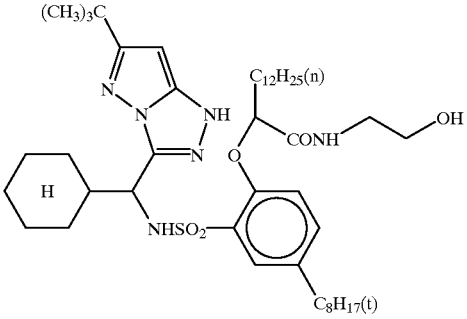
-continued
CA-53
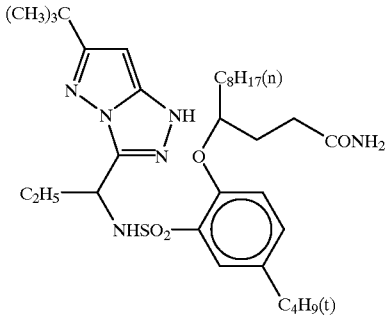
CA-54
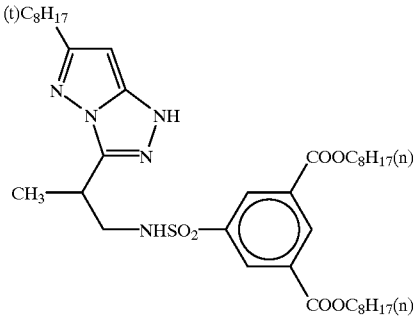
CA-55
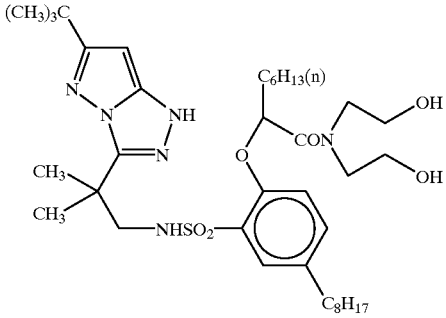
CA-56
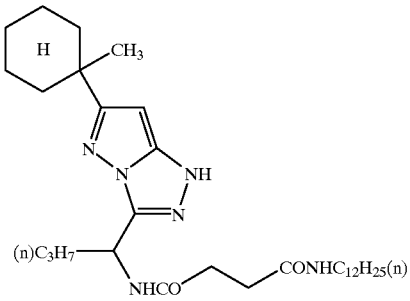

-continued
CA-57
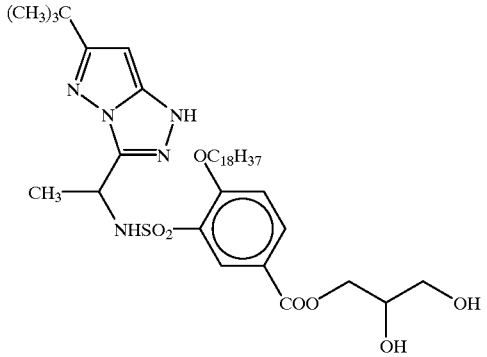
CA-58
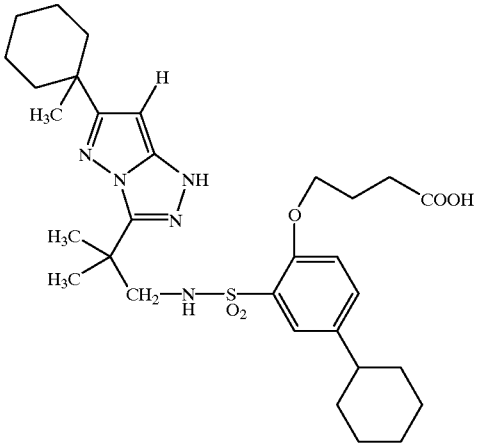
CA-59
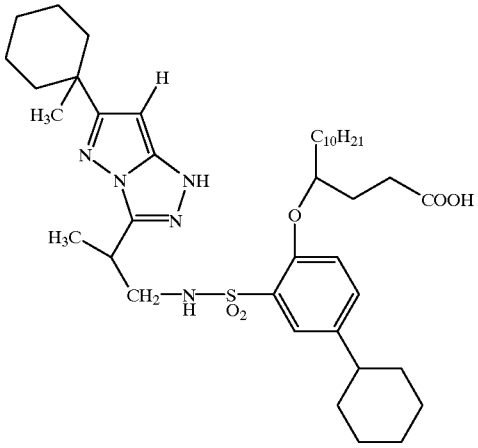
-continued
CA-60
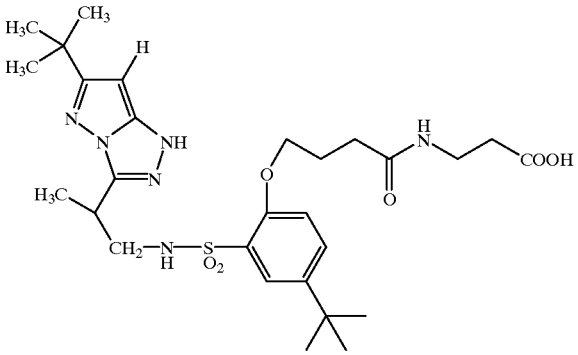
CA-61
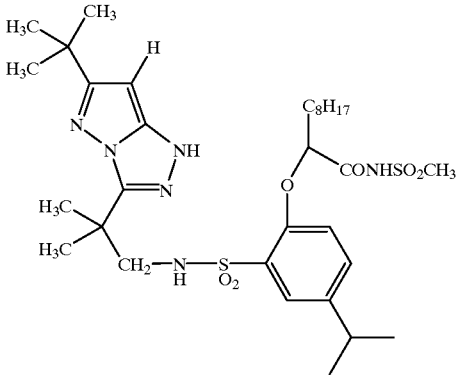
CA-62
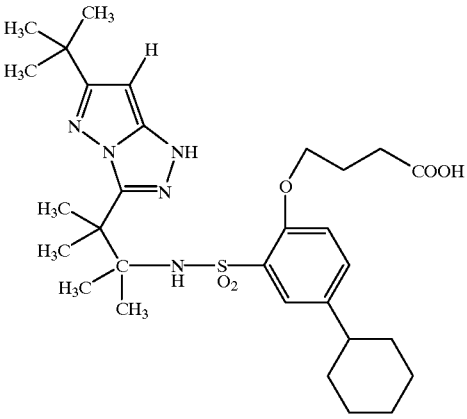
CA-63
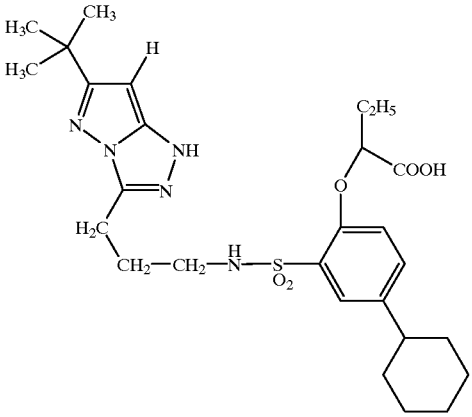

-continued
CA-64
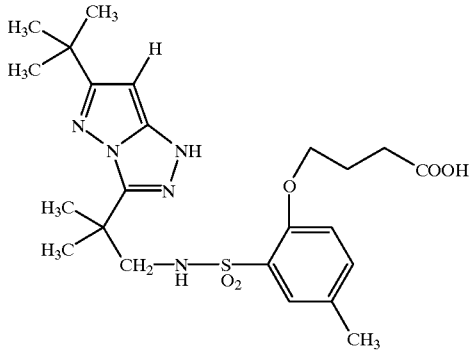
CA-65
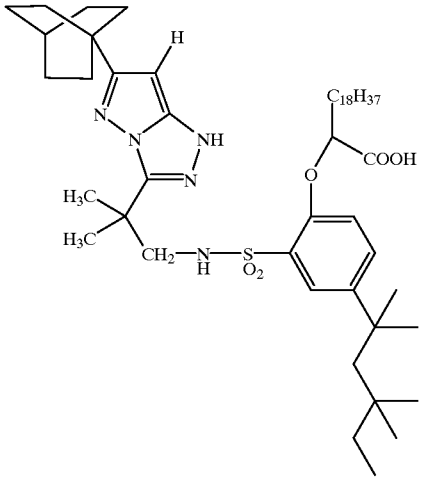
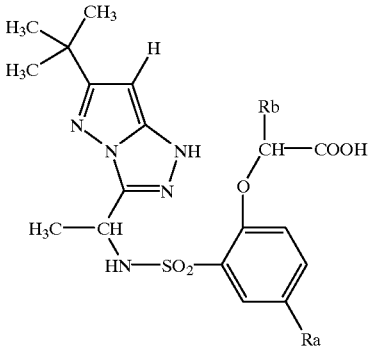
| Compound No. | Ra | Rb * |
|---|---|---|
| CA-66 | 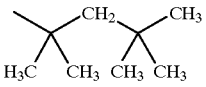 | $-C_6H_{13}$ |
| CA-67 | 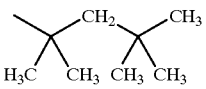 | $-C_8H_{17}$ |
-continued
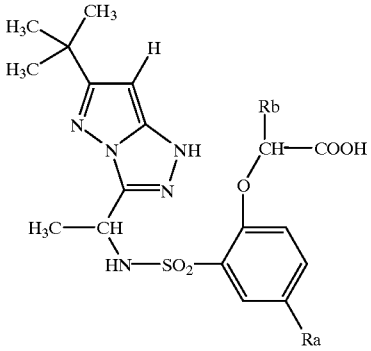
| Compound No. | Ra | Rb * |
|---|---|---|
| CA-68 | 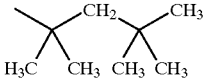 | $-C_{10}H_{21}$ |
| CA-69 | 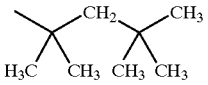 | $-C_{12}H_{25}$ |
| CA-70 | 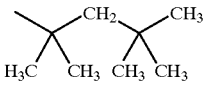 | $-C_{14}H_{29}$ |
| CA-71 | 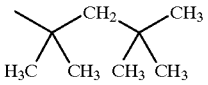 | $-C_{16}H_{31}$ |
| CA-72 | 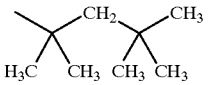 | $-C_{18}H_{37}$ |
* The alkyl groups represented by Rb are n-alkyl groups, except otherwise indicated.
| Compound No. | Ra | Rb |
|---|---|---|
| CA-73 | 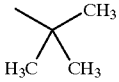 | $-C_6H_{13}$ |
| CA-74 | 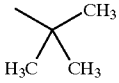 | $-C_8H_{17}$ |
| CA-75 | 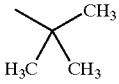 | $-C_{10}H_{21}$ |
| CA-76 | 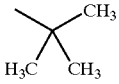 | $-C_{12}H_{25}$ |

-continued
| Compound No. | Ra | Rb |
|---|---|---|
| CA-77 | 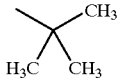 | $—C_{14}H_{29}$ |
| CA-78 | 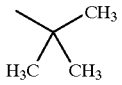 | $—C_{16}H_{31}$ |
| CA-79 | 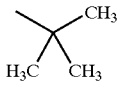 | $—C_{18}H_{37}$ |
| CA-80 | 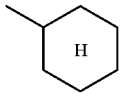 | $—C_{14}H_{29}$ |
| CA-81 | 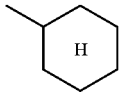 | $—C_{16}H_{31}$ |
| CA-82 | 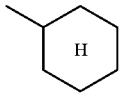 | $—C_{18}H_{37}$ |
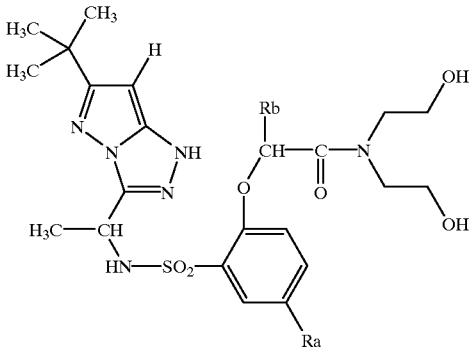
| Compound No. | Ra | Rb |
|---|---|---|
| CA-83 | 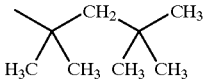 | $—C_6H_{13}$ |
| CA-84 | 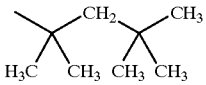 | $—C_8H_{17}$ |
| CA-85 | 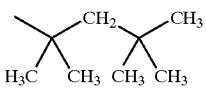 | $—C_{10}H_{21}$ |
-continued
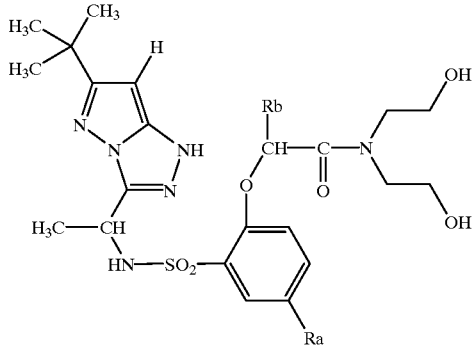
| Compound No. | Ra | Rb |
|---|---|---|
| CA-86 | 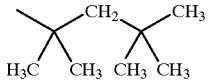 | $—C_{12}H_{25}$ |
| CA-87 | 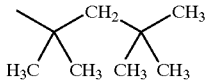 | $—C_{14}H_{29}$ |
| CA-88 | 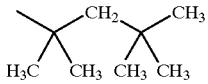 | $—C_{16}H_{31}$ |
| CA-89 | 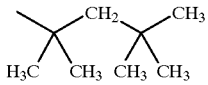 | $—C_{18}H_{37}$ |
| CA-90 | 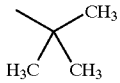 | $—C_6H_{13}$ |
| CA-91 | 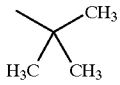 | $—C_8H_{17}$ |
| CA-92 | 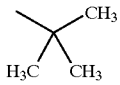 | $—C_{10}H_{21}$ |
| CA-93 | 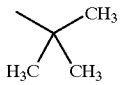 | $—C_{12}H_{25}$ |
| CA-94 | 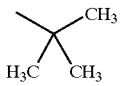 | $—C_{14}H_{29}$ |
| CA-95 | 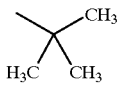 | $—C_{16}H_{31}$ |
| CA-96 | 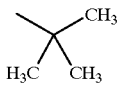 | $—C_{18}H_{37}$ |

-continued
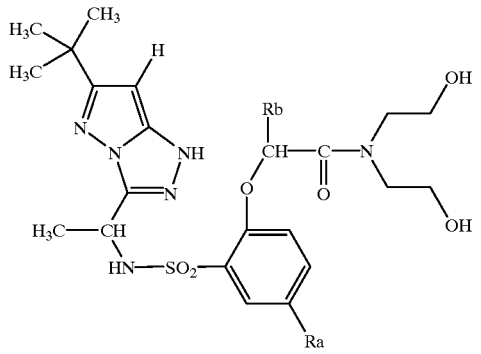
| Compound No. | Ra | Rb |
|---|---|---|
| CA-97 | 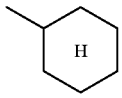 | $—C_8H_{17}$ |
| CA-98 | 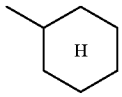 | $—C_{10}H_{21}$ |
| CA-99 | 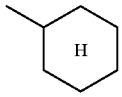 | $—C_{12}H_{25}$ |
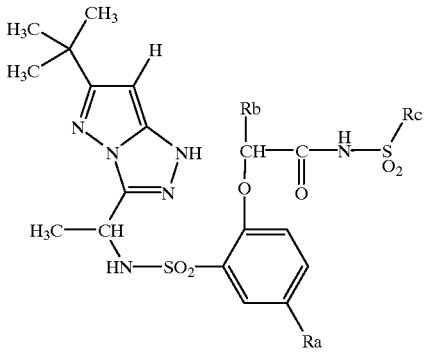
| Compound No. | Ra | Rb | Rc |
|---|---|---|---|
| CA-100 | 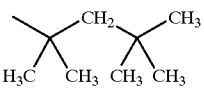 | $—C_6H_{13}$ | $—CH_3$ |
| CA-101 | 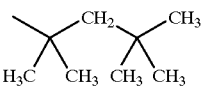 | $—C_8H_{17}$ | $—CH_3$ |
| CA-102 | 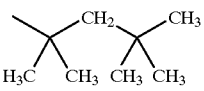 | $—C_{10}H_{21}$ | $—CH_3$ |
-continued
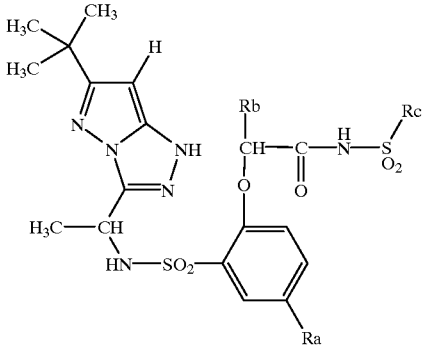
| Compound No. | Ra | Rb | Rc |
|---|---|---|---|
| CA-103 | 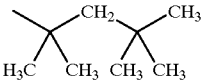 | $—C_{12}H_{25}$ | $—CH_3$ |
| CA-104 | 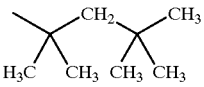 | $—C_{14}H_{29}$ | $—CH_3$ |
| CA-105 | 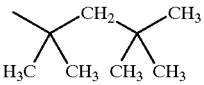 | $—C_{16}H_{31}$ | $—CH_3$ |
| CA-106 | 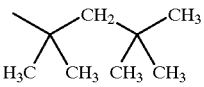 | $—C_{18}H_{37}$ | $—CH_3$ |
| CA-107 | 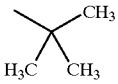 | $—C_6H_{13}$ | $—CH_3$ |
| CA-108 | 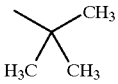 | $—C_8H_{17}$ | $—CH_3$ |
| CA-109 | 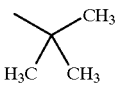 | $—C_{10}H_{21}$ | $—CH_3$ |
| CA-110 | 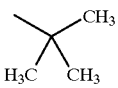 | $—C_{12}H_{25}$ | $—CH_3$ |
| CA-111 | 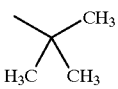 | $—C_{14}H_{29}$ | $—CH_3$ |
| CA-112 | 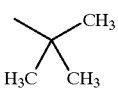 | $—C_{16}H_{31}$ | $—CH_3$ |

-continued
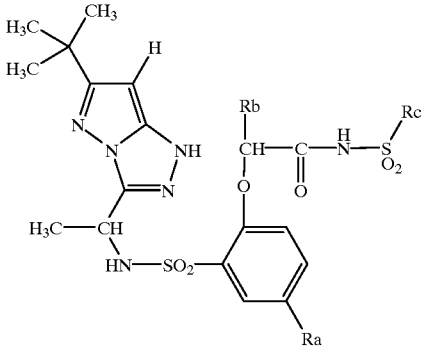
| Compound No. | Ra | Rb | Rc |
|---|---|---|---|
| CA-113 | 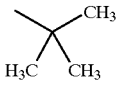 | $-C_{18}H_{37}$ | $-CH_3$ |
| CA-114 | 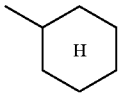 | $-C_8H_{17}$ | $-CH_3$ |
| CA-115 | 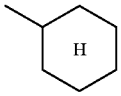 | $-C_{10}H_{21}$ | $-CH_3$ |
| CA-116 | 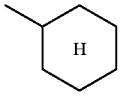 | $-C_{12}H_{25}$ | $-CH_3$ |
| CA-117 | 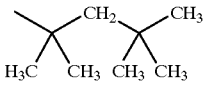 | $-C_8H_{17}$ | 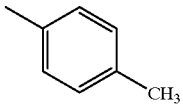 |
| CA-118 | 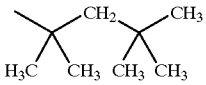 | $-C_{10}H_{21}$ | 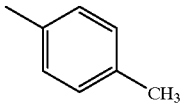 |
| CA-119 | 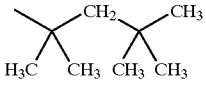 | $-C_{12}H_{25}$ | 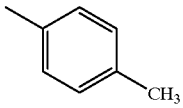 |
| CA-120 | 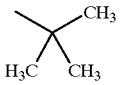 | $-C_8H_{17}$ | 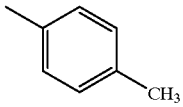 |
-continued
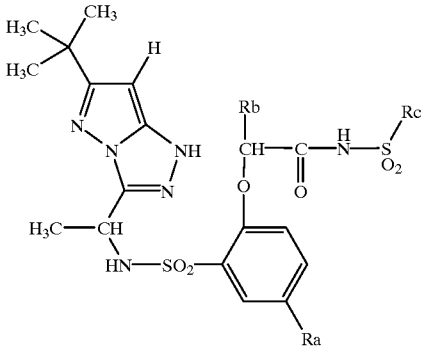
| Compound No. | Ra | Rb | Rc |
|---|---|---|---|
| CA-121 | 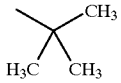 | $-C_{10}H_{21}$ | 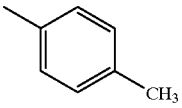 |
| CA-122 | 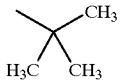 | $-C_{12}H_{25}$ | 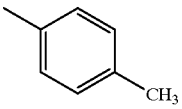 |
| CA-123 | 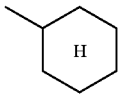 | $-C_8H_{17}$ | 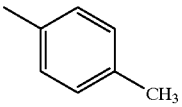 |
| CA-124 | 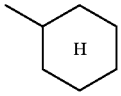 | $-C_{10}H_{21}$ | 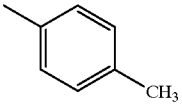 |
| CA-125 | 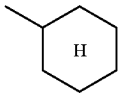 | $-C_{12}H_{25}$ | 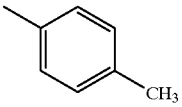 |
| CA-126 | 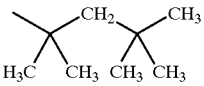 | $-C_{10}H_{21}$ | 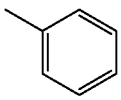 |

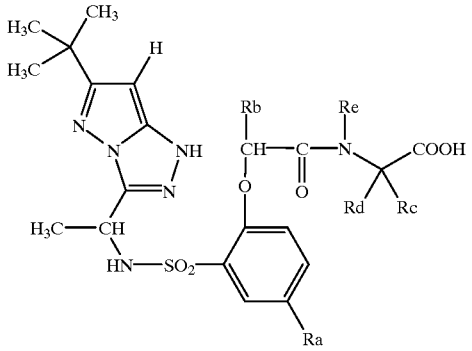
| Compound No. | Ra | Rb | Rc | Rd | Re |
|---|---|---|---|---|---|
| CA-127 | 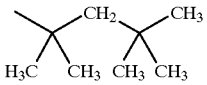 | $-C_8H_{17}$ | —H | —H | —H |
| CA-128 | 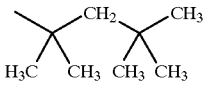 | $-C_{10}H_{21}$ | $-CH_3$ | —H | $-CH_3$ |
| CA-129 | 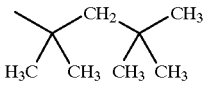 | $-C_{12}H_{25}$ | $-CH_3$ | —H | —H |
| CA-130 | 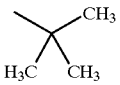 | $-C_8H_{17}$ | $-CH_3$ | $-CH_3$ | $-C_{10}H_{21}$ |
| CA-131 | 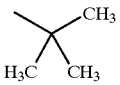 | $-C_{10}H_{21}$ | $-CH_3$ | $-CH_3$ | $-C_{10}H_{21}$ |
| CA-132 | 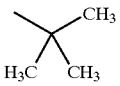 | $-C_{12}H_{25}$ | $-CH_3$ | $-CH_3$ | —H |
| CA-133 | 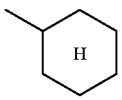 | $-C_8H_{17}$ | 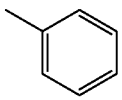 | $-CH_3$ | —H |

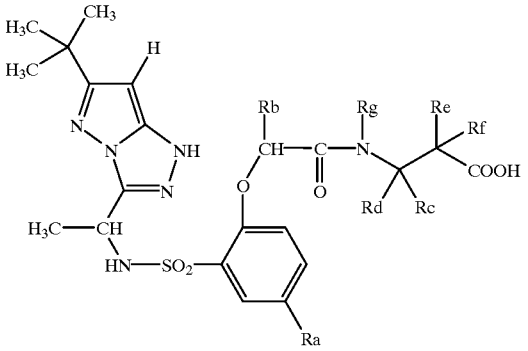
| Compound No. | Ra | Rb | Rc | Rd | Re | Rf | Rg |
|---|---|---|---|---|---|---|---|
| CA-134 | 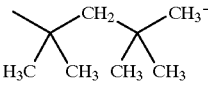 | $—C_8H_{17}$ | —H | —H | —H | —H | —H |
| CA-135 | 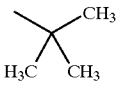 | $—C_8H_{17}$ | —H | —H | —H | —H | 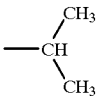 |
| CA-136 | 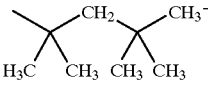 | $—C_{10}H_{21}$ | —H | —H | —H | —H | $—CH_3$ |
| CA-137 | 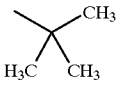 | $—C_{10}H_{21}$ | —H | —H | —H | —H | —H |
| CA-138 | 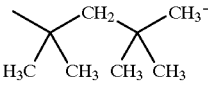 | $—C_{10}H_{21}$ | $—CH_3$ | —H | —H | —H | —H |
| CA-139 | 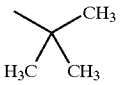 | $—C_8H_{17}$ | $—CH_3$ | $—CH_3$ | —H | —H | —H |
| CA-140 | 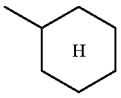 | $—C_{10}H_{21}$ | $—CH_3$ | $—CH_3$ | —H | —H | $—C_{10}H_{21}$ |

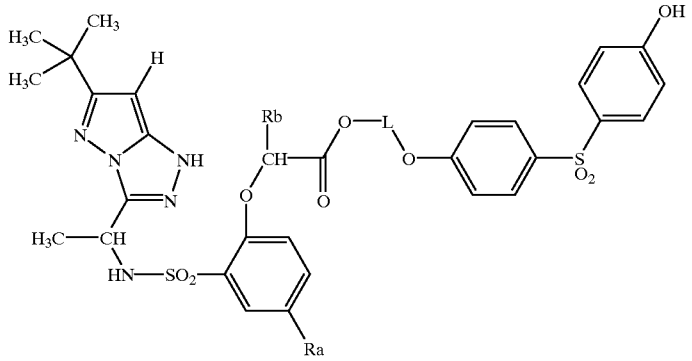
| Compound No. | Ra | Rb | L |
|---|---|---|---|
| CA-141 | 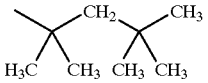 | $—C_6H_{13}$ | 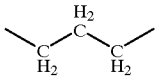 |
| CA-142 | 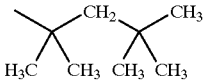 | $—C_8H_{17}$ | 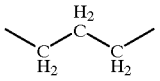 |
| CA-143 | 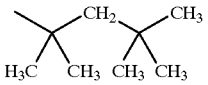 | $—C_{10}H_{21}$ | 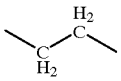 |
| CA-144 | 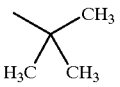 | $—C_{12}H_{25}$ | 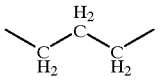 |
| CA-145 | 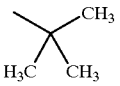 | $—C_{14}H_{29}$ | 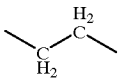 |
| CA-146 | 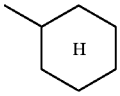 | $—C_{16}H_{31}$ | 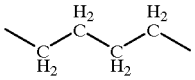 |
| CA-147 | 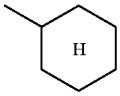 | $—C_{18}H_{37}$ | 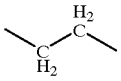 |
| CA-148 | 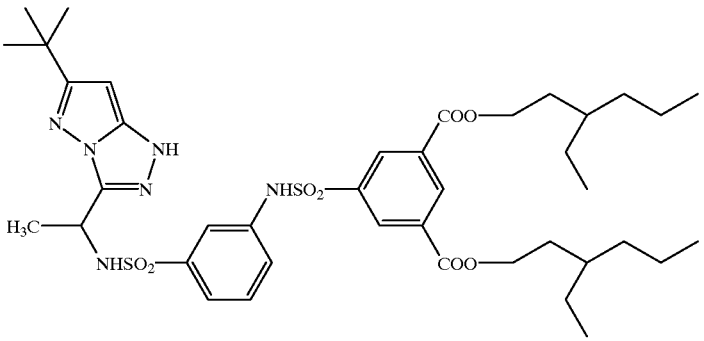 | | |

-continued
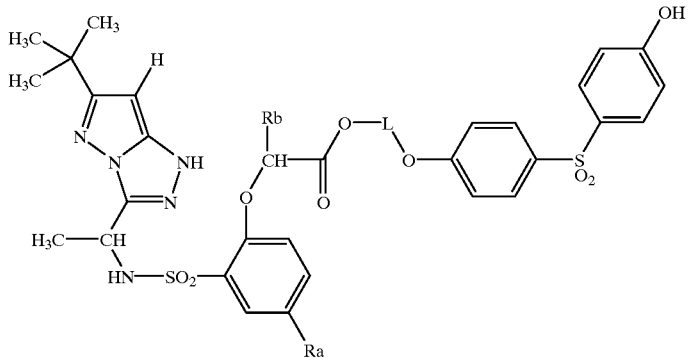
| Compound No. | Ra | Rb | L |
|---|---|---|---|
| CA-149 | | | |
| CA-150 | | | |

-continued
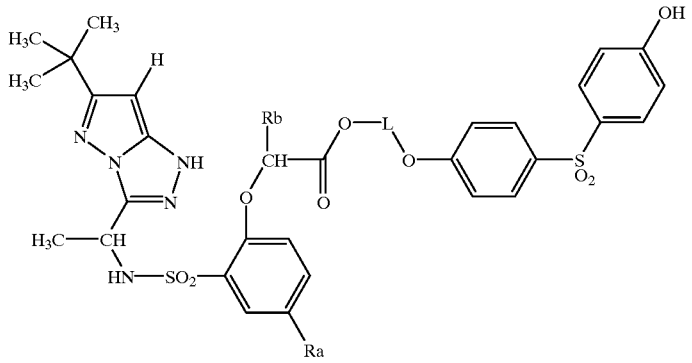
| Compound No. | Ra | Rb | L |
|---|---|---|---|
| CA-151 | 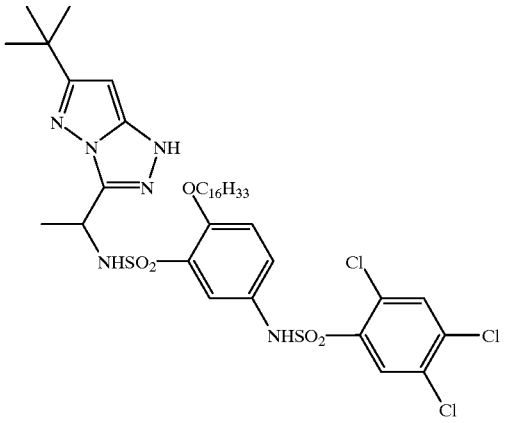 | | |
| CA-152 | 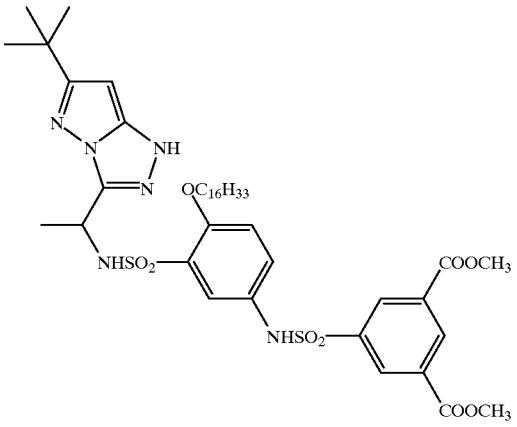 | | |

-continued
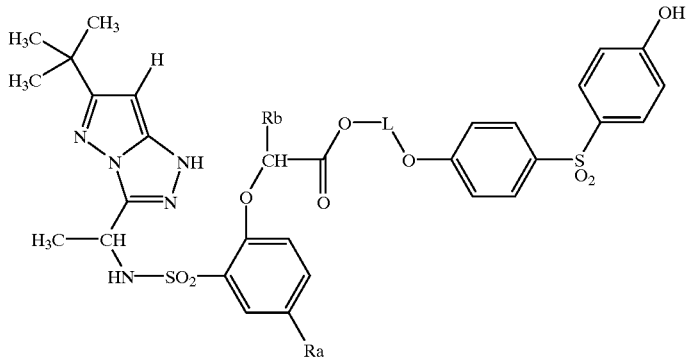
| Compound No. | Ra | Rb | L |
|---|---|---|---|
| CA-153 | | | |
| CA-154 | | | |

-continued
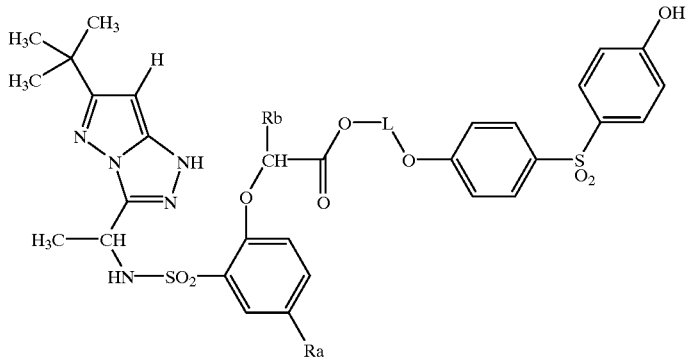
| Compound No. | Ra | Rb | L |
|---|---|---|---|
| CA-155 | 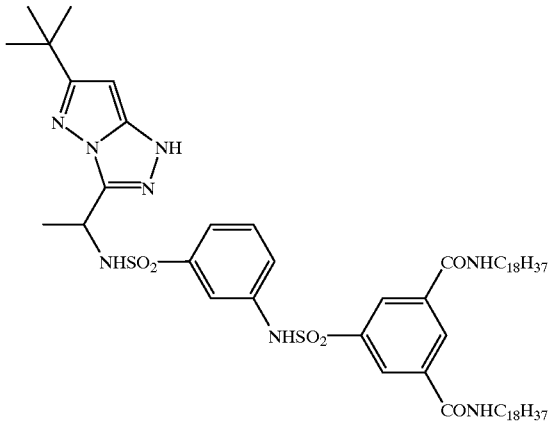 | | |
| CA-156 | 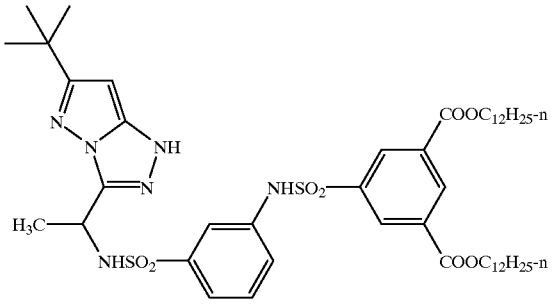 | | |

-continued
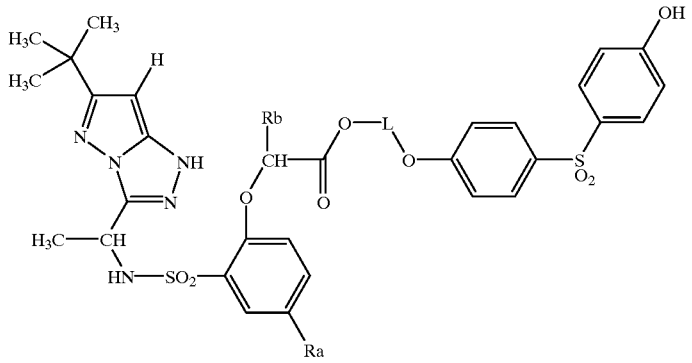
| Compound No. | Ra | Rb | L |
|---|---|---|---|
| CA-157 | | | |
| CA-158 | | | |
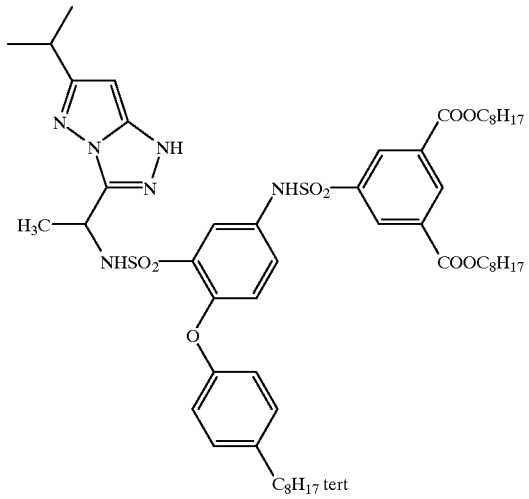
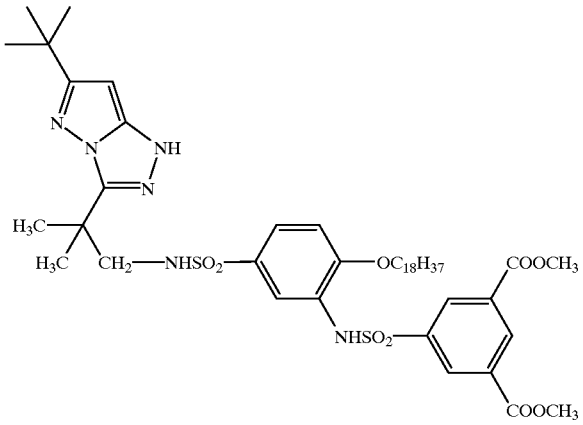

-continued
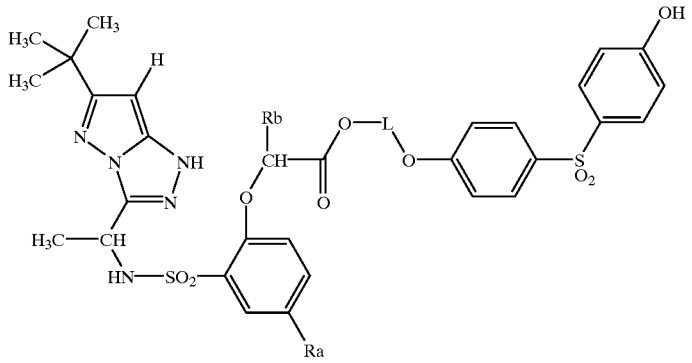
| Compound No. | Ra | Rb | L |
|---|---|---|---|
| CA-159 | 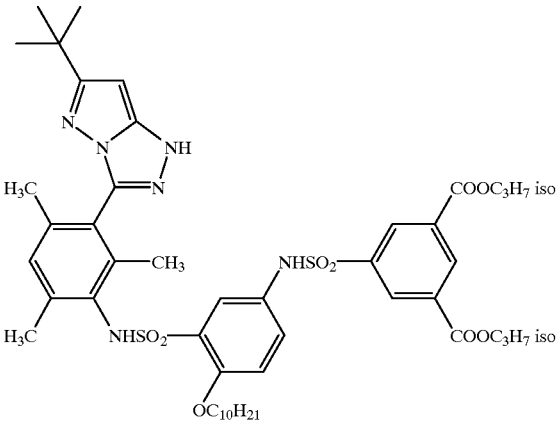 | | |
| CA-160 | 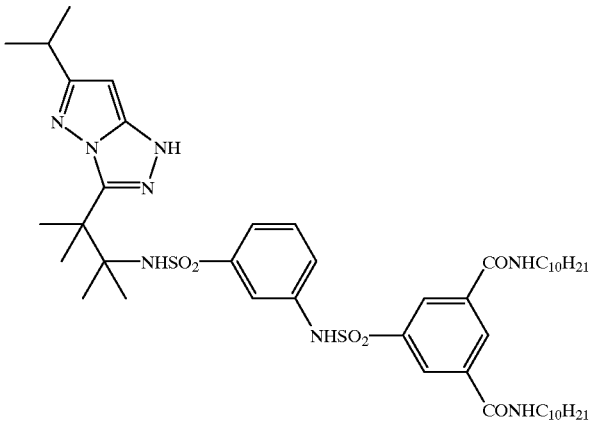 | | |

-continued
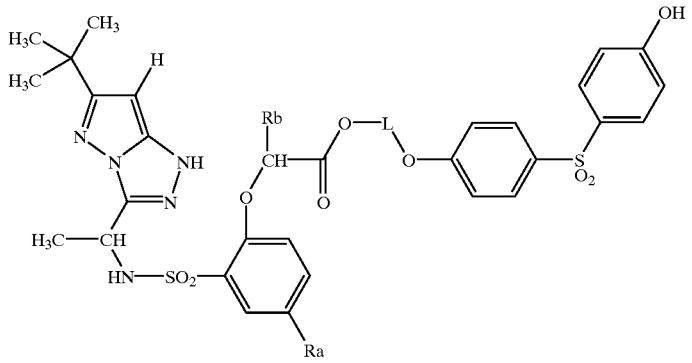
| Compound No. | Ra | Rb | L |
|---|---|---|---|
| CA-161 | | | |
| CA-162 | | | |
| CA-163 | | | |

-continued

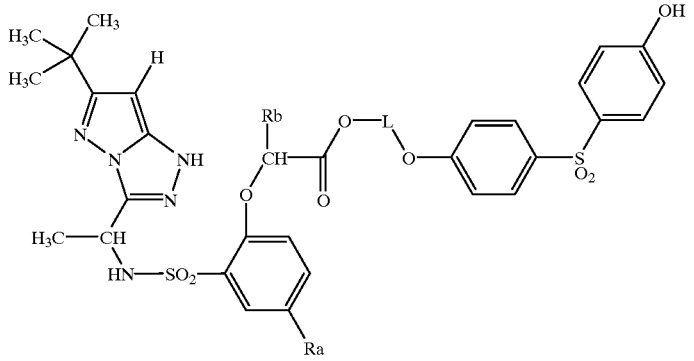

| Compound No. | Ra | Rb | L |
|---|---|---|---|
| CA-164 | | | |
| CA-165 | | | |

The coupler represented by formula (MC-1) of the present invention can be synthesized by know methods. Examples are described in U.S. Pat. Nos. 4,540,654, 4,705,863, and 5,451,501, JP-A's-61-65245, 62-209457, 62-249155, 63-41851, Jpn. Pat. Appln. KOKOKU Publication No. (hereinafter referred to as JP-B-)7-122744, JP-B's-5-105682, 7-13309, 7-82252, U.S. Pat. Nos. 3,725,067 and 4,777,121, JP-A's-2-201442, 2-101077, 3-125143, and 4-242249, the disclosures of which are herein incorporated by reference.

The coupler represented by formula (MC-1) of the present invention can be introduced to a sensitive material by various known dispersion methods. Of these methods, an oil-in-water dispersion method is preferable in which a coupler is dissolved in a high-boiling organic solvent (used in combination with a low-boiling solvent where necessary), the solution is dispersed by emulsification in an aqueous gelatin solution, and the dispersion is added to a silver halide emulsion.

Examples of the high-boiling solvent used in this oil-in-water dispersion method are described in, e.g., U.S. Pat. No.

2,322,027, the disclosure of which is herein incorporated by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Dispersion using an organic solvent-soluble polymer is described in PCT International Publication W088/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, di-2-ethylhexylphthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di-2-ethylhexylphenylphosphate), benzoic acid esters (e.g., 2-ethylhexylbenzoate, 2,4-dichlorobenzoate, dodecylbenzoate, and 2-ethylhexyl-p-hydroxybenzoate), amides of aliphatic carboxylic acid (e.g., N,N-diethyldodecaneamide and N,N-diethyllaurylamide), amides of aromatic carboxylic acid (e.g., 2-dodecyloxy benzoic acid amide, N,N,N,N-tetracyclohexylisophthalic acid amide, and N,N,N,N-tetra-2-ethylhexylisophthalic acid amide), alcohols and phenols (e.g., isostearylalcohol and 2,4-di-tert-amylphenol), aliphatic esters (e.g., dibutoxyethyl succinate, di-2-ethylhexyl succinate, 2-hexyldecyl tetradecanate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., trimesic acid tributyl), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy butyric acid and 2-ethoxyoctanedecanic acid), alkylphosphoric acids (e.g., di-(2-ethylhexyl)phosphoric acid and diphenylphosphoric acid). In addition to the above high-boiling solvents, compounds described in, e.g., JP-A-6-258803, the disclosure of which is herein incorporated by reference, can also be preferably used as high-boiling solvents.

Of these compounds, phosphoric acid esters and amides of aromatic carboxylic acid are preferable, and the combination of phosphoric acid esters and amides of aromatic carboxylic acid with alcohols or phenols is also preferable.

In the present invention, the weight ratio of a high-boiling organic solvent to the coupler represented by formula (MC-1) is preferably 0 to 2.0, more preferably, 0.01 to 1.0, and most preferably, 0.01 to 0.5.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content of the coupler represented by formula (MC-1) of the present invention in a sensitive material is 0.01 to 10 g, preferably 0.1 g to 2 g per $m^2$. The content is appropriately $1\times10^{-3}$ to 1 mol, preferably $2\times10^{-3}$ to $3\times10^{-1}$ mol per mol of a silver halide in the same sensitive emulsion layer.

It is also preferable to use the coupler represented by formula (MC-1) of the present invention together with a pyrazolotriazole coupler in which the arrangement of the carbon and nitrogen atoms represented by $G_1$ and $G_2$ in formula (MC-1) is opposite to the former coupler. The ratio of the former coupler represented by formula (MC-1): the latter coupler, can arbitrary be selected from 1:99 to 99:1 as a molar ratio, and the ratio is preferably 20:80 to 80:20. It is particularly preferable that a coupler in which $G_1$ and $G_2$ are a carbon atom and a nitrogen atom, respectively, in formula (MC-1) of the present invention account for 50% to 90%, as a molar ratio, of the total pyrazolotriazole coupler amount in the layer, and the rest be a pyrazolo-(1,5-b)-1,2,4-triazole coupler.

When a sensitive layer has a unit configuration including two or more sensitive emulsion layers having the same color sensitivity but differing in speed, the coupler content of the present invention per mol of a silver halide is preferably $2\times10^{-3}$ to $1\times10^{-1}$ mol in a low-speed layer and $3\times10^{-2}$ to $3\times10^{-1}$ mol in a high-speed layer.

The present invention is characterized by containing the magenta coupler represented by formula (MC-1). Although another magenta coupler can also be used together with this coupler, the results become more preferable as the ratio of a color dye of a coupler represented by formula (MC-1) of the present invention in the contribution to the total magenta density increases. More specifically, the amount is such that the coupler represented by formula (MC-1) of the present invention accounts for preferably 20% or more, more preferably, 40% or more, and most preferably, 70% or more, as a molar ratio with respect to all the magenta couplers contained in the photosensitive material of the invention.

A sensitive material of the present invention can also contain a competing compound (a compound which competes with an image forming coupler to react with an oxidized form of a color developing agent and which does not form any dye image). Examples of this competing coupler are reducing compounds such as hydroquinones, catechols, hydrazines, and sulfonamidophenols, and compounds which couple with an oxidized form of a color developing agent but do not substantially form a color image (e.g., colorless compound-forming couplers disclosed in German Patent No. 1,155,675, British Patent No. 861,138, and U.S. Pat. Nos. 3,876,428 and 3,912,513, and flow-out couplers disclosed in JP-A-6-83002, the disclosures of which are herein incorporated by reference).

The competing compound is preferably added to a sensitive emulsion layer containing a magenta coupler represented by formula (MC-1) of the present invention or a non-sensitive layer. The completing compound is particularly preferably added to a sensitive emulsion layer containing a coupler represented by formula (MC-1) of the present invention. The content of a competing compound is 0.01 to 10 g, preferably 0.10 to 5.0 g per $m^2$ of a sensitive material. The content is 1 to 1,000 mol %, preferably 20 to 500 mol % with respect to the coupler represented by formula (MC-1) of the present invention.

In a sensitive material of the present invention, a sensitive unit sensitive to the same color can have a non-color-forming interlayer. Additionally, this interlayer preferably contains a compound selectable as the aforementioned competing compound.

To prevent deterioration of the photographic properties caused by formaldehyde gas, the sensitive material of the present invention preferably contains a compound described in U.S. Pat. Nos. 4,411,987 or 4,435,503, which can react with and fix formaldehyde gas.

The spectral sensitivity of a red-sensitive layer preferable to the present invention will be described below.

In the present invention, a spectral sensitivity distribution is obtained as follows. That is, a sensitive material with which a support is coated is exposed to equal-energy spectral light, described in JIS Z-8105, 2018, from 400 up to 700 nm, and processed by developing steps described in examples of this specification. The yellow, magenta, and cyan (status A) densities of the obtained image are measured, and the reciprocal of an exposure amount which gives a constant density at each wavelength is defined as the sensitivity at that wavelength. This sensitivity is used as a function of the wavelength.

In the present invention, a red-sensitive layer has the maximum value of sensitivity within the range of 580 to 650 nm (in this specification, this sensitivity is the one which gives a density of 1.0 in equal-energy spectral exposure unless otherwise specified. The density is measured by the status A. The spectral sensitivity distributions of blue-, green-, and red-sensitive emulsion layers are obtained by measuring the yellow, magenta, and cyan densities, respectively). A red-sensitive layer has the maximum value of sensitivity within the range of preferably 600 to 640 nm (more preferably, 610 to 635 nm).

Also, the sensitivity at 600 nm is preferably ⅓ or more (more preferably, ½ or more) of the sensitivity at the wavelength which gives the maximum value of sensitivity. The sensitivity at 670 nm is preferably 1/10 or less of the sensitivity at the wavelength which gives the maximum value of sensitivity.

A red-sensitive layer in the sensitive material of the present invention can have a plurality of peak points, i.e., a maximum point and at least one peak point, in its spectral sensitivity distribution. Herein, the maximum point gives a higher sensitivity than the peak point. For example, a red-sensitive layer can have a maximum point which gives the maximum value of sensitivity and a sensitivity peak point at a shorter wavelength or a longer wavelength than the wavelength giving the maximum sensitivity. When a red-sensitive layer has such a maximum point and a peak point, it is preferable that the maximum point which gives the maximum value of sensitivity be within the range of 630 to 650 nm and the peak point be within the range of 590 to 620 nm. It is also preferable that the peak point be within the range of 650 to 670 nm.

The spectral sensitivity of a red-sensitive layer of the present invention is preferably such that the maximum value of sensitivity exists at a wavelength of 600 to 640 nm, the sensitivity at 600 nm is ⅓ or more of the sensitivity at the wavelength which gives the maximum value of sensitivity, and the sensitivity at 670 nm is 1/10 or less of the sensitivity at the wave-length which gives the maximum value of sensitivity.

A quality factor representing the consistency between the spectral sensitivity described in the present invention and the human color sensitivity is a colorimetric quality factor (q factor) described in, e.g., "Journal of The Optical Society of America", Vol. 46, pp. 821 to 824 (1956) or "Journal of Japan Photographic Society", Vol. 61, No. 1, pp. 8 to 17 (1998), the disclosures of which are herein incorporated by reference. This q factor is known as an index which represents the consistency between spectral sensitivity and color matching functions (described in, e.g., "Journal of The Optical Society of America", Vol. 43, p. 533 ff. (1953), the disclosure of which is herein incorporated by reference). The q factor can be calculated by the method described in "Journal of Japan Photographic Society", Vol. 61, No. 1, p. 9 (1998), the disclosure of which is herein incorporated by reference. In the present invention, the g factor of a red-sensitive layer is 0.90 or more. However, the g factors of both green- and blue-sensitive layers are also preferably 0.90 or more.

A sensitizing dye used in the sensitive material of the present invention will be described below. The spectral sensitivity of the present invention is preferably achieved by using a compound represented by formula (SD-1) as a sensitizing dye.

IVA sgDetails of this compound represented by formula (SD-1) will be described below.

First, $A_1$ and $A_2$ will be explained. Each of $A_1$ and $A_2$ represents a substituted or nonsubstituted alkyl group (e.g., a 1- to 10-carbon alkyl group and a 7 to 12-total carbon alkyl group substituted with an aryl group; specifically, methyl, ethyl, n-propyl, i-propyl, n-butyl, 2-sulfoethyl, 3-sulfopropyl, 4-sulfobutyl, 5-sulfopentyl, carboxymethyl, 2-carboxyethyl, methanesulfonylcarbamoylmethyl, benzyl, 4-methoxybenzyl, 4-sulfoethylbenzyl, or 4-sulfopropyloxybenzyl). At least one of $A_1$ and $A_2$ is preferably a group having a sulfo group. It is also preferable that both of $A_1$ and $A_2$ be groups having a sulfo group. This sulfo group can be a salt of an alkaline metal such as sodium or potassium, a salt of an alkaline earth metal such as calcium, or an ammonium salt such as pyridinium, N-methylpyridinium, or tetrabutylammonium.

$Z_1$ represents an atomic group necessary to form a heterocyclic ring selected from the group consisting of substituted or nonsubstituted benzoimidazole, benzoxazole, and naphthoxazole. The ring to be formed is preferably benzoxazole or naphthoxazole.

$Z_2$ represents an atomic group necessary to form a heterocyclic ring selected from the group consisting of substituted or nonsubstituted benzothiazole, benzoselenazole, naphthothiazole, naphthoselenazole, and benzotellurazole. The ring to be formed is preferably benzothiazole, benzoselenazole, or naphthothiazole.

Each of $Z_1$ and $Z_2$ may have a substituent on the benzene ring. Examples of this substituent are those enumerated above for $R_2$ in formula (MC-1). Preferable examples are a halogen atom (a chlorine atom, bromine atom, and iodine atom), an alkyl group (e.g., a 1- to 10-carbon straight-chain, branched or cyclic alkyl group which can contain a substituent and a 7- to 15-total carbon alkyl group substituted with an aryl group which can further contain a substitutent other than the aryl group; specifically, methyl, ethyl, n-propyl, i-propyl, n-butyl, cyclohexyl, methoxymethyl, 2-methoxyethyl, 2-chloroethyl, trifluoromethyl, and hexafluoro-i-propyl; and benzyl, 3-methoxybenzyl, 4-chlorobenzyl, and 4-N,N-dimethylaminobenzyl), an alkoxy group (a 1- to 10-carbon alkoxy group which can contain a substituent; e.g., methoxy, ethoxy, 2-methoxyethoxy, and 2-chloroethoxy), an aryl group (a 6- to 12-carbon aryl group which can contain a substituent; e.g., phenyl, naphthyl, 4-methoxyphenyl, 2-chlorophenyl, hexafluorophenyl, and 4-N,N-dimethylphenyl), an aryloxy group (a 6- to 12-carbon aryloxy group which can contain a substituent; e.g., phenoxy, 2-cholophenoxy, 4-methoxyphenoxy, 4-(2-methoxyethoxy)-phenoxy, and naphthoxy), a cyano group, a hydroxy group, and a carboxyl group. A chlorine atom, an alkyl group, an alkoxy group, an aryl group, and an aryloxy group are particularly preferable.

$A_3$ represents a hydrogen atom, an alkyl group, or an aryl group, which can contain a substituent, for example, an alkyl group substituted with an aryl group. $A_3$ is preferably a hydrogen atom or a non substituted alkyl group, and most preferably, a hydrogen atom or a 1- to 5-carbon alkyl group (e.g., methyl, ethyl, n-propyl, i-propyl, n-butyl, i-butyl, or n-pentyl).

X represents a cation, and n is 1 or 2. When an intramolecular salt is to be formed, n is 1. Examples of the cation represented by X are a metal ion and ammonium salt. Preferable examples are sodium ion, potassium ion, lithium ion, tetramethylammonium ion, N-methylpyridinium ion, triethylammonium ion, tetraethylammonium ion, and pyridinium ion.

Practical compound examples of the sensitizing dye represented by formula (SD-1) will be presented below. However, the present invention is not restricted to these examples.

I-1

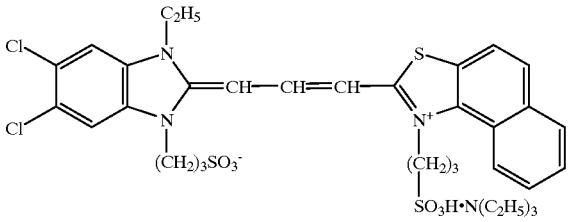

I-2

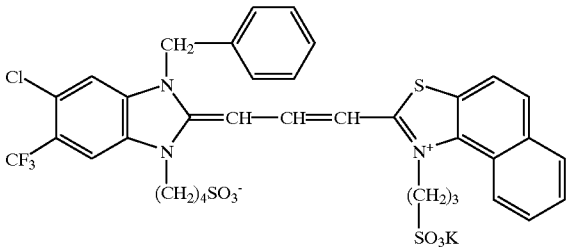

I-3

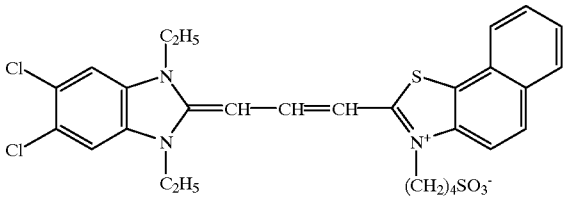

I-4

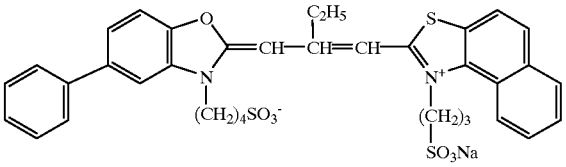

I-5

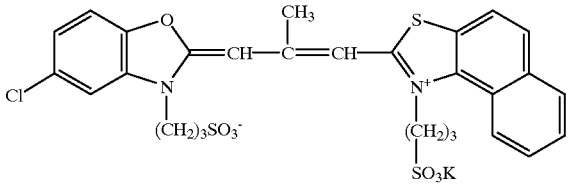

-continued

I-6

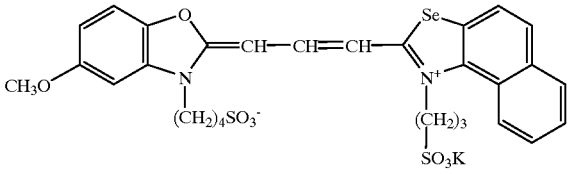

I-7

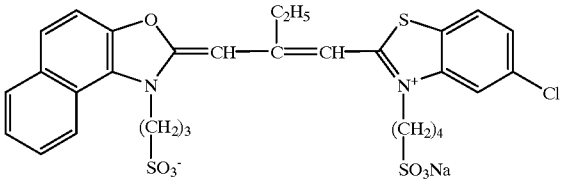

I-8

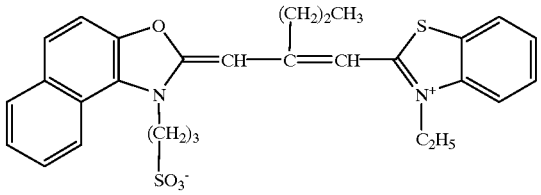

I-9

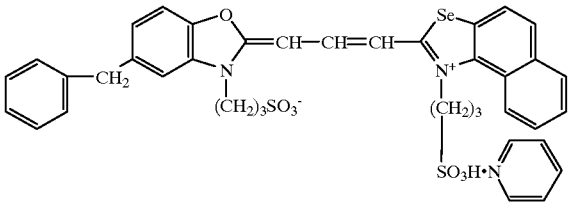

I-10

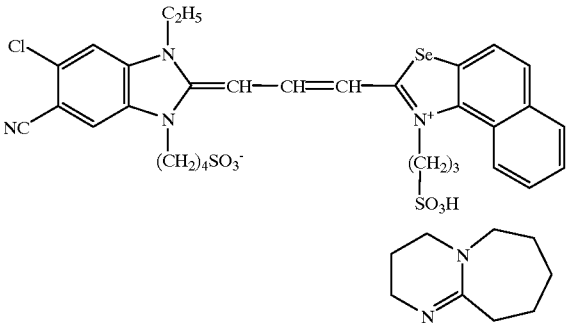

I-11

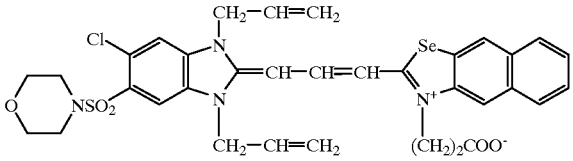

-continued
I-12
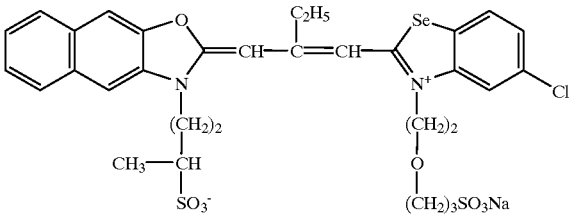
I-13
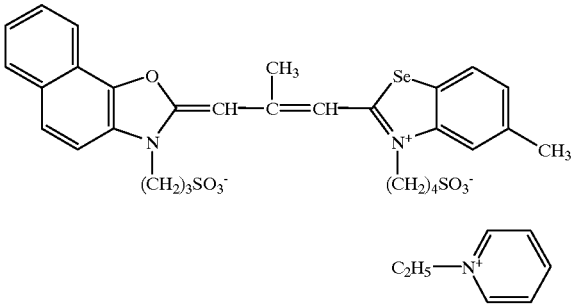
I-14
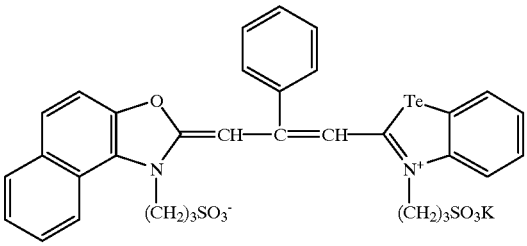
I-15
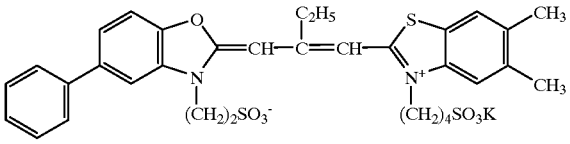
I-16
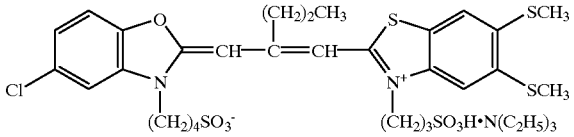
I-17
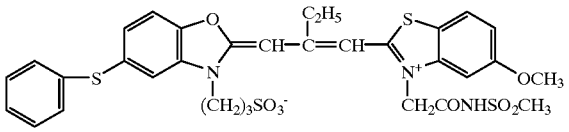
-continued
I-18
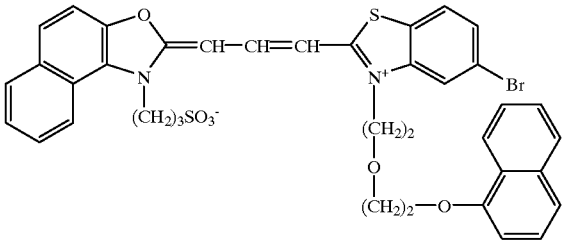
I-19
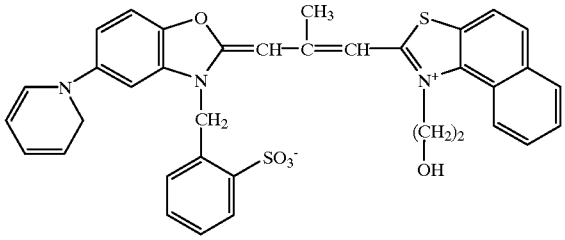
I-20
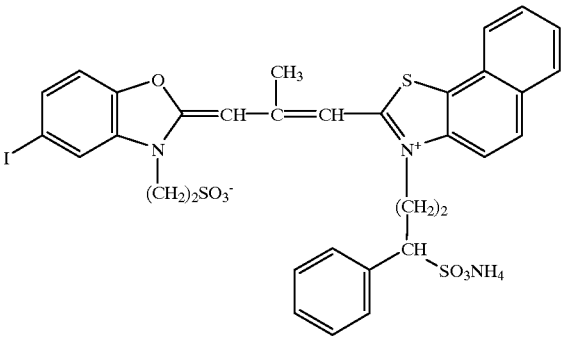
I-21
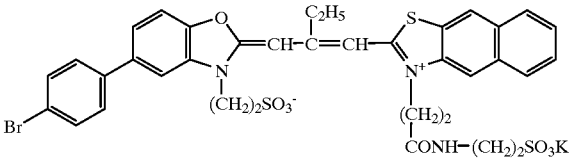
I-22
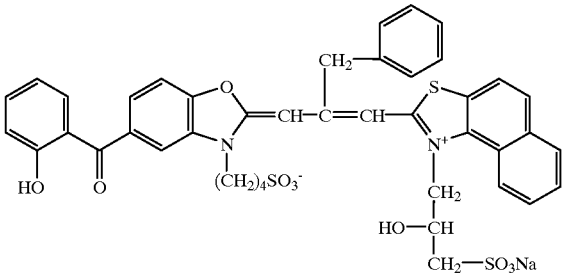

-continued

I-23

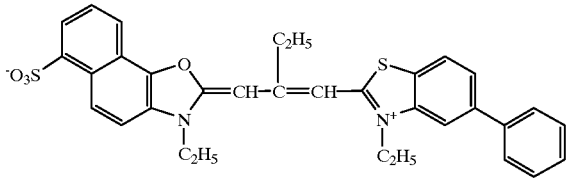

I-24

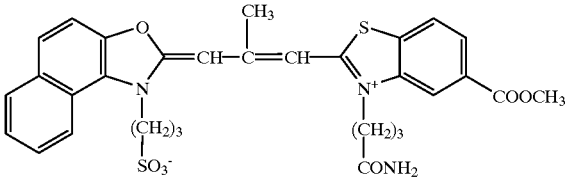

I-25

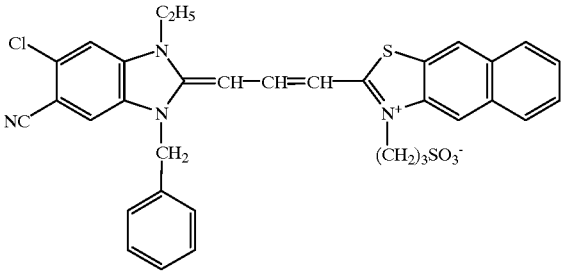

I-26

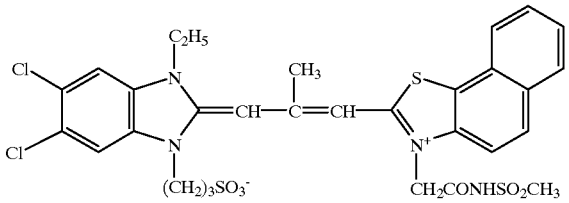

I-27

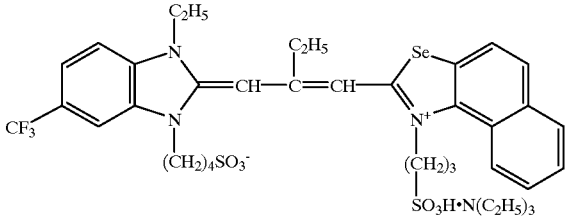

I-28

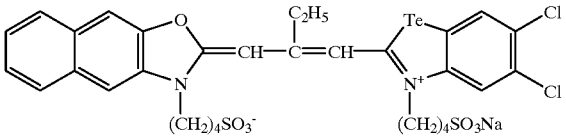

I-29

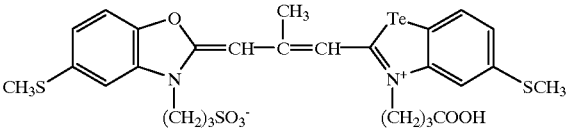

In the present invention, the compound represented by formula (SD-1) is contained at a molar ratio of 10% to 100% of the total amount of sensitizing dyes in all the red-sensitive emulsion layers. The ratio of a compound represented by formula (SD-1) is preferably 30 mol % or more, and more preferably, 50 mol % or more.

Any sensitizing dye can be used in combination with the compound represented by formula (SD-1) of the present invention. It is preferable to use the compound represented by formula (SD-1) of the present invention in combination with the sensitizing dyes having the same chemical structure as that of formula (SD-1), except that the terminal atom of the atomic group represented by $Z_1$, which bonds to the carbon atom of —N(—$A_1$)—C(—$Z_1$)=, is a sulfur atom, a selenium atom or a tellurium atom, and the heterocyclic ring formed with $Z_1$ is selected from the group consisting of benzothiazole, naphthothiazole, benzoselenazole, naphthoselenazole, benzotellurazole and naphthotellurazole.

Although any coupler can be contained in red-sensitive emulsion layers of a sensitive material of the present invention, a cyan coupler of a phenol derivative or a pyrroloazole cyan coupler as described in JP-A-9-43790, the disclosure of which is herein incorporated by reference, is preferably contained.

The sensitive material of the present invention has at least one green-sensitive emulsion layer containing the coupler represented by formula (MC-1) of the present invention. Sensitive layers can be arranged by coating a support with at least one blue-sensitive silver halide emulsion layer, at least one green-sensitive silver halide emulsion layer, and at least one red-sensitive silver halide emulsion layer in this order. However, the order can also be changed. When the present invention is applied to a sensitive material for photographing, it is preferable to form red-, green-, and blue-sensitive silver halide emulsion layers in this order from a support. Each color-sensitive layer preferably has a unit configuration including two or more sensitive emulsion layers different in speed. Most preferably, each color-sensitive layer has a three-layered unit configuration including three sensitive emulsion layers, i.e., low-, medium-, and high-speed layers formed in this order from a support.

Emulsion layers differing in speed in the same unit are spectrally sensitized to substantially the same wavelength region. However, the wavelengths which give the maximum values of sensitivity of low- and high-speed emulsion layers can have a difference of about 0 to 15 nm. In a red-sensitive unit of the sensitive material of the present invention, the wavelength which gives the maximum value of sensitivity (by which a cyan density of 0.6 is given) of a low-speed layer is preferably longer by 0 to 10 nm than the wavelength which gives the maximum value of sensitivity (by which a cyan density of 2.0 is given) of a high-speed layer.

The sensitive material of the present invention is spectrally sensitized to blue sensitivity, green sensitivity, and red sensitivity. The wavelength which gives the maximum value of sensitivity of each sensitive layer is preferably 430 to 460 nm for a blue-sensitive layer and 520 to 560 nm for a green-sensitive layer. When a sensitive material of the present invention is spectrally sensitized as described above, a filter dye is preferably used where necessary. To increase color saturation, it is particularly preferable in the present invention to allow an intermediate layer between green- and red-sensitive layers to contain a dye whose wavelength by which the maximum value of absorption is given is 520 to 560 nm.

Next, a sensitive silver halide emulsion layer which does not substantially contribute to image formation but imparts the interimage effect to another layer will be described below. Imparting the interimage effect is to have an effect of suppressing development of another layer as a function of development of this sensitive silver halide emulsion layer.

In the present invention, "does not substantially contribute to image formation" means that the contribution of this layer to the yellow, magenta, and cyan dye image densities is small. This colorless sensitive emulsion layer can also contain a small amount of a coupler, i.e., can contain 20 mol % or less of a color-forming coupler with respect to couplers which generate the same color and which are contained in the whole material. This layer is preferably a low-color-forming layer which contains 10 mol % or less of such a coupler with respect to couplers which generate the same color, and more preferably, a layer containing no image-forming coupler. Also, this layer preferably contains the compound previously enumerated as a competing compound.

In the present invention, this sensitive silver halide emulsion layer (to be also referred to as the fourth sensitive layer hereinafter) is so spectrally sensitized as to have the maximum value of sensitivity at a wavelength of 480 to 550 nm. The faithfulness of color reproduction can be improved by forming the fourth sensitive layer like this and suppressing development of a red-sensitive layer as a function of development of this fourth sensitive layer.

Also, this layer preferably contains a substance having a development inhibiting function. Known techniques can be used as this substance having a development inhibiting function. Examples are silver iodobromide containing at least 2 to 40 mol % of silver iodide, silver bromochloroiodide, or silver iodide (preferably fine-grain silver iodide having an average grain diameter of 0.05 to 0.20 $\mu$m), a development inhibitor (e.g., mercaptotetrazoles, mercaptothiadiazoles, mercaptoxadiazoles, mercaptoimidazoles, mercaptotetrazoles, mercaptobenzothiazoles, mercaptobenzimidazoles, mercaptobenzoxazoles, mercaptothiazoles, benzotriazoles, and benzimidazoles), and a development inhibitor precursor.

The fourth sensitive layer can be formed in any position of a sensitive material. However, this fourth sensitive layer is preferably formed closer to a support than a red-sensitive layer, between red- and green-sensitive layers, or between blue- and green-sensitive layers.

The fourth sensitive layer is most preferably formed between red- and green-sensitive layers or closer to a support than a red-sensitive layer.

Color reproduction by a subtractive color process is possible when each of these sensitive emulsion layers contains a silver halide emulsion sensitive to the corresponding wavelength region and a color coupler for forming a dye which has a complementary color relationship with light to which the emulsion is sensitive. However, the sensitive emulsion layer and the color coupler contained therein need not have the above correspondence. Also, a coupler which generates another hue can be mixed with the coupler for forming a dye which has a complementary color relationship. For example, the shade depicting capability can be improved by mixing a cyan-forming coupler or a black-forming coupler, in addition to a coupler represented by formula (MC-1) of the present invention, in high- and medium-speed layers of a green-sensitive emulsion unit.

Silver halide emulsions to be contained in a sensitive material of the present invention will be described below.

Sensitive silver halide grains for use in the present invention are silver bromide, silver chloride, silver iodide, silver chlorobromide, silver iodochloride, silver iodobromide, or silver bromochloroiodide. The silver halide emulsion can also contain another silver salt, such as silver rhodanate, silver sulfide, silver selenide, silver carbonate, silver phosphate, or organic acid silver, as another grain or as a portion of the silver halide grain. In the present invention, silver iodobromide or silver bromochloroiodide is preferable. More preferably, 0.5 to 30 mol % of silver iodide are contained. Silver iodobromide or silver bromochloroiodide containing 1 to 10 mol % of silver iodide is most preferable.

The silver halide emulsion of the present invention preferably has a distribution or a structure in connection with a halogen composition in its grains. A typical example of such a grain is a core-shell or double structure grain having different halogen compositions in its interior and surface layer as disclosed in, e.g., JP-B-43-13162, JP-A's-61-215540, 60-222845, 60-143331, or 61-75337, the disclosures of which are herein incorporated by reference. The structure need not be a simple double structure but can be a triple structure or a higher-order multiple structure as disclosed in JP-A-60-222844, the disclosure of which is herein incorporated by reference. It is also possible to bond a thin silver halide having a different composition from that of ia core-shell double-structure grain to the surface of the grain.

The structure to be formed inside a grain need not be the surrounding structure as described above but can be a so-called junctioned structure. Examples of the Functioned structure are disclosed in JP-A's-59-133540, and 58-108526, EP199,290A2, JP-B-58-24772, and JP-A-59-16254, the disclosures of which are herein incorporated by reference. A crystal to be junctioned can be formed on the edge, the corner, or the face of a host crystal to have a different composition from that of the host crystal. Such a Functioned crystal can be formed regardless of whether a host crystal is uniform in halogen composition or has a core-shell structure.

In a silver iodobromide grain having any of the above structures, it is preferable that the silver iodide content in the core portion be higher than that in the shell portion. In contrast, it is sometimes preferable that the silver iodide content in the core portion be low and that in the shell portion be high. Similarly, in the junctioned-structure grain, the silver iodide content can be high in the host crystal and low in the Functioned crystal and vice versa. The boundary portion between different halogen compositions in a grain having any of the above structures can be either definite or indefinite. It is also possible to positively form a continuous composition change.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. The opposite correlation or a correlation with respect to another halogen composition can also be selected in accordance with the intended use. For this purpose, it is preferable to mix two or more emulsions having different compositions.

Silver halide grains for use in the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), 1st ed., page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964, and this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842, the disclosures of which are herein incorporated by reference. It is also possible to use, in accordance with the intended use, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, Vol. 30, page 247, 1986, the disclosures of which are herein incorporated by reference, although the preparation method requires amn: some improvements. A grain having two or more different faces, such as a tetradecahedral grain having both (100) and (111) faces, a grain having (100) and (110) faces, or a grain having (111) and (110) faces, can also be used in accordance with the intended use.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157, the disclosures of which are herein incorporated by reference. The use of tabular grains brings about advantages, such as an increase in covering power and an increase in spectral sensitization efficiency due to sensitizing dyes. These advantages are described in detail in U.S. Pat. No. 4,434,226 cited above. The average aspect ratio of 80% or more of the total projected area of grains is preferably 1 to less than 100, more preferably, 2 to less than 20, and most preferably, 3 to less than 10. The shape of a tabular grain can be selected from, e.g., a triangle, a hexagon, and a circle. An example of a preferable shape is a regular hexagon having six substantially equal sides, as described in U.S. Pat. No. 4,797,354, the disclosure of which is herein incorporated by reference.

An equivalent-circle diameter of a projected area is often used as the grain size of a tabular grain. To improve the image quality, grains with an average diameter of 0.6 $\mu$m or smaller such as described in U.S. Pat. No. 4,748,106 are preferable. Also, as a shape of a tabular grain, defining the grain thickness to 0.5 $\mu$m or less, more preferably, 0.3 $\mu$m or less is preferable to improve the sharpness. Grains described in JP-A-63-163451 in which the grain thickness and the distance between twin planes are defined are also preferable.

More desirable results can sometimes be obtained when monodisperse tabular grains with a narrow grain size distribution are used. U.S. Pat. No. 4,797,354 and JP-A-2-838 describe methods of manufacturing monodisperse hexagonal tabular grains with high flatness. EP514,742 describes a method of manufacturing tabular grains whose variation coefficient of a grain size distribution is smaller than 10% by using a polyalkyleneoxide block copolymer. The use of these tabular grains in the present invention is preferable. Grains with a grain thickness variation coefficient of 30% or less, i.e., with a high thickness uniformity are also preferable.

Dislocation lines of a tabular grain can be observed by using a transmission electron microscope. It is preferable to select a grain containing no dislocations, a grain containing several dislocations, or a grain containing a large number of dislocations in accordance with the intended use. It is also possible to select dislocations introduced linearly with respect to a specific direction of a crystal orientation of a grain or dislocations curved with respect to that direction. Alternatively, it is possible to selectively introduce dislocations throughout an entire grain or only to a particular portion of a grain, e.g., the fringe portion of a grain. Introduction of dislocation lines is preferable not only for tabular grains but for a regular crystal grain or an irregular grain represented by a potato-like grain. In the case of these grains, as in the above case, it is preferable to limit the positions of dislocation lines to specific portions, such as the corners or the edges, of a grain.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from an ultrafine grain having an equivalent-sphere diameter of 0.05 $\mu$m or less to a coarse grain having that of 10 $\mu$m or more. It is preferable to use a grain having an equivalent-sphere diameter of 0.1 to 3 $\mu$m as a sensitive silver halide grain.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-circle diameter of the projected area of a grain or the equivalent-sphere diameter of the volume of a grain is sometimes used. When a monodisperse emulsion is to be used, it is desirable to use an emulsion having a size distribution with a variation coefficient of preferably 25% or less, more preferably, 20% or less, and most preferably, 15% or less.

In order for a sensitive material to satisfy its target gradation, two or more monodisperse silver halide emulsions having different grain sizes can be mixed in the same emulsion layer or applied as different layers in an emulsion layer having essentially the same color sensitivity. It is also possible to mix, or apply as different layers, two or more types of polydisperse silver halide emulsions or monodisperse emulsions together with polydisperse emulsions.

Silver halide grains for use in the present invention can be subjected to at least one of chalcogen sensitization, such as for example, sulfur sensitization and selenium sensitization, and noble metal sensitization such as, for example, gold sensitization and palladium sensitization, and reduction sensitization in any step of the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions used in the present invention, the position of a chemical sensitization nucleus can be selected in accordance with the intended use. However, it is generally preferable to form at least one type of a chemical sensitization nucleus near the surface.

It is preferable to perform gold sensitization for emulsions used in the present invention. An amount of a gold sensitizer is preferably $1\times10^{-4}$ to $1\times10^{-7}$ mol, and more preferably, $1\times10^{-5}$ to $5\times10^{-7}$ mol, per mol of silver halide. A preferable amount of a palladium compound is $1\times10^{-3}$ to $5\times10^{-7}$ mol. A preferable amount of a thiocyan compound or a selenocyan compound is $5\times10^{-2}$ to $1\times10^{-6}$ mol.

A sulfur sensitizer amount with respect to silver halide grains used in the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions used in the present invention. Known labile selenium compounds are used in this selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions for use in the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to perform two or more of these methods jointly.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although the addition amount of the reduction sensitizers depends upon the emulsion manufacturing conditions and hence must be so selected, an appropriate amount is $10^{-7}$ to $10^{-3}$ mol per mol of a silver halide.

Silver halide emulsions for red-sensitive layers of the present invention are spectrally sensitized by methine dyes and the like as described earlier. In addition to the spectral sensitizing dyes, the emulsions can contain dyes having no spectral sensitizing effect or substances which do not substantially absorb visible light and which present supersensitization effect.

The sensitizing dyes can be added to an emulsion at any point in the preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount can be $4\times10^{-6}$ to $8\times10^{-3}$ mol per mol of a silver halide. However, for a more preferable silver halide grain size of 0.2 to 1.2 $\mu$m, an addition amount of about $5\times10^{-5}$ to $2\times10^{-3}$ mol is more effective.

In silver halide photosensitive materials of the present invention and silver halide photographic emulsions used therein, it is generally possible to use various techniques and inorganic and organic materials described in Research Disclosure Nos. 308119 (1989), 37038 (1995), and 40145 (1997).

In addition, techniques and inorganic and organic materials usable in color photosensitive materials of the present invention can be applied are described in portions of EP436, 938A2 and patents cited below.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421,453A1, page 3, line 5 to page 25, line 55 |
| 5) Cyan couplers usable together | page 149, lines 29 to 33; EP432,804A2, page 3, line 28 to page 40, line 2 |
| 6) Polymer couplers | page 149, lines 34 to 38; EP435,334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435,334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421,453A1, page 75, line 21 to page 84, line 56, and page 27, line 40 to page 37, line 40 |
| 12) Dispersion methods | page 150, lines 4 to 24 |
| 13) supports | page 150, lines 32 to 34 |
| 14) Film thickness · film physical properties | page 150, lines 35 to 49 |
| 15) Color development step | page 150, line 50 to page 151, line 47 |

-continued

| Items | Corresponding portions |
|---|---|
| 16) Desilvering step | page 151, line 48 to page 152, line 53 |
| 17) Automatic processor | page 152, line 54 to page 153, line 2 |
| 18) Washing · stabilizing step | page 153, lines 3 to 37 |

EXAMPLE-1

The present invention will be described in detail below by way of its examples, but the invention is not limited to these examples.

Preparation of Sample 101

A multilayered color sensitive material including layers having the following compositions was formed on a 127-μm thick undercoated cellulose triacetate film support to make a sample 101. Numbers represent addition amounts per $m^2$. Note that the effects of added compounds are not restricted to the described purposes.

1st Layer: Antihalation Layer

| | |
|---|---|
| Black colloidal silver | 0.13 g |
| Gelatin | 2.00 g |
| Ultraviolet absorbent U-1 | 0.20 g |
| Ultraviolet absorbent U-3 | 0.040 g |
| Ultraviolet absorbent U-4 | 0.15 g |
| High-boiling organic solvent Oil-1 | 0.10 g |
| Dye D-4 | 1.0 mg |
| Dye D-8 | 2.5 mg |
| Fine crystal solid dispersion of dye E-1 | 0.10 g |

2nd Layer: Interlayer

| | |
|---|---|
| Gelatin | 0.40 g |
| Compound Cpd-C | 0.5 mg |
| Compound Cpd-J | 1.0 mg |
| Compound Cpd-K | 2.5 mg |
| Compound Cpd-N | 0.030 g |
| High-boiling organic solvent Oil-3 | 0.010 g |
| High-boiling organic solvent Oil-4 | 0.020 g |
| High-boiling organic solvent Oil-5 | 2.0 mg |
| High-boiling organic solvent Oil-7 | 2.0 mg |
| High-boiling organic solvent Oil-8 | 5.0 mg |
| Dye D-7 | 2.5 mg |

3rd Layer: Interlayer

| | | |
|---|---|---|
| Yellow colloidal silver | silver | 5 mg |
| Gelatin | | 0.40 g |
| Compound Cpd-M | | 0.010 g |
| High-boiling organic solvent Oil-3 | | 0.010 g |

4th Layer: Low-speed Red-sensitive Emulsion Layer

| | | |
|---|---|---|
| Emulsion A | silver | 0.25 g |
| Emulsion B | silver | 0.10 g |
| Emulsion C | silver | 0.20 g |
| Gelatin | | 0.70 g |

-continued

| | |
|---|---|
| Coupler C-1 | 0.030 g |
| Coupler C-2 | 0.020 g |
| Coupler C-3 | 0.010 g |
| Coupler C-9 | 5.0 mg |
| Coupler C-11 | 0.050 g |
| Compound Cpd-C | 5.0 mg |
| Compound Cpd-I | 0.020 g |
| Compound Cpd-J | 5.0 mg |
| High-boiling organic solvent Oil-2 | 0.10 g |
| Additive F-1 | 0.10 g |

5th Layer: Medium-speed Red-sensitive Emulsion Layer

| | | |
|---|---|---|
| Emulsion C | silver | 0.20 g |
| Emulsion D | silver | 0.15 g |
| Gelatin | | 0.60 g |
| Coupler C-1 | | 0.050 g |
| Coupler C-2 | | 0.020 g |
| Coupler C-3 | | 0.010 g |
| Coupler C-11 | | 0.10 g |
| High-boiling organic solvent Oil-2 | | 0.10 g |
| Additive P-1 | | 0.10 g |

6th Layer: High-speed Red-sensitive Emulsion Layer

| | | |
|---|---|---|
| Emulsion E | silver | 0.15 g |
| Emulsion F | silver | 0.15 g |
| Gelatin | | 1.00 g |
| Coupler C-1 | | 0.10 g |
| Coupler C-2 | | 0.050 g |
| Coupler C-3 | | 0.20 g |
| Coupler C-11 | | 0.30 g |
| High-boiling organic solvent Oil-2 | | 0.10 g |
| High-boiling organic solvent Oil-9 | | 0.20 g |
| Compound Cpd-K | | 2.0 mg |
| Compound Cpd-F | | 0.050 g |
| Additive P-1 | | 0.10 g |

7th Layer: Interlayer

| | |
|---|---|
| Gelatin | 0.50 g |
| Additive P-2 | 0.30 g |
| Compound Cpd-I | 2.6 mg |
| Dye D-5 | 0.020 g |
| Dye D-6 | 0.010 g |
| Compound Cpd-M | 0.040 g |
| Compound Cpd-0 | 3.0 mg |
| Compound Cpd-P | 2.5 mg |
| High-boiling organic solvent Oil-1 | 0.020 g |
| High-boiling organic solvent Oil-6 | 0.050 g |

8th Layer: Interlayer

| | | |
|---|---|---|
| Fine grain silver iodobromide emulsion having fogged surface and interior (average grain size 0.06 μm, variation coefficient 18%, AgI content 1 mol %) | silver | 0.010 g |
| Yellow colloidal silver | silver | 7.0 mg |
| Gelatin | | 0.60 g |
| Additive P-1 | | 0.05 g |
| Compound Cpd-A | | 0.10 g |
| Compound Cpd-M | | 0.050 g |
| High-boiling organic solvent Oil-6 | | 0.10 g |

9th Layer: Low-speed Green-sensitive Emulsion Layer

| | | |
|---|---|---|
| Emulsion G | silver | 0.25 g |
| Emulsion H | silver | 0.30 g |
| Emulsion I | silver | 0.25 g |
| Gelatin | | 1.00 g |
| Coupler C-7 | | 0.10 g |
| Coupler C-8 | | 0.17 g |
| Compound Cpd-B | | 0.030 g |
| Compound Cpd-D | | 0.020 g |
| Compound Cpd-E | | 0.020 g |
| Compound Cpd-G | | 2.5 mg |
| Compound Cpd-F | | 0.040 g |
| Compound Cpd-K | | 2.0 mg |
| Compound Cpd-L | | 0.020 g |
| High-boiling organic solvent Oil-1 | | 0.05 g |
| High-boiling organic solvent Oil-2 | | 0.10 g |

10th Layer: Medium-speed Green-sensitive Emulsion Layer

| | | |
|---|---|---|
| Emulsion I | silver | 0.20 g |
| Emulsion J | silver | 0.20 g |
| Gelatin | | 0.70 g |
| Coupler C-4 | | 0.25 g |
| Compound Cpd-B | | 0.030 g |
| Compound Cpd-D | | 0.020 g |
| Compound Cpd-F | | 0.050 g |
| Compound Cpd-G | | 2.0 mg |
| High-boiling organic solvent Oil-2 | | 0.10 g |

11th Layer: High-speed Green-sensitive Emulsion Layer

| | | |
|---|---|---|
| Emulsion K | silver | 0.55 g |
| Gelatin | | 0.80 g |
| Coupler C-4 | | 0.35 g |
| Compound Cpd-B | | 0.080 g |
| Compound Cpd-D | | 0.020 g |
| Compound Cpd-F | | 0.040 g |
| Compound Cpd-K | | 5.0 mg |
| High-boiling organic solvent Oil-2 | | 0.15 g |

12th Layer: Interlayer

| | |
|---|---|
| Gelatin | 0.30 g |
| Compound Cpd-M | 0.05 g |
| High-boiling organic solvent Oil-3 | 0.025 g |
| High-boiling organic solvent Oil-6 | 0.025 g |

13th Layer: Yellow Filter Layer

| | | |
|---|---|---|
| Yellow colloidal silver | silver | 5.0 mg |
| Gelatin | | 1.00 g |
| Compound Cpd-C | | 0.010 g |
| Compound Cpd-M | | 0.030 g |
| Compound Cpd-L | | 0.010 g |
| High-boiling organic solvent Oil-1 | | 0.020 g |
| Fine crystal solid dispersion of dye E-2 | | 0.030 g |
| Fine crystal solid dispersion of dye E-3 | | 0.020 g |

14th Layer: Interlayer

| | |
|---|---|
| Gelatin | 0.40 g |

15th Layer: Low-speed Blue-sensitive Emulsion Layer

| | | |
|---|---|---|
| Emulsion L | silver | 0.20 g |
| Emulsion M | silver | 0.20 g |
| Gelatin | | 0.80 g |
| Coupler C-5 | | 0.20 g |
| Coupler C-6 | | 0.10 g |
| Coupler C-10 | | 0.10 g |
| Compound Cpd-I | | 0.010 g |
| Compound Cpd-M | | 0.010 g |

16th Layer: Medium-speed Blue-sensitive Emulsion Layer

| | | |
|---|---|---|
| Emulsion N | silver | 0.20 g |
| Emulsion O | silver | 0.20 g |
| Gelatin | | 0.90 g |
| Coupler C-5 | | 0.10 g |
| coupler C-6 | | 0.10 g |
| Coupler C-10 | | 0.10 g |
| Compound Cpd-N | | 2.0 mg |
| Compound Cpd-K | | 2.0 mg |
| High-boiling organic solvent Oil-2 | | 0.050 g |

17th Layer: High-speed Blue-sensitive Emulsion Layer

| | | |
|---|---|---|
| Emulsion O | silver | 0.20 g |
| Emulsion P | silver | 0.25 g |
| Gelatin | | 1.20 g |
| Coupler C-5 | | 0.10 g |
| Coupler C-6 | | 0.10 g |
| Coupler C-10 | | 0.80 g |
| High-boiling organic solvent Oil-2 | | 0.10 g |
| Compound Cpd-N | | 5.0 mg |
| Compound Cpd-Q | | 0.20 g |

18th Layer: 1st Protective Layer

| | |
|---|---|
| Gelatin | 0.70 g |
| Ultraviolet absorbent U-1 | 0.20 g |
| Ultraviolet absorbent U-2 | 0.050 g |
| Ultraviolet absorbent U-5 | 0.30 g |
| Compound Cpd-O | 5.0 mg |
| Compound Cpd-A | 0.030 g |
| Compound Cpd-H | 0.20 g |
| Dye D-1 | 0.10 g |
| Dye D-2 | 0.050 g |
| Dye D-3 | 0.07 g |
| High-boiling organic solvent Oil-3 | 0.10 g |

19th Layer: 2nd Protective Layer

| | | |
|---|---|---|
| Colloidal silver | silver | 0.10 mg |
| Fine grain silver iodobromide emulsion (average grain size 0.06 μm, AgI content 1 mol %) | silver | 0.10 g |
| Gelatin | | 0.50 g |

20th Layer: 3rd Protective Layer

| | |
|---|---|
| Gelatin | 0.80 g |
| Polymethylmethacrylate (average grain size 2.0 μm) | 0.10 g |
| 6:4 copolymer of methylmethacrylate and methacrylic acid (average grain size 1.5 μm) | 0.10 g |
| Silicone oil SO-1 | 0.10 g |
| Surfactant W-1 | 3.0 mg |
| Surfactant W-2 | 0.030 g |
| Surfactant W-7 | 2.5 mg |

In addition to the above compositions, additives F-1 to F-10 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

Silver iodobromide emulsions used in Sample 101 are as follows.

| Emulsion | Characteristics | Av. equivalent spherical diameter (μm) | COV* of diameter (%) | AgI Content (%) |
|---|---|---|---|---|
| A | Monodispersed tetradecahedral grains | 0.13 | 10 | 4.0 |
| B | Monodispersed cubic internally-fogged grains | 0.25 | 10 | 4.8 |
| C | Monodispersed tabular grains having an av.as.rt** of 2.0 | 0.30 | 15 | 3.8 |
| D | Monodispersed tabular grains having an av.as.rt** of 3.0 | 0.35 | 18 | 4.8 |
| E | Monodispersed tabular grains having an av.as.rt** of 3.0 | 0.40 | 15 | 2.0 |
| F | Monodispersed tabular grains having an av.as.rt** of 4.5 | 0.50 | 12 | 1.8 |
| G | Monodispersed cubic grains | 0.15 | 9 | 3.5 |
| H | Monodispersed cubic internally-fogged grains | 0.24 | 12 | 3.5 |
| I | Monodispersed tabular grains having an av.as.rt** of 4.0 | 0.30 | 17 | 3.5 |
| J | Monodispersed tabular grains having an av.as.rt** of 5.0 | 0.45 | 16 | 3.0 |
| K | Monodispersed tabular grains having an av.as.rt** of 5.5 | 0.60 | 13 | 3.3 |
| L | Monodispersed tetradecahedral grains | 0.33 | 10 | 4.5 |
| M | Monodispersed cubic grains | 0.33 | 9 | 4.5 |
| N | Monodispersed tabular grains having an av.as.rt** of 3.0 | 0.43 | 10 | 2.5 |

TABLE 1-continued

Silver iodobromide emulsions used in Sample 101 are as follows.

| Emulsion | Characteristics | Av. equivalent spherical diameter (μm) | COV* of diameter (%) | AgI Content (%) |
|---|---|---|---|---|
| O | Monodispersed tabular grains having an av.as.rt** of 6.0 | 0.75 | 9 | 2.0 |
| P | Monodispersed tabular grains having an av.as.rt** of 6.0 | 0.90 | 8 | 1.8 |

*COV: coefficient of variation in distribution

**av.as.rt: average aspect ratio

TABLE 2

Table 2 Spectral sensitization of Emulsions G to P

| Emulsion | Spectral sensitizer added | Addition amount per mol of silver halide(g) |
|---|---|---|
| G | S-4 | 0.30 |
| | S-5 | 0.10 |
| | S-12 | 0.10 |
| H | S-4 | 0.20 |
| | S-12 | 0.10 |
| I | S-4 | 0.25 |
| | S-5 | 0.10 |
| | S-12 | 0.15 |
| J | S-4 | 0.40 |
| | S-9 | 0.10 |
| | S-12 | 0.15 |
| K | S-4 | 0.25 |
| | S-5 | 0.050 |
| | S-9 | 0.050 |
| | S-12 | 0.15 |
| L | S-6 | 0.25 |
| | S-7 | 0.15 |
| | S-10 | 0.050 |
| M | S-6 | 0.10 |
| | S-10 | 0.15 |
| | S-11 | 0.25 |
| N | S-10 | 0.25 |
| | S-11 | 0.25 |
| O | S-6 | 0.10 |
| | S-10 | 0.20 |
| | S-11 | 0.25 |
| P | S-6 | 0.050 |
| | S-7 | 0.050 |
| | S-10 | 0.20 |
| | S-11 | 0.25 |

TABLE 3

Spectral sensitization of Emulsions A to F, A-(2) to F-(2), A-(3) to F-(3)
(Each of the addition amounts is expressed in gram per mol of silver halide)

| Spectral sensitizer | Emulsion | Addition amount | Molar ratio | Emulsion | Addition amount | Molar ratio | Emulsion | Addition amount | Molar ratio |
|---|---|---|---|---|---|---|---|---|---|
| S-1 | A | 0.02 | 7.2 | A-(2) | 0.01 | 3.8 | A-(3) | 0.01 | 4.0 |
| S-2 | | 0.25 | 77.5 | | 0.16 | 52.4 | | 0.08 | 27.2 |
| S-13 | | 0.04 | 10.7 | | 0.03 | 8.5 | | 0.03 | 8.8 |
| S-3 | | 0.015 | 4.6 | | 0.01 | 3.2 | | 0.01 | 3.3 |
| S-8 | | | | | 0.07 | 22.6 | | 0.12 | 40.3 |
| S-14 | | | | | 0.03 | 9.4 | | 0.05 | 16.3 |
| S-2 | B | 0.25 | 83.5 | B-(2) | 0.18 | 57.4 | B-(3) | 0.08 | 28.3 |
| S-13 | | 0.04 | 11.6 | | 0.03 | 8.3 | | 0.03 | 9.2 |
| S-8 | | 0.015 | 4.9 | | 0.07 | 22.1 | | 0.13 | 45.5 |
| S-14 | | | | | 0.04 | 12.2 | | 0.05 | 17.0 |
| S-2 | C | 0.25 | 83.5 | C-(2) | 0.18 | 63.1 | C-(3) | 0.12 | 35.0 |
| S-13 | | 0.04 | 11.6 | | 0.02 | 6.1 | | 0.02 | 5.0 |
| S-8 | | 0.015 | 4.9 | | 0.06 | 20.8 | | 0.16 | 46.0 |
| S-14 | | | | | 0.03 | 10.1 | | 0.05 | 13.9 |
| S-1 | D | 0.03 | 11.1 | D-(2) | 0.01 | 3.7 | D-(3) | 0.01 | 3.3 |
| S-2 | | 0.2 | 63.4 | | 0.15 | 47.7 | | 0.1 | 28.2 |
| S-3 | | 0.02 | 6.2 | | 0.02 | 6.2 | | 0.02 | 5.5 |
| S-13 | | 0.07 | 19.2 | | 0.03 | 8.3 | | 0.02 | 4.9 |
| S-8 | | | | | 0.07 | 22.0 | | 0.15 | 41.8 |
| S-14 | | | | | 0.04 | 12.2 | | 0.06 | 16.2 |
| S-1 | E | 0.02 | 8.4 | E-(2) | 0.02 | 8.6 | E-(3) | 0.02 | 7.1 |
| S-2 | | 0.15 | 53.6 | | 0.15 | 55.3 | | 0.12 | 36.4 |
| S-13 | | 0.1 | 31.0 | | | | | | |
| S-8 | | 0.02 | 7.1 | | 0.07 | 25.5 | | 0.14 | 42.0 |
| S-14 | | | | | 0.03 | 10.6 | | 0.05 | 14.5 |
| S-1 | F | 0.05 | 18.9 | F-(2) | 0.02 | 7.8 | F-(3) | 0.01 | 3.6 |
| S-2 | | 0.2 | 64.6 | | 0.15 | 50.0 | | 0.1 | 30.6 |
| S-13 | | 0.025 | 7.0 | | | | | | |
| S-8 | | 0.03 | 9.6 | | 0.08 | 26.3 | | 0.15 | 45.3 |
| S-14 | | | | | 0.05 | 15.9 | | 0.07 | 20.5 |

C-1

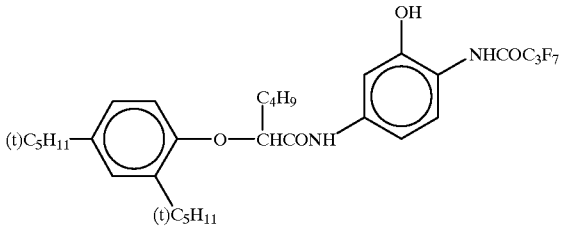

C-2

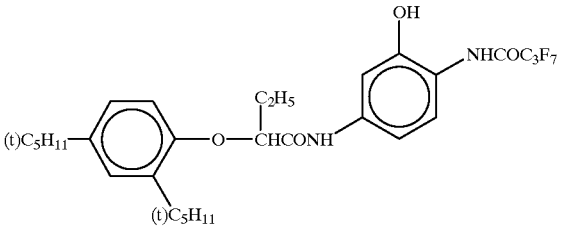

C-3

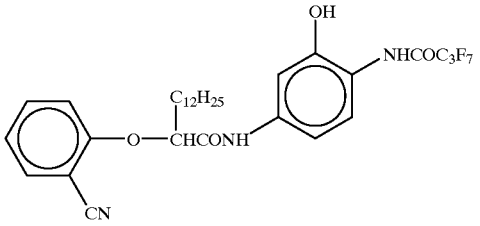

C-4

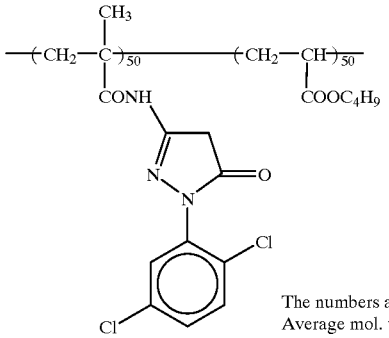

The numbers are in weight %
Average mol. wt.: about 25,000

-continued
C-5
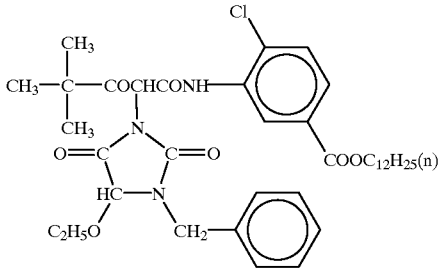
C-6
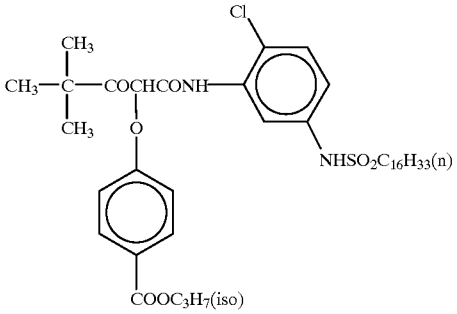
C-7
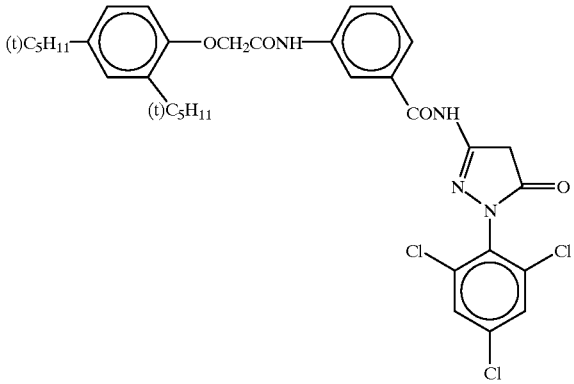
C-8
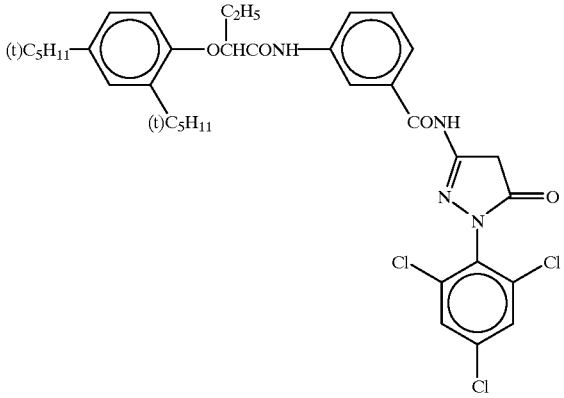
C-9
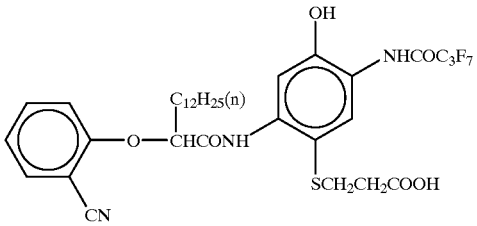
C-10
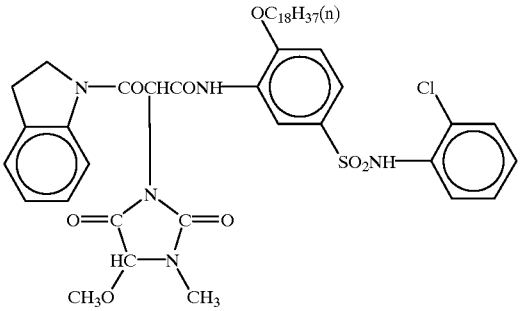
C-11
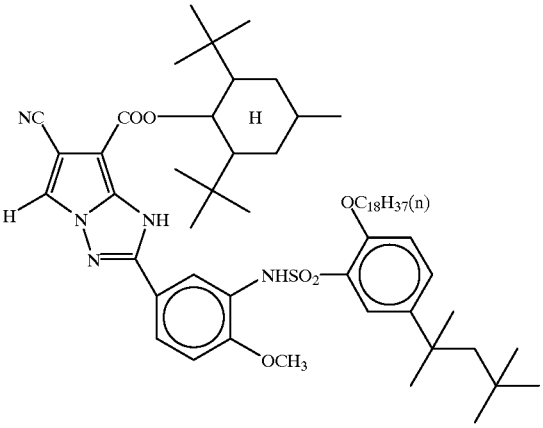
Oil-1
Dibutyl phthalate
Oil-2
Tricresyl phosphate
Oil-3
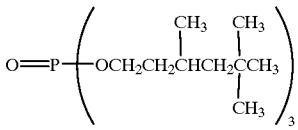

-continued
Oil-4
Tricyclohexyl phosphate
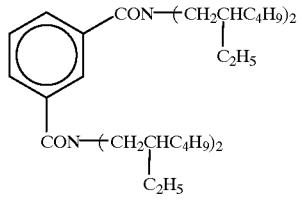
Oil-5
Dicyclohexyl phthalate
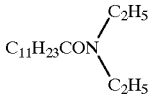
Oil-6
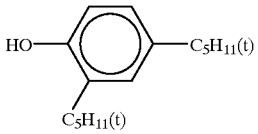
Oil-7
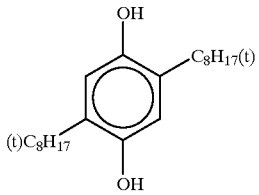
Oil-8
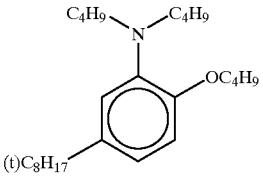
Oil-9
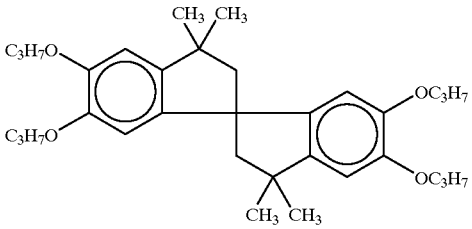
Cpd-A
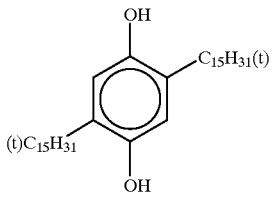
Cpd-B
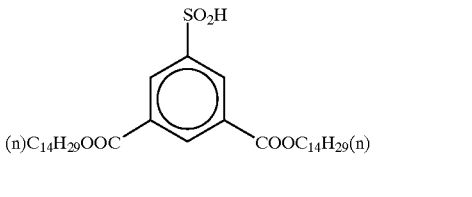
Cpd-C
Cpd-D
Cpd-E
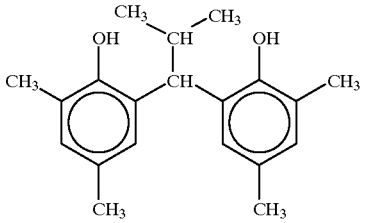
Cpd-F
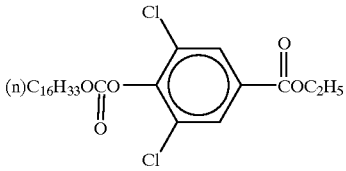
Cpd-G
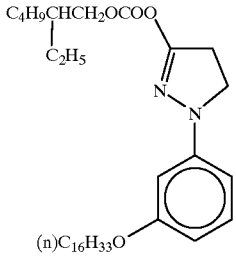
Cpd-H
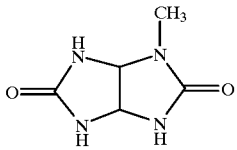

-continued
Cpd-I
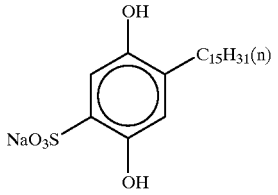
Cpd-J
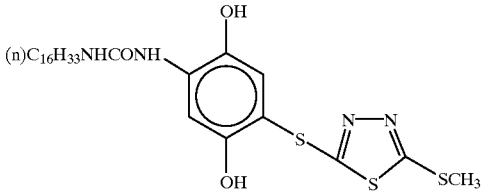
Cpd-K
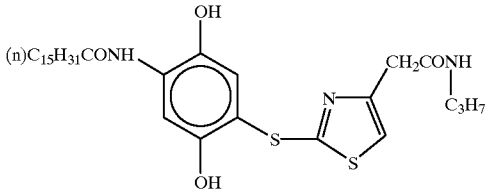
Cpd-L
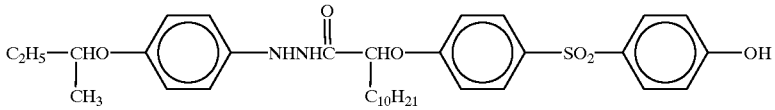
Cpd-M
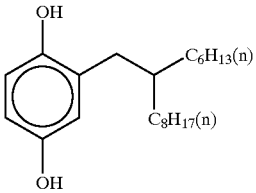
Cpd-N
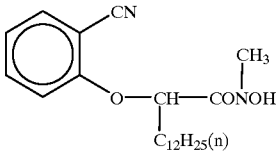
Cpd-O
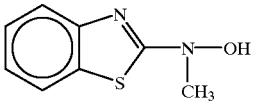
Cpd-P
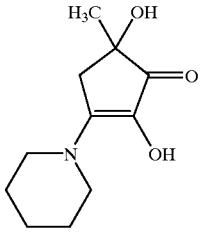
Cpd-Q
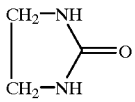
U-1
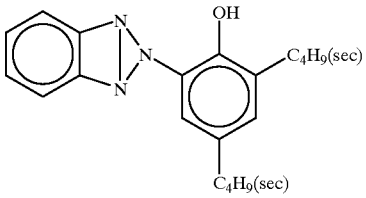
U-2
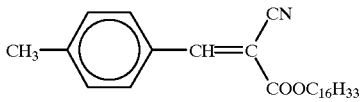
U-3
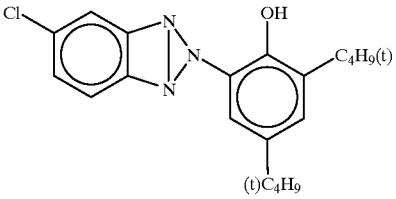

-continued
U-4
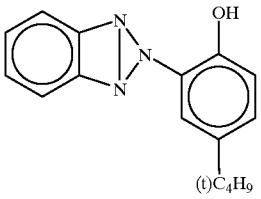
U-5
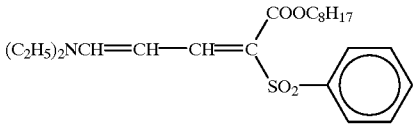
U-6
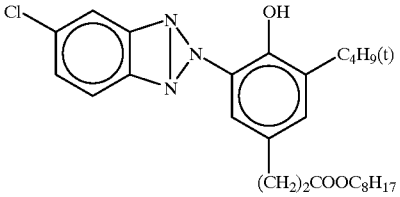
S-1
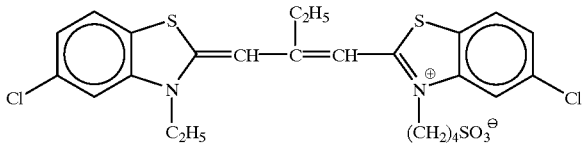
S-2
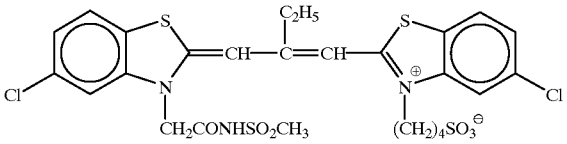
S-3
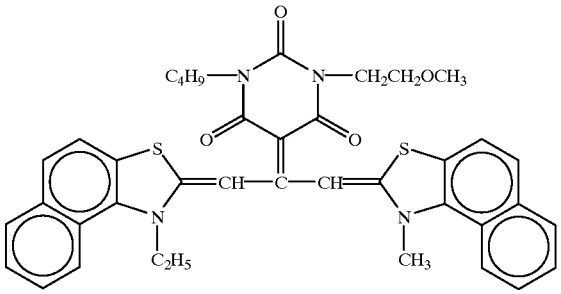
S-4
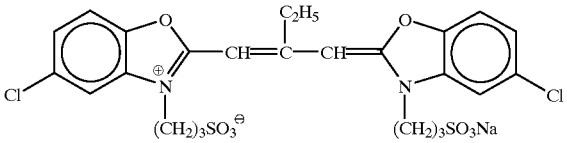
S-5
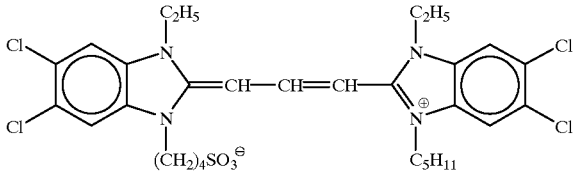
S-6
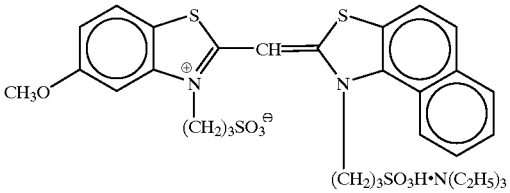
S-7
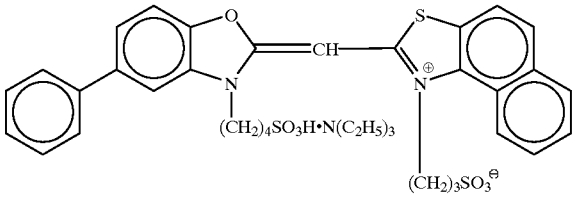
S-8
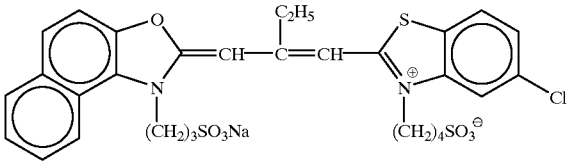
(The same compound as compound I-7 of the invention)
S-9
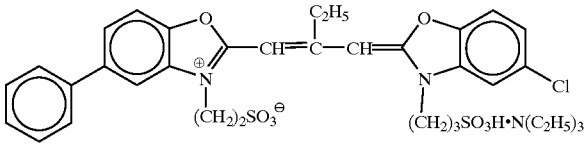
S-10
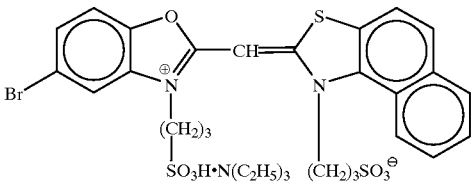
S-11
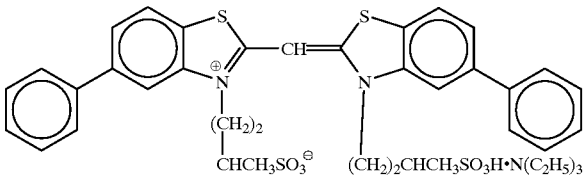

-continued
S-12
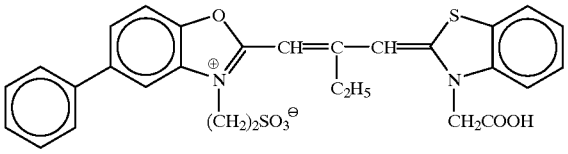
S-13
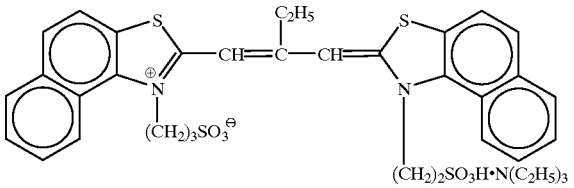
S-14
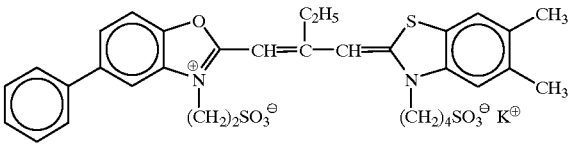
D-1
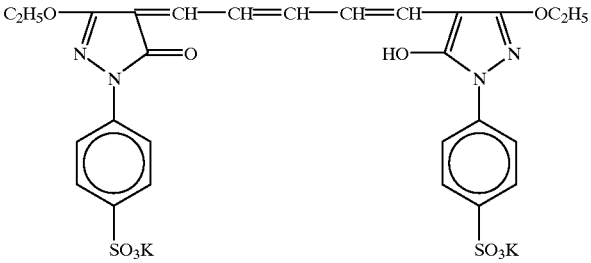
D-2
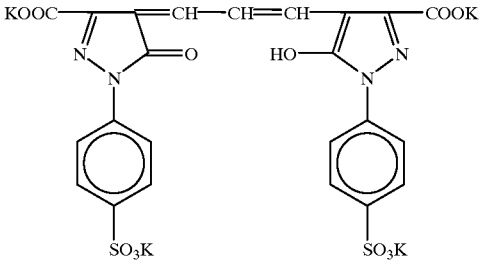
D-3
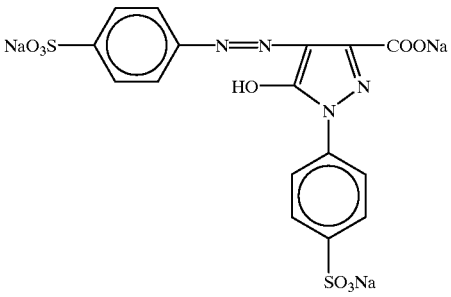
D-4
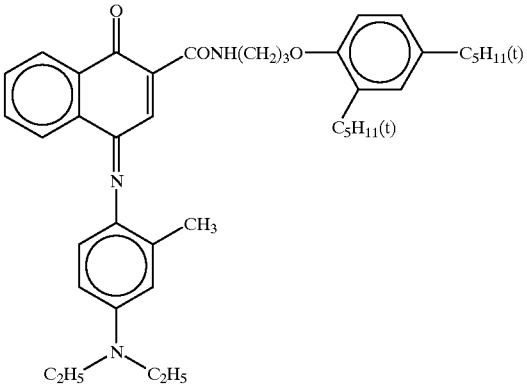
D-5
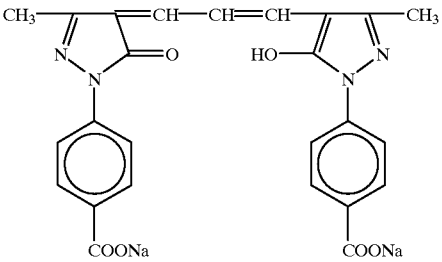
D-6
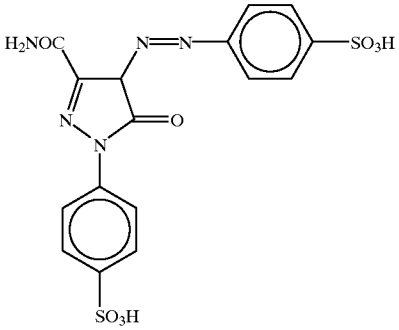
D-7
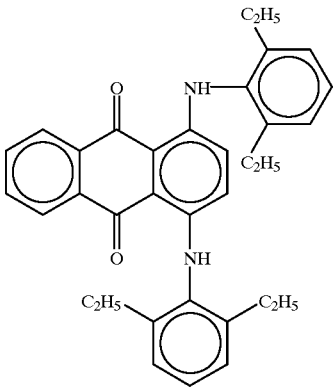

-continued
D-8
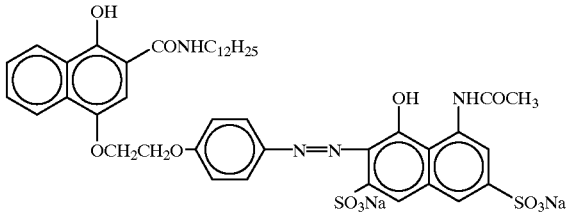
D-9
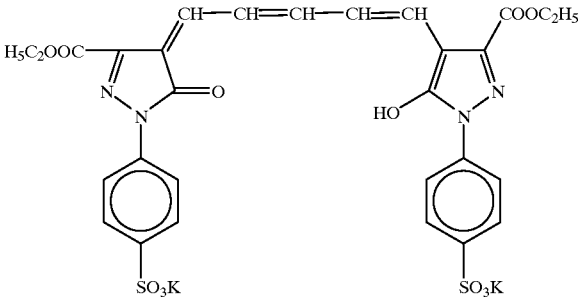
E-1
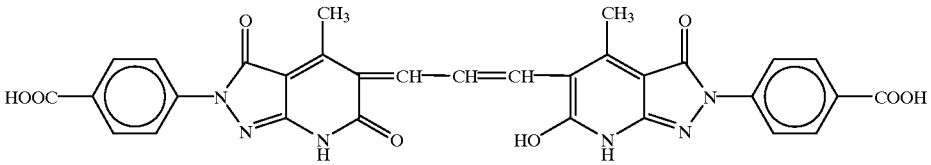
E-2
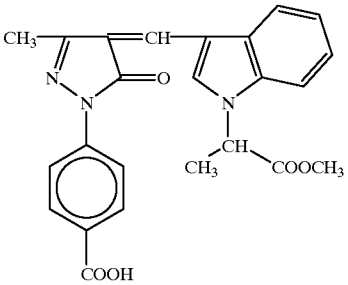
E-3
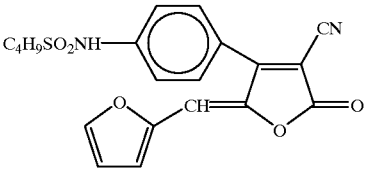
H-1
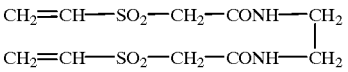
W-1
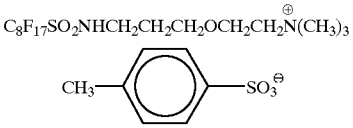
W-2
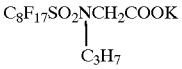
W-3
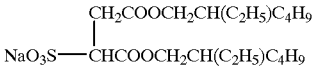
W-4
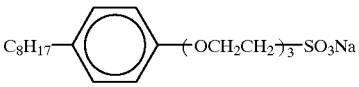
W-5
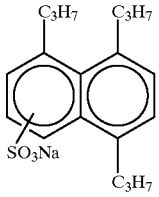
W-6
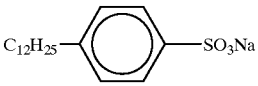
W-7
$C_8F_{17}SO_3Li$
P-1
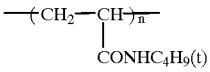
(n = 100–1000)
P-2
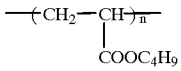
(n = 100–1000)

-continued

SO-1

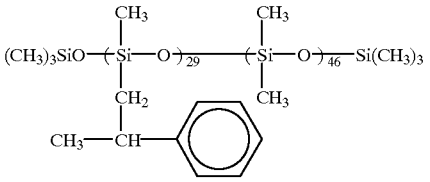

F-1

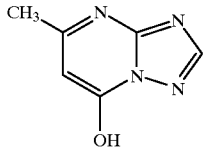

F-2

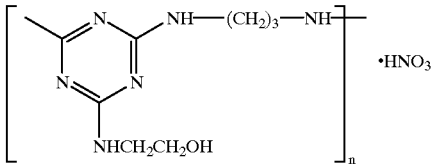

(n = 3–4)

F-3

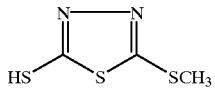

F-4

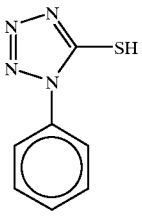

F-5

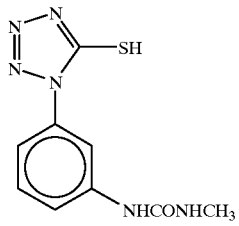

F-6

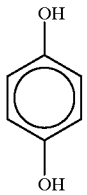

F-7

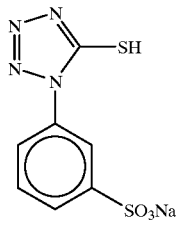

F-8

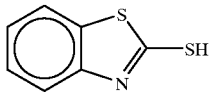

F-9

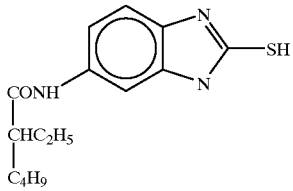

F-10

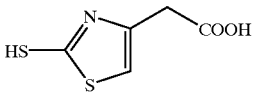

Preparation of Dispersion of Organic Solid Dispersed Dye

The dye E-1 was dispersed by the following method. That is, water and 200 g of Pluronic F88 (ethylene oxide-propylene oxide block copolymer) manufactured by BASF CORP. were added to 1,430 g of a dye wet cake containing 30% of methanol, and the resultant material was stirred to form a slurry having a dye concentration of 6%. Next, Ultra Visco Mill (UVM-2) manufactured by Imex K.K. was filled with 1,700 mL of zirconia beads with an average grain size of 0.5 mm, and the slurry was milled through UVM-2 at a peripheral speed of approximately 10 m/sec and a discharge rate of 0.5 L/min for 8 hr. The beads were filtered away, and water was added to dilute the material to a dye concentration of 3%. After that, the material was heated to 90° C. for 10 hr for a stabilization purpose. The average grain size of the obtained fine dye grains was 0.60 μm. The grain size distribution (grain size standard deviation×100/average grain size) was 18%.

Following the same procedure as above, solid dispersions of the dyes E-2 and E-3 were obtained. The average grain sizes were found to be 0.54 and 0.56 μm, respectively.

The spectral sensitivity of the red-sensitive emulsion layers of the sample 101 obtained as above was as follows.

Wavelength by which a maximum value of sensitivity was given: 655 nm

Ratio of sensitivity at 600 nm to sensitivity at wavelength by which the maximum value was given: 1/4

Ratio of sensitivity at 670 nm to sensitivity at wavelength by which the maximum value was given: 1/6

A sample 102 was formed by changing the spectral sensitivity of red-sensitive emulsion layers as set forth below, and by removing the dye D-1 added to the sample 101 and adding a dye D-9.

Wavelength by which a maximum value of sensitivity was given: 635 nm

Ratio of sensitivity at 600 nm to sensitivity at wavelength by which the maximum value was given: 1/3

Ratio of sensitivity at 670 nm to sensitivity at wavelength by which the maximum value was given: 1/11

The sensitizing dyes of the emulsions A, B, C, D, E, and F of the sample 101 were replaced as shown in Table 3 to form emulsions A-(2), A-(3), B-(2), B-(3), C-(2), C-(3), D-(2), D-(3), E-(2), E-(3), F-(2), and F-(3). Samples 103 to 127 were formed by replacing the emulsions A, B, C, D, E, and F with equal silver amounts of the emulsions A-(2) or A-(3), B-(2) or B-(3), C-(2) or C-(3), D-(2) or D-(3), E-(2) or E-(3), and F-(2) or F-(3), respectively, as shown in Table 4, and by replacing the couplers C-7 and C-8 in the 9th layer and the coupler C-4 in the 10th and 11th layers as shown in Table 4. The couplers C-7 and C-8 were replaced with a 0.6-fold molar quantity, and the coupler C-4 was replaced with a 0.65-fold molar quantity. The high-boiling organic solvent Oil-2 was added to each replaced coupler in an amount of 0.30 g per 1.0 g of the coupler.

In the samples 119 to 127, a sensitive layer (C) presented below was formed in positions shown in Table 4.

| Sensitive layer (C) | |
|---|---|
| Emulsion X silver | 0.10 g |
| Gelatin | 0.50 g |
| Compound Cpd-A | 0.15 g |
| Compound Cpd-K | 0.20 g |
| Compound Cpd-I | 30.0 mg |
| High-boiling organic solvent Oil-3 | 0.20 g |
| Compound Cpd-L | 10.0 mg |
| Compound Cpd-M | 2.0 mg |

(Emulsion X: monodisperse tabular grains; average aspect ratio 5.0, sphere-equivalent average grain size 0.90 μm, variation coefficient 18%, AgI content 8.0 mol %, spectrally sensitized by adding 0.25 g of sensitizing dye S-10 per mol of silver).

Comparative coupler (A)

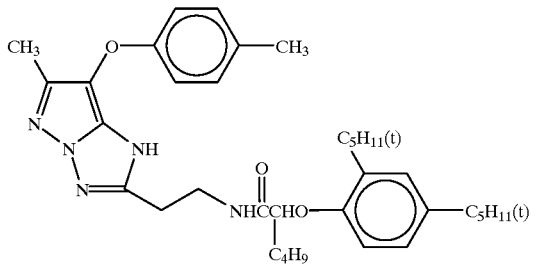

(Compound M-14 described in JP-A-62-49354)

Comparative coupler (B)

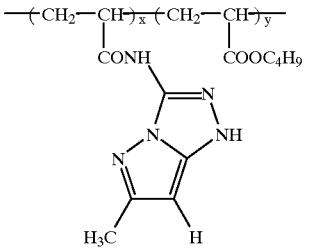

(Compound M-31 described in JP-A-62-49354)

x/y = 50/50 (weight ratio)

TABLE 4

| | | Sample configurations | | | | | | |
|---|---|---|---|---|---|---|---|---|
| | | Magenta coupler | | | Emulsions in red-sensitive layers | | | Sensitive |
| | Sample | 9th layer | 10th layer | 11th layer | 4th layer | 5th layer | 6th layer | layer (C) |
| 101 | Comparative example | As described in text | | | | | | None |
| 102 | Comparative example | As described in text | | | | | | None |
| 103 | Comparative example | Comparative coupler (A) | Comparative coupler (A) | Comparative coupler (A) | The same as 102 | The same as 102 | The same as 102 | None |
| 104 | Present invention | CA-4 | CA-4 | CA-4 | The same as 102 | The same as 102 | The same as 102 | None |
| 105 | Comparative example | The same as 101 | The same as 101 | The same as 101 | Emulsion A-(2) Emulsion B-(2) Emulsion C-(2) | Emulsion C-(2) Emulsion D-(2) | Emulsion E-(2) Emulsion F-(2) | None |
| 106 | Comparative example | Comparative coupler (A) | Comparative coupler (A) | Comparative coupler (A) | The same as 101 | The same as 101 | The same as 101 | None |
| 107 | Comparative example | Comparative coupler (A) | Comparative coupler (A) | Comparative coupler (A) | The same as 105 | The same as 105 | The same as 105 | None |
| 108 | Comparative example | Comparative coupler (B) | Comparative coupler (B) | Comparative coupler (B) | The same as 105 | The same as 105 | The same as 105 | None |
| 109 | Comparative example | CA-4 | CA-4 | CA-4 | The same as 101 | The same as 101 | The same as 101 | None |
| 110 | Comparative example | CA-16 | CA-16 | CA-16 | The same as 101 | The same as 101 | The same as 101 | None |

TABLE 4-continued

| | | Sample configurations | | | | | | |
|---|---|---|---|---|---|---|---|---|
| | | Magenta coupler | | | Emulsions in red-sensitive layers | | | Sensitive |
| | Sample | 9th layer | 10th layer | 11th layer | 4th layer | 5th layer | 6th layer | layer (C) |
| 111 | Present invention | CA-4 | CA-4 | CA-4 | The same as 105 | The same as 105 | The same as 105 | None |
| 112 | Present invention | CA-16 | CA-16 | CA-16 | The same as 105 | The same as 105 | The same as 105 | None |
| 113 | Present invention | 40% of C-7, 8 were replaced with CA-3 | 40% of C-4 were replaced with CA-3 | 40% of C-4 were replaced with CA-3 | The same as 105 | The same as 105 | The same as 105 | None |
| 114 | Present invention | 70% of C-7, 8 were replaced with CA-3 | 70% of C-4 were replaced with CA-3 | 70% of C-4 were replaced with CA-3 | The same as 105 | The same as 105 | The same as 105 | None |
| 115 | Present invention | CA-3 | CA-3 | CA-3 | The same as 105 | The same as 105 | The same as 105 | None |
| 116 | Present invention | CA-55 | CA-55 | CA-55 | The same as 105 | The same as 105 | The same as 105 | None |
| 117 | Present invention | CA-4 | CA-4 | CA-4 | Emulsion A-(3) Emulsion B-(3) Emulsion C-(3) | Emulsion C-(3) Emulsion D-(3) | Emulsion E-(3) Emulsion F-(3) | None |
| 118 | Comparative example | Comparative coupler (A) | Comparative coupler (A) | Comparative coupler (A) | The same as 117 | The same as 117 | The same as 117 | None |
| 119 | Comparative example | Comparative coupler (A) | Comparative coupler (A) | Comparative coupler (A) | The same as 117 | The same as 117 | The same as 117 | Between 8th and 9th layers |
| 120 | Present invention | CA-4 | CA-4 | CA-4 | The same as 117 | The same as 117 | The same as 117 | Between 8th and 9th layers |
| 121 | Present invention | CA-16 | CA-16 | CA-16 | The same as 105 | The same as 117 | The same as 117 | Between 11th and 12th layers |
| 122 | Present invention | CA-151 | CA-151 | CA-151 | The same as 105 | The same as 105 | The same as 105 | None |
| 123 | Present invention | CA-150 | CA-150 | CA-150 | The same as 117 | The same as 117 | The same as 117 | None |
| 124 | Present invention | CA-102 | CA-102 | CA-102 | The same as 117 | The same as 117 | The same as 117 | Between 8th and 9th layers |
| 125 | Present invention | CA-108 | CA-108 | CA-150 | The same as 117 | The same as 117 | The same as 117 | Between 2nd and 3rd layers |
| 126 | Present invention | CA-108 and CA-16 (8:2) | CA-108 and CA-16 (8:2) | CA-152 | The same as 117 | The same as 117 | The same as 117 | Between 2nd and 3rd layers |
| 127 | Present invention | CA-102 and PM-1 (8:2) | CA-102 and PM-1 (8:2) | 70% of C-4 were replaced with mixture (8:2) of CA-102 and PM-1 | The same as 117 | The same as 117 | The same as 117 | Between 2nd and 3rd layers |

Coupler PM-1

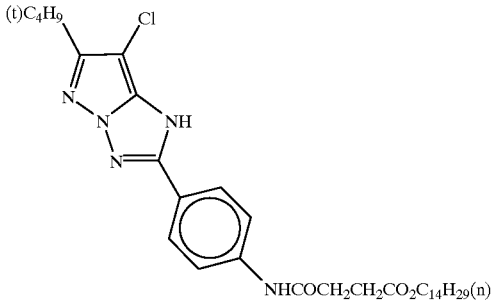

The following development was performed in this example. In this processing, 60% of each of FUJICHROME RVP and FUJICHROME RDPII (manufactured by Fuji Photo Film Co., Ltd.), ECTACHROME EPR and ECTACHROME E100S (Manufactured by Eastman Kodak), and the samples 101 and 112 were completely exposed to white light, and the resultant materials were used after being processed at a ratio of 1:3:2:1:1:2 until the replenishment amount was five times the tank volume.

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |

-continued

| Processing Step | Time | Temperature | Tank volume | Replenishment rate |
|---|---|---|---|---|
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid. pentasodium salt | 1.5 g | 1.5 g |
| Diethylenetriamine pentaacetic acid. pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid. pentasodium salt | 3.0 g | the same as tank solution |
| Stannous chloride.dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid. pentasodium salt | 2.0 g | 2.0 g |
| Sodium sulfite | 7.0 g | 7.0 g |
| Trisodium phosphate. dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline.3/2 sulfuric acid.monohydrate | 11 g | 11 g |

-continued

| <Color developer> | <Tank solution> | <Replenisher> |
|---|---|---|
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid.disodium salt. dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid.disodium salt. dihydrate | 2.0 g | 4.0 g |
| Ethylenediaminetetraacetic acid.Fe(III).ammonium. dihydrate | 120 g | 240 g |
| Potassium bromide | 100 g | 200 g |
| Ammonium nitrate | 10 g | 20 g |
| Water to make | 1,0000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

(Evaluation of Samples)

(Evaluation of Color Reproduction)

Each of the samples 101 to 127 was cut into a 135 size, processed into the form of a magazine, and loaded into a camera. Each resultant film was used to photograph "COLOR CHECKER" manufactured by Macbeth Corp. and subjected to the abovementioned development-processing to first obtain filter conditions, by which the gray balance of the result of photographing of Gray 5 was met, for each sample. Through this filter, a bluish purple object, purple object, red object, and green object were photographed. Ten research workers participating in image evaluation at Fuji Photo Film Ashigara Laboratory made organoleptic evaluation on the photographed and developed results. That is, each research worker marked the degrees of reproduction of the hue and perceived chroma of each original on the basis of 10 points, and the points were totaled. The reproduction of hue was evaluated on the basis of the difference in hue between the colors of the bluish purple and purple objects and the reproduced colors. The perceived chroma was evaluated on the basis of the perceived chroma of the red and green objects.

(Evaluation of Coloration After Processing)

Each of the samples 101 to 127 was exposed outdoors in the sun at daytime for 1 minute and subjected to the development-processing described above, and the magenta density of a white portion was measured. The measurement was performed in the status A mode of the X-light manufactured by X-light Corp. The higher the density, the more the white portion was colored, so the worse the result.

(Evaluation of Storage Stability)

Each of the samples 101 to 127 was stored for two weeks at 40° C.–80%RH and loaded into a camera by the aforementioned method. Each resultant film was used to photograph Macbeth "COLOR CHECKER" after filter conditions were obtained such that the gray balance was met. The color reproductions of red and green after photographing and development were compared with the results before storage. ○ indicates "almost no difference was found"; Δ, "difference was found but allowable"; and ×, "unallowable color impurity occurred".

The results are summarized in Table 5 below.

TABLE 5

| Sample | Results of evaluation: Hue reproduction of bluish purple and purple (on the basis of 100 points) | Perceived chroma reproduction of red and green (on the basis of 100 points) | White portion coloration (status A: magenta density) | Storage stability (changes in color reproduction of red and green before and after storage) |
|---|---|---|---|---|
| 101 Comparative example | 53 | 75 | 0.10 | Δ |
| 102 Comparative example | 78 | 40 | 0.11 | Δ |
| 103 Comparative example | 82 | 68 | 0.13 | Δ |
| 104 Present invention | 85 | 90 | 0.10 | ○ |
| 105 Comparative example | 83 | 40 | 0.11 | Δ |
| 106 Comparative example | 50 | 90 | 0.12 | Δ |
| 107 Comparative example | 80 | 72 | 0.23 | x |
| 108 Comparative example | 80 | 75 | 0.22 | x |
| 109 Comparative example | 55 | 92 | 0.11 | ○ |
| 110 Comparative example | 52 | 94 | 0.10 | ○ |
| 111 Present invention | 82 | 95 | 0.08 | ○ |
| 112 Present invention | 80 | 94 | 0.09 | ○ |
| 113 Present invention | 82 | 82 | 0.08 | ○ |
| 114 Present invention | 82 | 88 | 0.08 | ○ |
| 115 Present invention | 80 | 92 | 0.09 | ○ |
| 116 Present invention | 80 | 90 | 0.08 | ○ |
| 117 Present invention | 90 | 90 | 0.09 | ○ |
| 118 Comparative example | 90 | 75 | 0.27 | x |
| 119 Comparative example | 95 | 70 | 0.28 | x |
| 120 Present invention | 95 | 90 | 0.09 | ○ |
| 121 Present invention | 95 | 88 | 0.09 | ○ |
| 122 Present invention | 83 | 90 | 0.08 | ○ |
| 123 Present invention | 90 | 92 | 0.08 | ○ |
| 124 Present invention | 95 | 92 | 0.09 | ○ |
| 125 Present invention | 97 | 93 | 0.08 | ○ |
| 126 Present invention | 97 | 92 | 0.09 | ○ |
| 127 Present invention | 97 | 93 | 0.09 | ○ |

In the sample 102 in which the spectral sensitivity of the red-sensitive layer was shifted to a shorter wavelength than in the sample 101, the faithfulness of the hue of purple improved, but the perceived chroma lowered significantly. When a comparative coupler (A) as a 2-equivalent pyrazolotriazole coupler was used, this perceived chroma of red slightly recovered but was still unsatisfactory, and the perceived chroma of green lowered. By contrast, in the sample 104 of the present invention the perceived chroma of red and green recovered while the faithfulness of the hue of purple was maintained.

In the samples 107, 108, 118, and 119 using comparative coupler (A) or (B) with respect to the sample 105 in which the spectral sensitivity of the red-sensitive layer was changed by the addition amount of sensitizing dyes of emulsions, the white portion magenta density after processing increased to significantly impair the image quality, or the raw storage stability was low. The samples of the present invention solved these problems and achieved both the faithfulness of hue and the perceived chroma.

EXAMPLE-2

Samples 220, 221, and 224 to 227 were formed following the same procedures as for the samples 120, 121, and 124 to 127, respectively, except that the configuration of the sensitive layer (C) was changed to a sensitive layer (D) as follows.

| Sensitive layer (D) | |
|---|---|
| Emulsion Y silver | 0.30 g |
| Gelatin | 0.80 g |
| Compound Cpd-A | 0.15 g |
| Compound Cpd-M | 0.20 g |
| Compound Cpd-I | 30.0 mg |
| High-boiling organic solvent Oil-3 | 0.20 g |
| Compound Cpd-L | 10.0 mg |
| Compound Cpd-K | 2.0 mg |

(Emulsion Y: monodisperse tabular grains; average aspect ratio 7.0, sphere-equivalent average grain size 1.20 μm, variation coefficient 25%, AgI content 8.5 mol %, spectrally sensitized by adding 0.25 g of sensitizing dye S-15 per mol of silver and 0.05 g of sensitizing dye S-4 per mol of silver.)

S-15

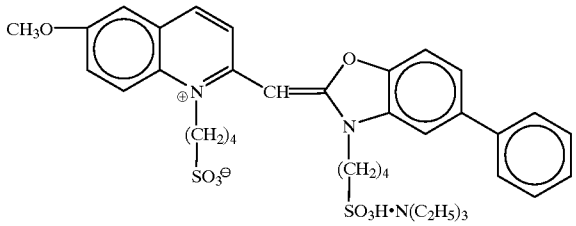

These samples 220, 221, and 224 to 227 were evaluated following the same procedures as in Example-1. Consequently, the green perceived chroma improved more and the results were more preferable than in the corresponding samples 120, 121, and 124 to 127.

EXAMPLE-3

The samples 101 to 127, 220, 221, and 224 to 227 were evaluated following the same procedures as in Example-1 except that the color developer used in the developing step in Example-1 was changed as follows.

| <Color developer> | <Tank solution> | <Replenisher> |
|---|---|---|
| Sodium sulfite | 7.0 g | 8.0 g |
| 5-sulfosalicylic acid dihydrate | 30 g | 30 g |
| Sodium bromide | 1.2 g | — |
| Potassium iodide | 80 mg | — |
| Sodium hydroxide | 20 g | 20 g |
| Citrazinic acid | 0.5 g | 0.6 g |
| N-ethyl-N-(β-methanesulfon amidoethyl)-3-methyl-4 aminoaniline. 3/2 sulfuric acid. monohydrate | 9 g | 13 g |
| 3,6-dithiaoctane-1,8-diol | 1.0 g | 1.0 g |
| Water to make | 1,000 ml | 1,000 ml |
| pH | 11.80 | 12.20 |

The pH was adjusted by sulfuric acid or potassium hydroxide.

In this processing, the present invention achieved favorable results as in Example-1.

EXAMPLE-4

The samples 101 to 127, 220, 221, and 224 to 227 were evaluated following the same procedures as in Example-1 except that the formaldehyde sodium bisulfite adduct of the pre-bleaching solution was removed.

In this processing, the present invention achieved favorable results as in Example-1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material having at least one blue-sensitive emulsion layer, at least one green-sensitive emulsion layer, and at least one red-sensitive emulsion layer on a support, wherein the red-sensitive emulsion layer has the maximum value of sensitivity in a wavelength region of 580 nm to 650 nm; and the green-sensitive emulsion layer contains at least one magenta coupler represented by formula (MC-1) below:

(MC-1)

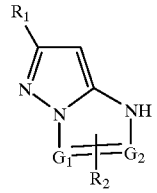

wherein $R_1$ represents a substituent selected from the group consisting of a secondary or tertiary alkyl group, an aryl group, an alkoxy group, an aryloxy group, an amino group, an acylamino group, an arylthio group, an alkylthio group, an aminocarbonylamino group, an alkoxycarbonylamino group, a carbamoyloxy group, and a heterocyclic thio group, provided that the substituents represented by $R_1$ may have a substituent; each of $G_1$ and $G_2$ represents a nitrogen atom or a carbon atom, provided that when $G_1$ is a nitrogen atom, $G_2$ is a carbon atom, and when $G_2$ is a nitrogen atom, $G_1$ is a carbon atom; $R_2$ represents a substituent, and $R_2$ substitutes one of $G_1$ and $G_2$ which is a carbon atom; provided that a group represented by formula (MC-1) can further substitute via $R_1$ or $R_2$ to form a polymer, and a group represented by formula (MC-1) can bond to a polymer chain via $R_1$ or $R_2$.

2. A silver halide color photosensitive material having at least one blue-sensitive emulsion layer, at east one green-sensitive emulsion layer, and at least one red-sensitive emulsion layer on a support, wherein the red-sensitive emulsion layer contains a spectral sensitizing dye represented by formula (SD-1) below at a molar ratio of 10% to 100% with respect to all the spectral sensitizing dyes contained in the layer:

(SD-1)

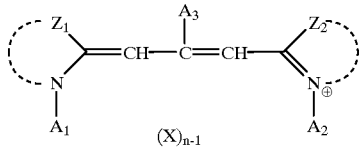

wherein $Z_1$ represents an atomic group necessary to form a heterocyclic ring selected from the group consisting of substituted or nonsubstituted benzoimidazole, benzoxazole, and naphthoxazole; $Z_2$ represents an atomic group necessary to form a heterocyclic ring selected from the group consisting of substituted or nonsubstituted benzothiazole, benzoselenazole, naphthothiazole, naphthoselenazole, and benzotellurazole; each of $A_1$ and $A_2$ independently represents a substituted or nonsubstituted alkyl group; $A_3$ represents a hydrogen atom, an alkyl group, or an aryl group; X represents a cation; and n is 1 or 2, provided that n is 1 when an intramolecular salt is to be formed; and the green-sensitive emulsion layer contains at least one type of a magenta coupler represented by formula (MC-1) of claim 1.

3. A silver halide color photosensitive material having at least one blue-sensitive emulsion layer, at least one green-sensitive emulsion layer, and at least one red-sensitive emulsion layer on a support, wherein a quality factor indicating the consistency between the spectral sensitivity of the red-sensitive emulsion layer and the color sensitivity of a human is 0.9 or more; and the green-sensitive emulsion layer contains at least one type of a magenta coupler represented by formula (MC-1) of claim 1.

4. The photosensitive material according to claim 2, wherein the red-sensitive emulsion layer has the maximum value of sensitivity in a wavelength region of 580 to 650 nm, or a quality factor indicating the consistency between the spectral sensitivity of the red-sensitive emulsion layer and the color sensitivity of a human is 0.9 or more.

5. A silver halide color photosensitive material having at least one blue-sensitive emulsion layer, at least one green-sensitive emulsion layer, and at least one red-sensitive emulsion layer on a support, wherein the photosensitive material further has a photosensitive silver halide emulsion layer which does not substantially generate an image dye but imparts the interimage effect to another layer; and the green-sensitive emulsion layer contains at least one type of a magenta coupler represented by formula (MC-1) of claim 1.

6. The photosensitive material according to claim 4, wherein the red-sensitive emulsion layer has the maximum value of sensitivity in a wavelength region of 600 nm to 640 nm; the sensitivity at 600 nm is ⅓ or more of the sensitivity at the wavelength giving the maximum value of sensitivity; and the sensitivity at 670 nm is 1/10 or less of the sensitivity at the wavelength giving the maximum sensitivity.

7. The photosensitive material according to claim 4, wherein the molar ratio of the sensitizing dye represented by formula (SD-1) is 30% to 100%.

8. The photosensitive material according to claim 7, wherein in formula (SD-1), the heterocyclic ring formed with $Z_1$ is selected from the group consisting of benzoxazole and naphthoxazole, each of which may be substituted or nonsubstituted; and the heterocyclic ring formed with $Z_2$ is selected from the group consisting of benzothiazole, benzoselenazole, naphthothiazole and naphthoselenazole, each of which may be substituted or nonsubstituted.

9. The photosensitive material according to claim 4, wherein in formula (MC-1), $G_1$ is a carbon atom; $G_2$ is a nitrogen atom; and $R_1$ is a tertiary alkyl group.

10. The photosensitive material according to claim 8, wherein an amount of the magenta coupler represented by formula (MC-1) is 40 mol % or more with respect to all the magenta couplers contained in the photosensitive material.

11. The photosensitive material according to claim 10, wherein in formula (MC-1), $G_1$ is a carbon atom; $G_2$ is a nitrogen atom; and $R_1$ is a tertiary alkyl group.

12. The photosensitive material according to claim 11, wherein the amount of the magenta coupler represented by formula (MC-1) is 70 mol % or more.

13. The photosensitive material according to claim 11, wherein the molar ratio of the sensitizing dye represented by formula (SD-1) is 50% to 100%.

14. The photosensitive material according to claim 11, wherein in formula (MC-1), $G_1$ is a carbon atom; $G_2$ is a nitrogen atom; $R_1$ is a tertiary alkyl group; and $R_2$ is represented by formula (BL-1):

(BL-1)

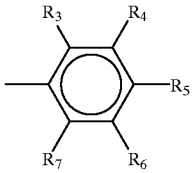

wherein each of $R_3$ to $R_7$ independently represents a hydrogen atom or a substituent, provided that at least one of $R_3$ to $R_7$ represents a substituent having a total number of carbon atoms of 4 to 70 and containing a substituted or nonsubstituted alkyl group as a partial structure or a substituent having a total number of carbon atoms of 6 to 70 and containing a substituted or nonsubstituted aryl group as a partial structure; or formula (BL-2):

(BL-2)

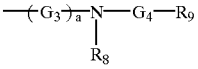

wherein $G_3$ represents a substituted or nonsubstituted methylene group; a represents an integer from 1 to 3; $R_8$ represents a hydrogen atom, an alkyl group or an aryl group; $G_4$ represents —CO— or —$SO_2$—; and $R_9$ represents a substituent having a total number of carbon atoms of 6 to 70 and containing a substituted or nonsubstituted alkyl group or aryl group as a partial structure.

15. The photosensitive material according to claim 12, wherein the molar ratio of the sensitizing dye represented by formula (SD-1) is 50% to 100%.

16. The photosensitive material according to claim 15, wherein in formula (MC-1), $G_1$ is a carbon atom; $G_2$ is a nitrogen atom; $R_1$ is a tertiary alkyl group; and $R_2$ is represented by formula (BL-1) or formula (BL-2) of claim 14.

17. A silver halide color photosensitive material having a red-sensitive unit layer comprising red-sensitive emulsion sub-layers, a green-sensitive unit layer comprising green-sensitive emulsion sub-layers, and a blue-sensitive unit layer comprising blue-sensitive emulsion sub-layers on a support in this order nearest from the support, wherein each of the unit layers is composed of two or more photosensitive emulsion sub-layers having the same color sensitivity but differing in speed, and each of the sub-layers contains a silver iodobromide photosensitive emulsion; and at least one of the green-sensitive emulsion sub-layers contains at least one magenta coupler represented by formula (MC-1):

(MC-1)

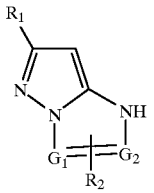

wherein $R_1$ represents a tertiary alkyl group; $G_1$ represents a carbon atom; $G_2$ represents a nitrogen atom; and $R_2$ is represented by formula (BL-1) or formula (BL-2) of claim 14;

an amount of the magenta coupler represented by formula (MC-1) is 40 mol % or more with respect to all the magenta couplers in the photosensitive material;

at least one of the red-sensitive emulsion sub-layers contains a sensitizing dye represented by formula (SD-1):

(SD-1)

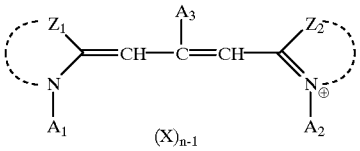

wherein $Z_1$ represents an atomic group necessary to form a heterocyclic ring selected from the group consisting of benzoxazole and naphthoxazole; $Z_2$ represents an atomic group necessary to form a heterocyclic ring selected from the group consisting of benzothiazole, benzoselenazole, naphthothiazole and naphthoselenazole, in an molar ratio in a range from 30% to 100% of all the sensitizing dyes contained in the red-sensitive unit layer; and the red-sensitive unit layer has the maximum value of sensitivity in a wavelength region from 600 nm to 640 nm.

18. The photosensitive material according to claim 17, wherein the amount of the magenta coupler represented by formula (MC-1) is 70 mol % or more; and the molar ratio of the sensitizing dye represented by formula (SD-1) is in a range from 50% to 100%.

19. The photosensitive material according to claim 5, wherein the photosensitive layer that does not substantially generate an image dye but imparts the interimage effect to another layer, contains a silver iodobromide photosensitive emulsion having an iodide content in a range from 2 mol % to 40 mol %.

20. The photosensitive material according to claim 17, wherein the material further comprises a photosensitive silver halide layer that does not substantially generate an image dye but imparts the interimage effect to another layer in which a silver iodobromide photosensitive emulsion having an iodide content in a range from 2 mol % to 40 mol %, is contained.

* * * * *